US010954769B2

(12) United States Patent
Randall et al.

(10) Patent No.: US 10,954,769 B2
(45) Date of Patent: Mar. 23, 2021

(54) PORTED CASING COLLAR FOR DOWNHOLE OPERATIONS, AND METHOD FOR ACCESSING A FORMATION

(71) Applicant: Coiled Tubing Specialties, LLC, Tulsa, OK (US)

(72) Inventors: Bruce L. Randall, Tulsa, OK (US); Bradford G. Randall, Tulsa, OK (US); David P. Brisco, Duncan, OK (US)

(73) Assignee: COILED TUBING SPECIALTIES, LLC, Tulsa, OK (US)

( * ) Notice: Subject to any disclaimer, the term of this patent is extended or adjusted under 35 U.S.C. 154(b) by 236 days.

(21) Appl. No.: 16/246,005

(22) Filed: Jan. 11, 2019

(65) Prior Publication Data

US 2019/0162060 A1 May 30, 2019

Related U.S. Application Data

(63) Continuation-in-part of application No. 15/009,623, filed on Jan. 28, 2016, now Pat. No. 10,309,205.

(Continued)

(51) Int. Cl.

*E21B 43/26* (2006.01)
*E21B 7/06* (2006.01)

(Continued)

(52) U.S. Cl.

CPC ..... *E21B 43/26* (2013.01); *E21B 7/061* (2013.01); *E21B 7/18* (2013.01); *E21B 29/06* (2013.01);

(Continued)

(58) Field of Classification Search

CPC ..... E21B 2200/06; E21B 29/06; E21B 43/26; E21B 47/06; E21B 47/09; E21B 7/061; E21B 7/18

See application file for complete search history.

(56) References Cited

U.S. PATENT DOCUMENTS 3,986,554 A 10/1976 Nutter
6,283,230 B1 9/2001 Peters (Continued)

OTHER PUBLICATIONS

Co-Pending International Application No. PCT/US16/013391 International Search Report and Written Opinion, dated Mar. 14, 2019, 8 pages.

(Continued)

*Primary Examiner* — James G Sayre

(74) *Attorney, Agent, or Firm* — Dennis D. Brown; Brown Patent Law, P.L.L.C.

(57) ABSTRACT

A ported casing collar. The ported casing collar comprises a tubular body defining an outer sleeve. At least first and second portals are placed along the outer sleeve. The casing collar also comprises an inner sleeve. The inner sleeve defines a cylindrical body rotatably residing within the outer sleeve. The inner sleeve contains a plurality of inner portals. A control slot is provided along an outer diameter of the inner sleeve. In addition, a pair of torque pins are provided, configured to ride along the control slot in order to place selected inner portals of the inner sleeve with the first and second portals of the outer sleeve. Preferably, the setting tool is a whipstock configured to receive a jetting hose and connected jetting nozzle. A method of accessing a rock matrix in a subsurface formation is also provided.

38 Claims, 25 Drawing Sheets

Related U.S. Application Data

(60) Provisional application No. 62/617,108, filed on Jan. 12, 2018.

(51) Int. Cl.

| | |
|---|---|
| ***E21B 7/18*** | (2006.01) |
| ***E21B 29/06*** | (2006.01) |
| ***E21B 47/09*** | (2012.01) |
| ***E21B 47/06*** | (2012.01) |

(52) U.S. Cl.
CPC ..... *E21B 47/06* (2013.01); *E21B 47/09* (2013.01); *E21B 2200/06* (2020.05)

(56) References Cited

U.S. PATENT DOCUMENTS

| | | | | |
|---|---|---|---|---|
| 7,357,182 | B2 | 4/2008 | Hunt et al. | |
| 7,669,672 | B2 | 3/2010 | Brunet et al. | |
| 7,686,101 | B2 | 3/2010 | Belew et al. | |
| 7,699,107 | B2 | 4/2010 | Butler et al. | |
| 8,245,788 | B2 | 8/2012 | Garcia et al. | |
| 8,307,902 | B2 | 11/2012 | Telfer | |
| 8,752,651 | B2 | 6/2014 | Randall et al. | |
| 8,833,444 | B2 | 9/2014 | McAfee et al. | |
| 8,991,522 | B2 | 3/2015 | Randall et al. | |
| 9,080,413 | B2 | 7/2015 | Winnon | |
| 9,284,816 | B2 | 3/2016 | Radford | |
| 9,528,356 | B2 | 12/2016 | Russo et al. | |
| 9,856,700 | B2 | 1/2018 | Randall et al. | |
| 9,976,351 | B2 | 5/2018 | Randall | |
| 10,113,393 | B2 | 10/2018 | Saponja et al. | |
| 10,132,154 | B2 | 11/2018 | Witte et al. | |
| 10,151,172 | B1 | 12/2018 | Dallas | |
| 10,174,586 | B2 | 1/2019 | Symms | |
| 10,174,595 | B2 | 1/2019 | Knight et al. | |
| 10,227,825 | B2 | 3/2019 | Randall | |
| 10,227,866 | B2 | 3/2019 | Godager et al. | |
| 10,240,418 | B2 | 3/2019 | Ruttley | |
| 2005/0247451 | A1* | 11/2005 | Hunt | E21B 43/114 166/298 |
| 2013/0087323 | A1 | 4/2013 | Allamon et al. | |
| 2014/0158361 | A1* | 6/2014 | Cheng | E21B 23/04 166/308.1 |
| 2016/0273322 | A1* | 9/2016 | Russo | E21B 43/12 |

OTHER PUBLICATIONS

Xu, Tao, et al.; Permian Basin Production Performance Comparison Over Time and the Parent-Child Well Study; Published: Circa 2019; Society of Petroleum Engineers; The Woodlands, Texas.

Guo, Xuyang, et al.; Understanding the Mechanism of Interwell Fracturing Interference Based on Reservoir-geomechanics-fracturing Modeling in Eagle Ford Shale; Published: Circa 2018; Society of Petroleum Engineers; Houston, Texas.

Rodionov, Yuri, et al.; Optimization of Infill Well Development Using a Novel Far-Field Diversion Technique in the Eagle Ford Shale; Published: Circa 2017; Society of Petroleum Engineers; Austin, Texas.

Xu, Tao, et al.; Advanced Modeling of Production Induced Pressure Depletion and Well Spacing Impact on Infill Wells in Spraberry, Permian Basin; Published: Circa 2018; Society of Petroleum Engineers; Dallas, Texas.

Gao, Richard, et al.; Well Interference and Optimum Well Spacing for Wolfcamp Development at Permian Basin; Published: Circa 2017; Society of Petroleum Engineers; Austin,Texas.

Rezaei, Ali, et al.; The Role of Pore Pressure Depletion in Propagation of New Hydraulic Fractures during Refracturing of Horizontal Wells; Published: Circa 2017; Society of Petroleum Engineers; San Antonio, Texas.

Orlando J. Teran; Mapping Unconventional Reservoir Stress Conditions: An Integrated Workflow Using Geological, Stimulation and Microseismic Data; Published: Circa 2017; Society of Petroleum Engineers; Austin, Texas.

Vidma, Konstantin; Fracture Geometry Control Technology Prevents Well Interference in the Bakken; Published: Circa 2017; Society of Petroleum Engineers; Austin, Texas.

* cited by examiner

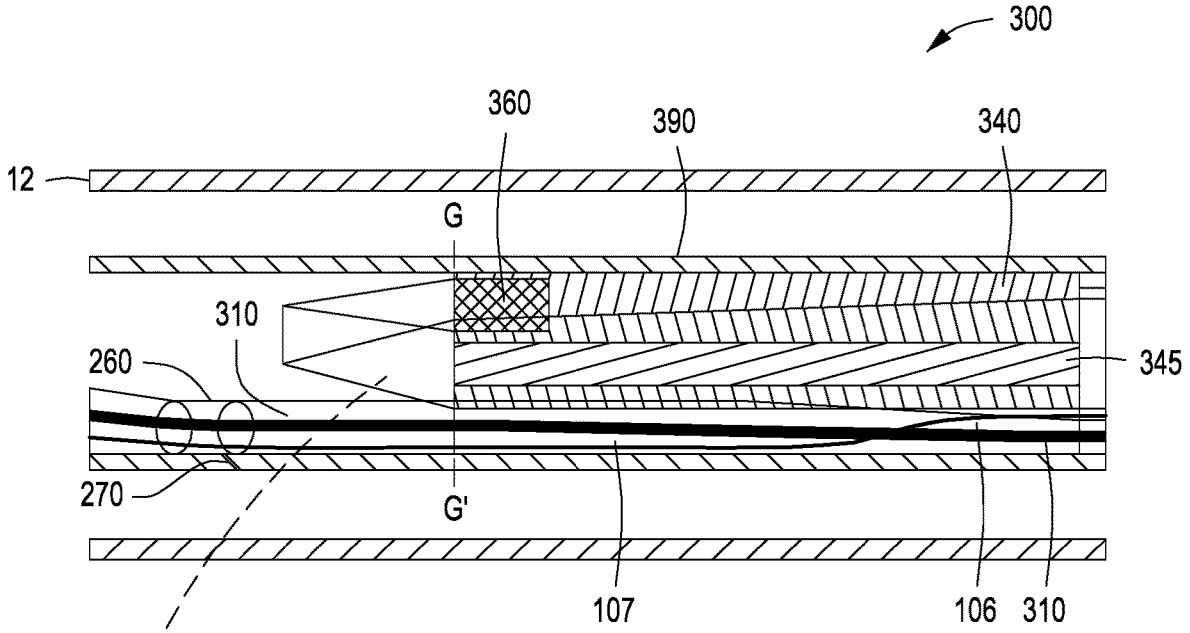
FIG. 4C
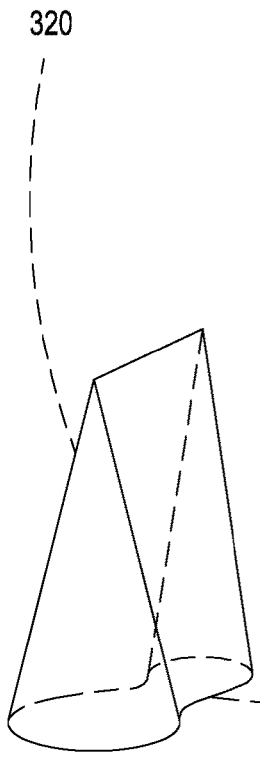
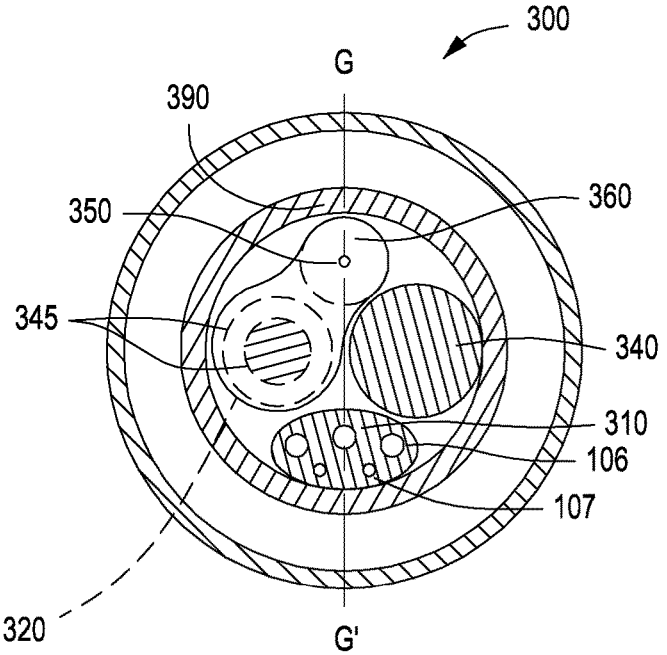
FIG. 4C-1a
FIG. 4C-1b

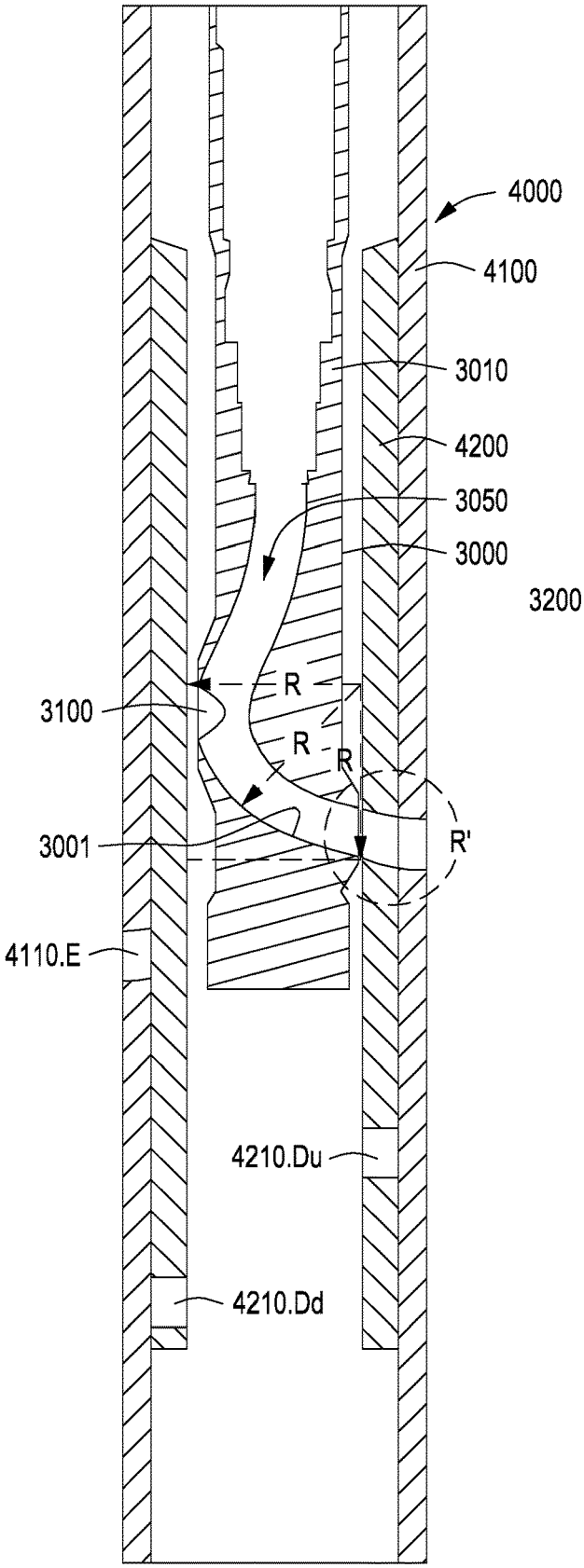
FIG. 4MW
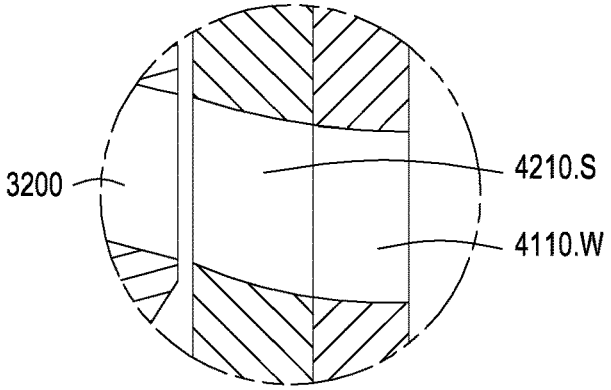
FIG. 4MW.1

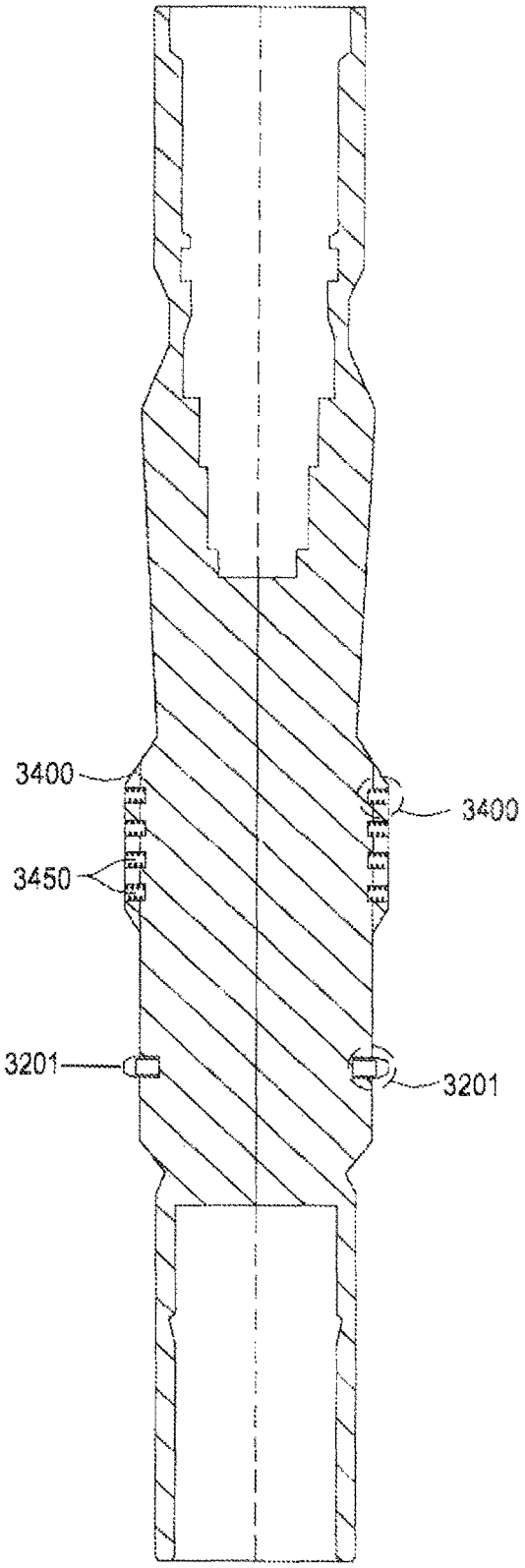
FIG. 4MW.2
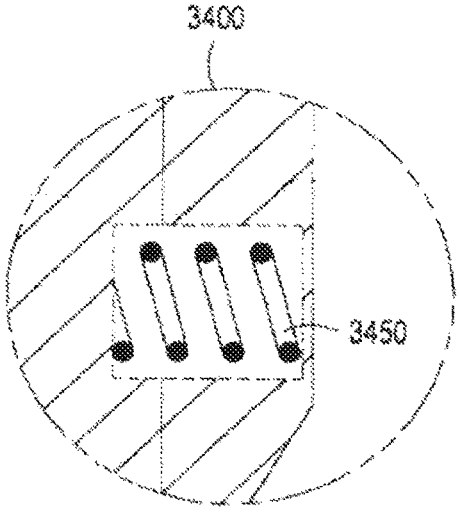
FIG. 4MW.2.AB
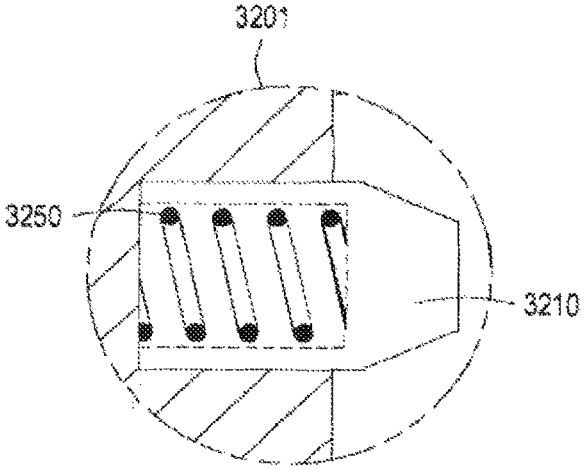
FIG. 4MW.2.SD

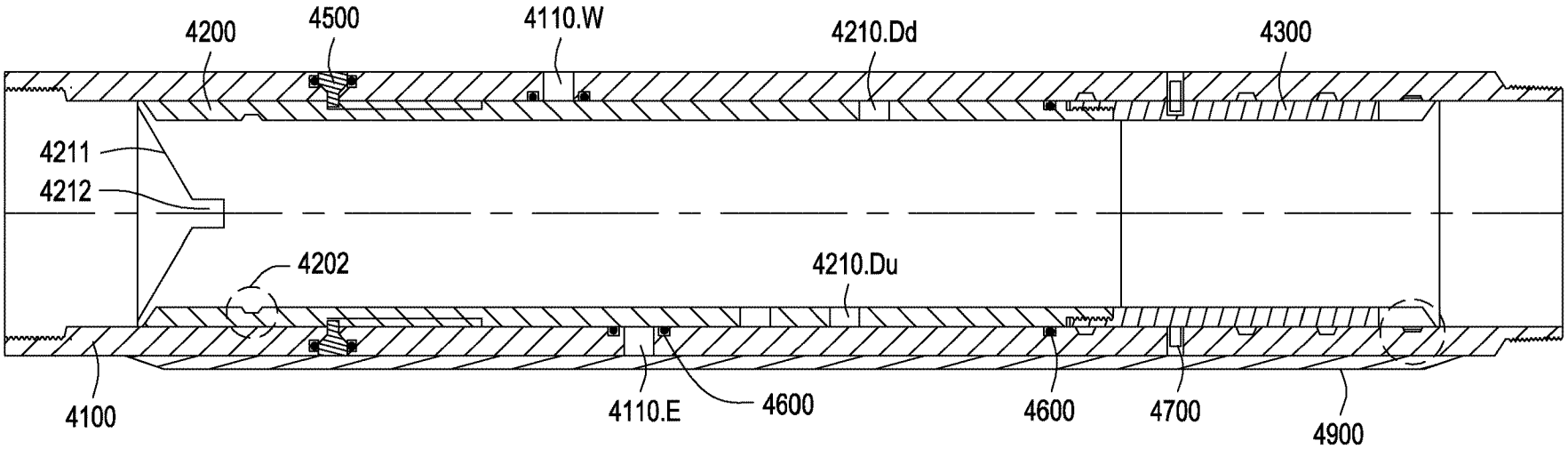
FIG. 4PCC.1
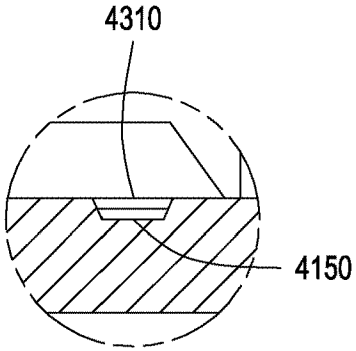
FIG. 4PCC.1.CLD
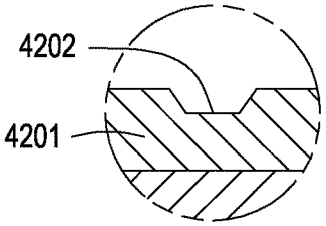
FIG. 4PCC.1.SDG

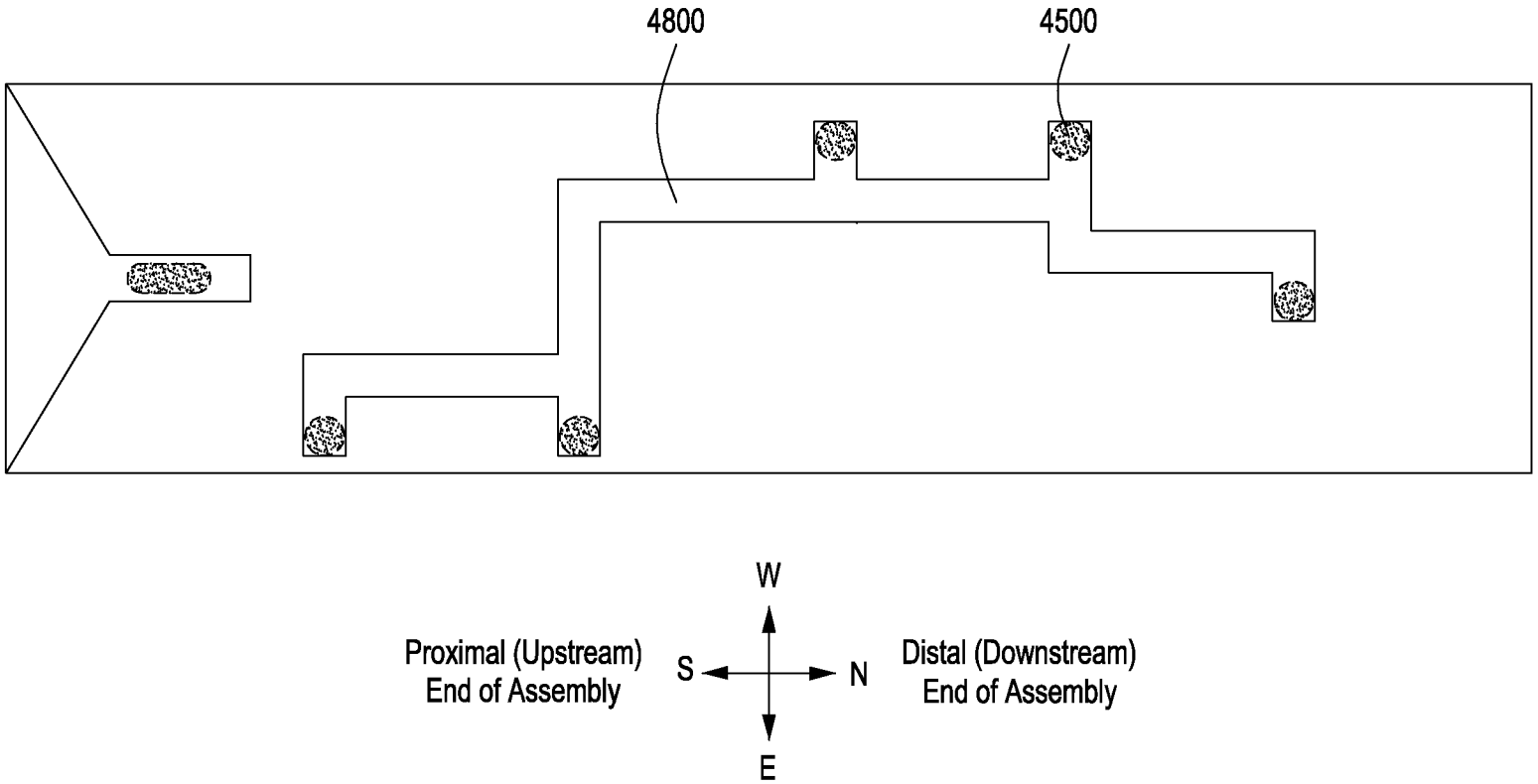
FIG. 4PCC.1.CSP

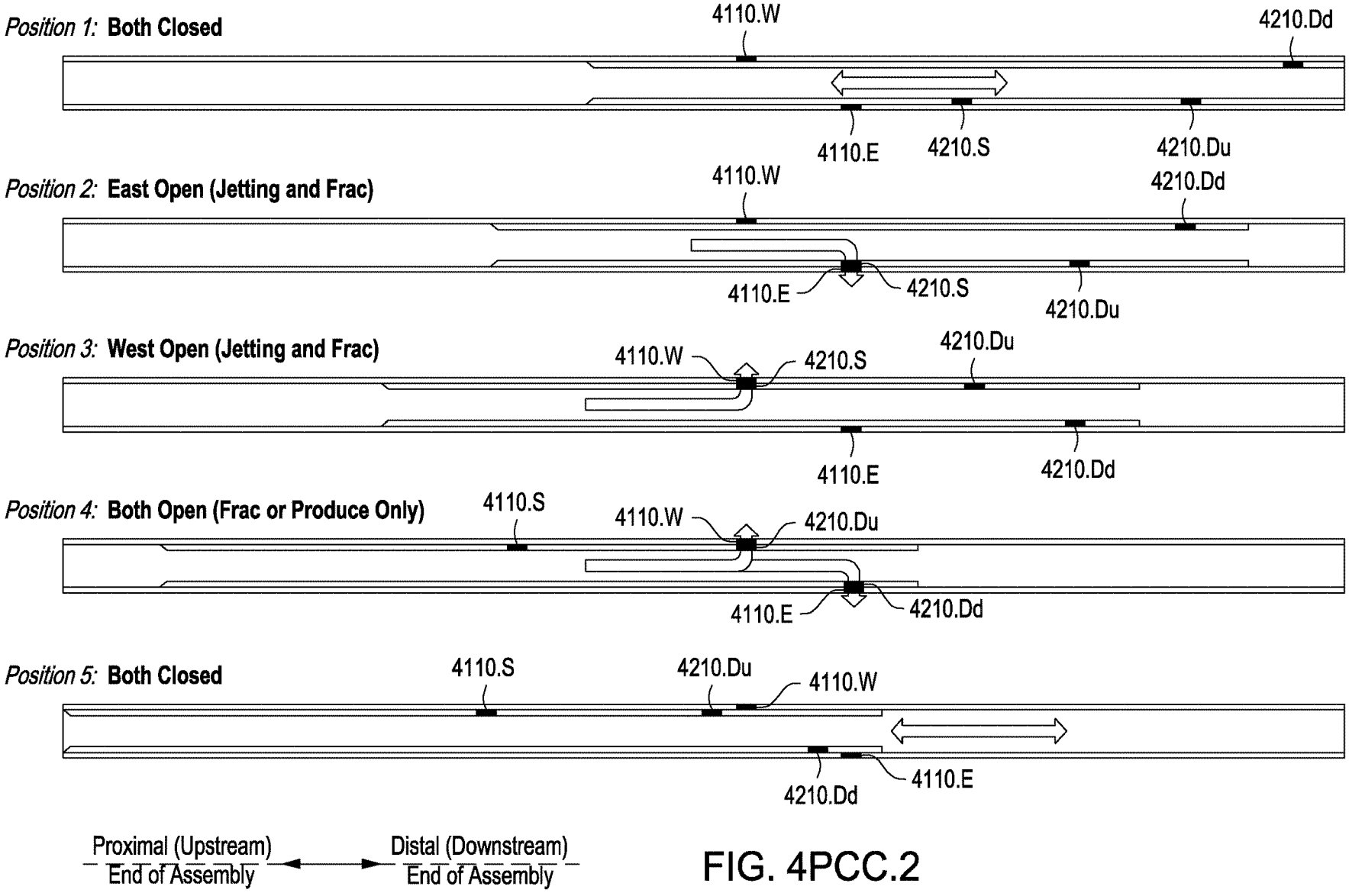
FIG. 4PCC.2

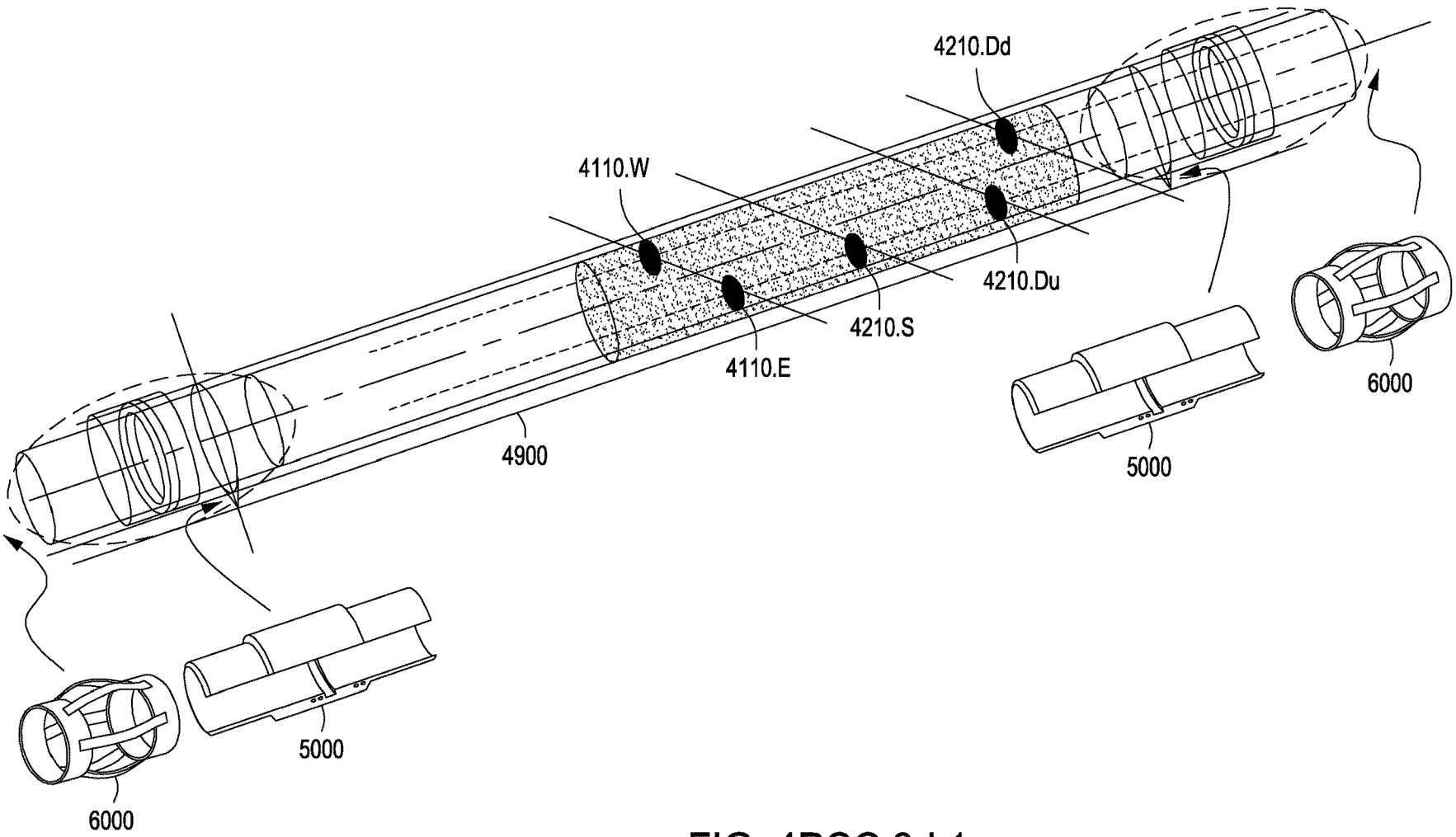
FIG. 4PCC.3d.1

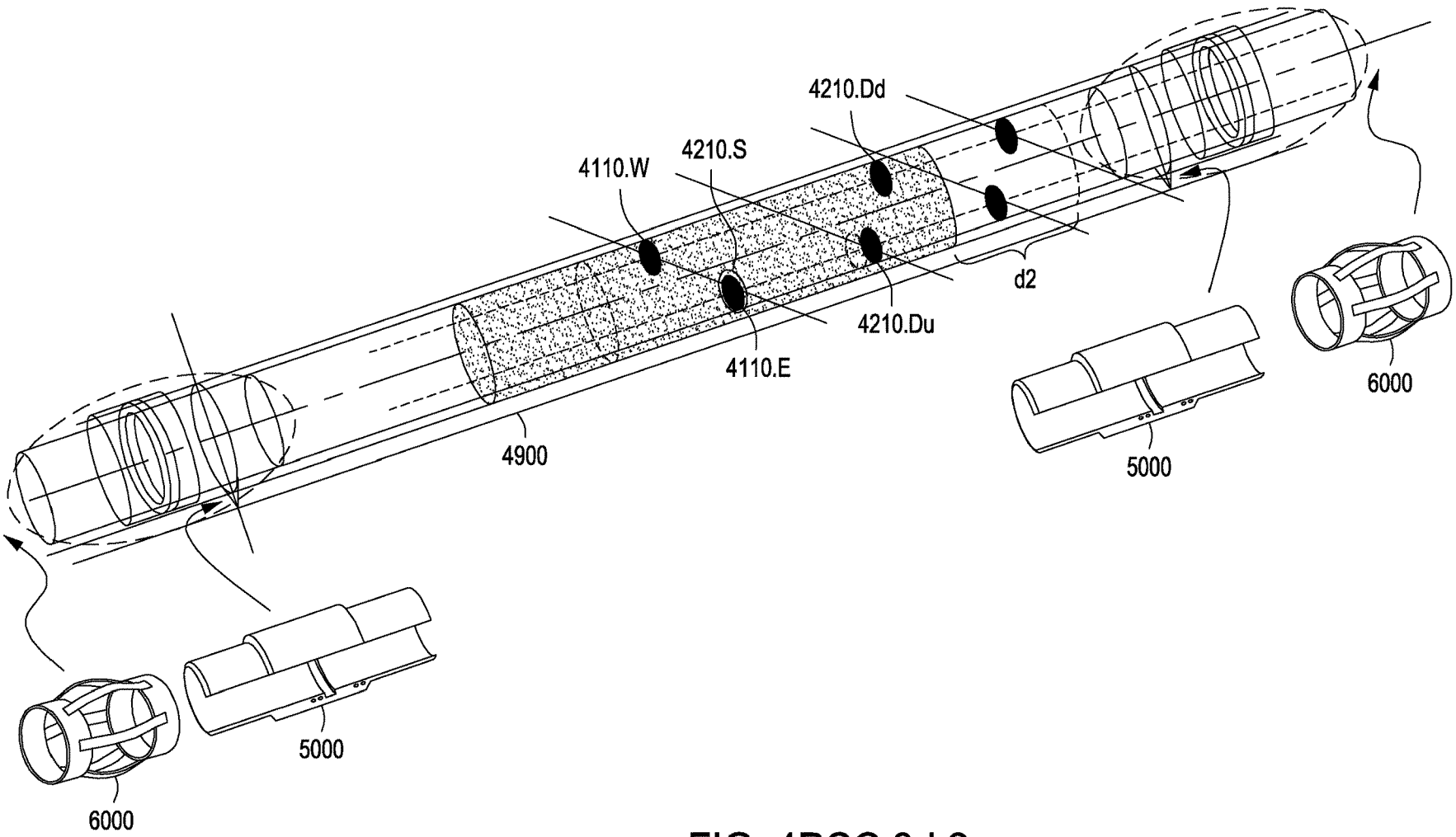
FIG. 4PCC.3d.2

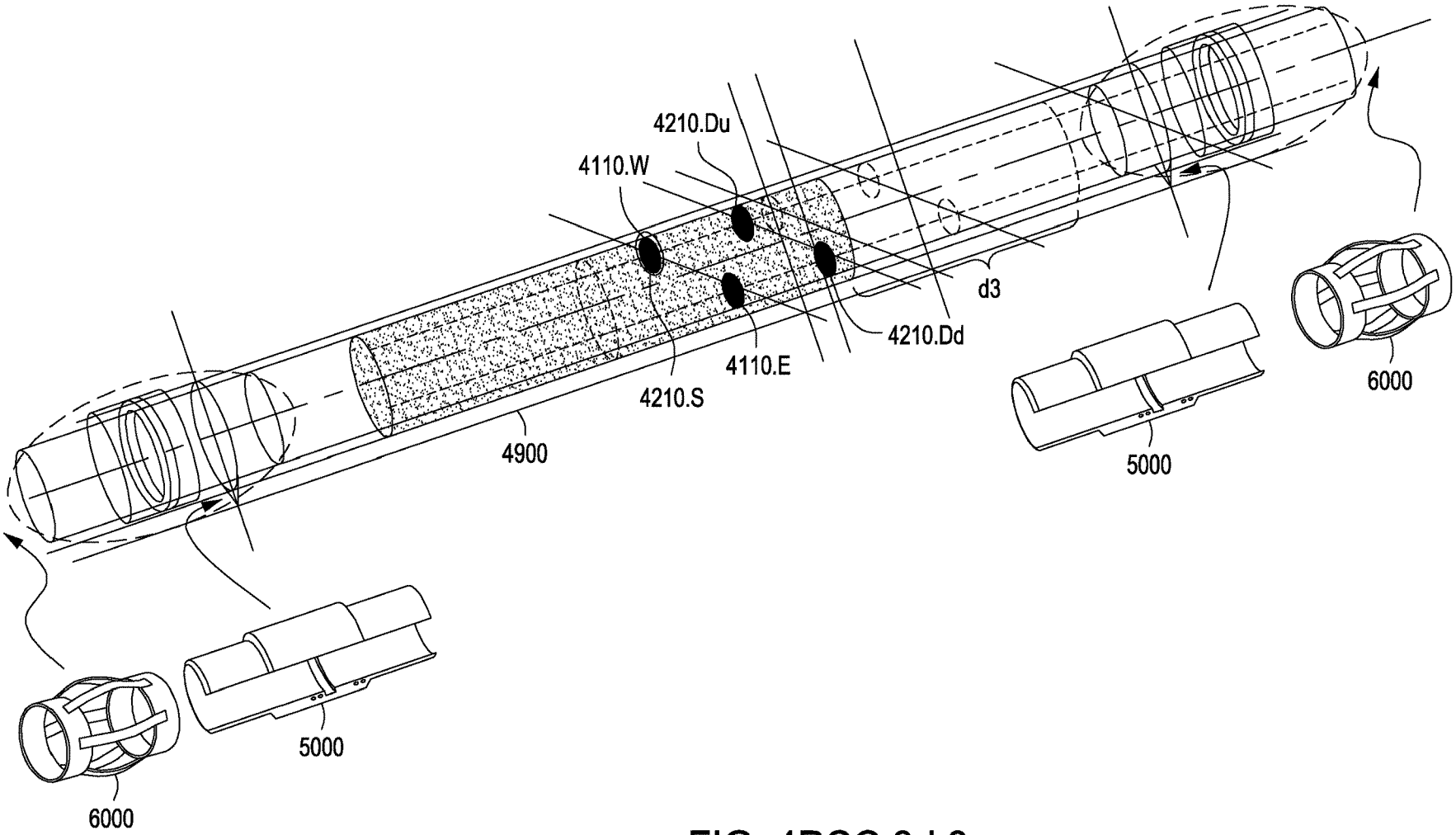
FIG. 4PCC.3d.3

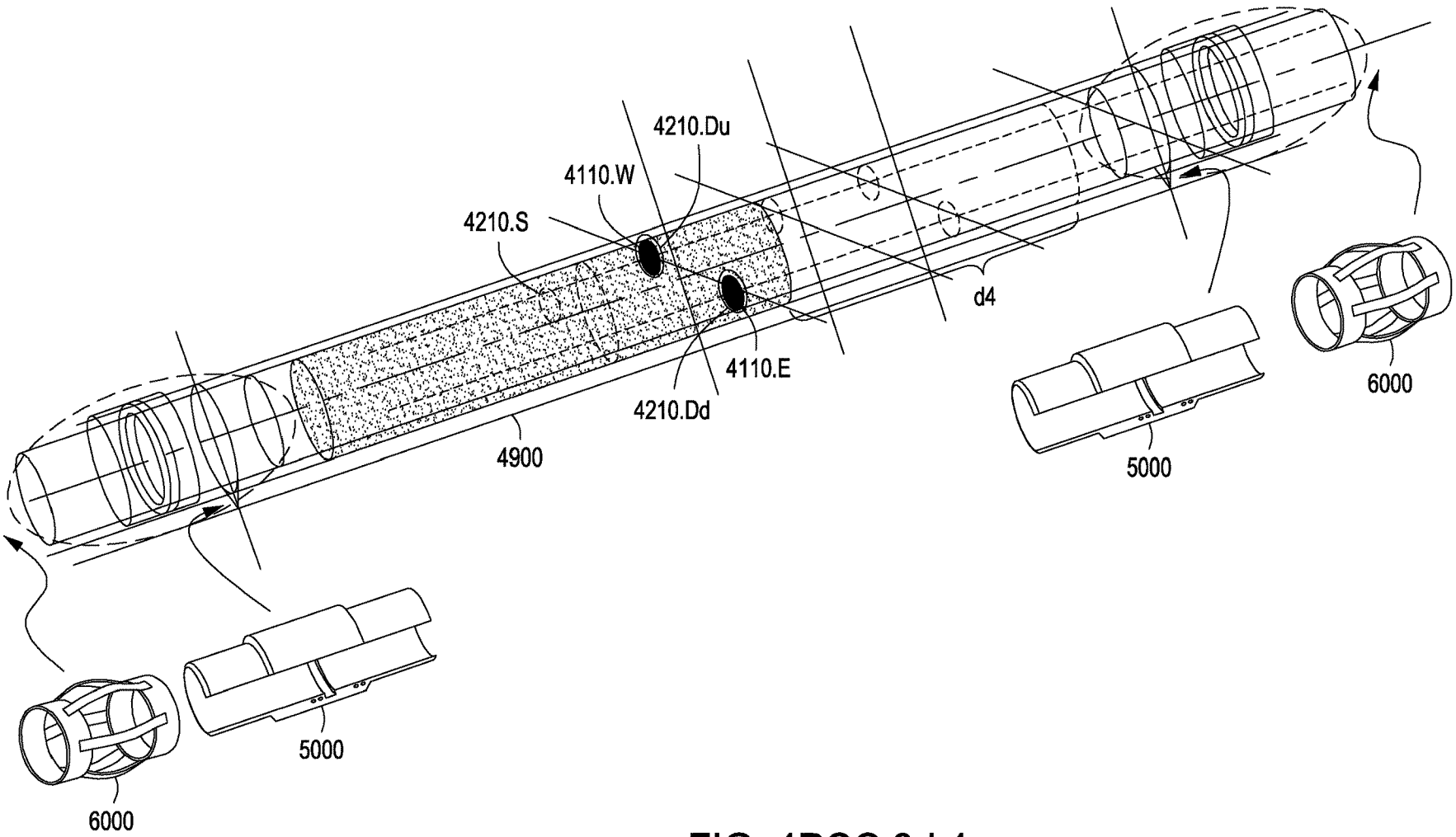
FIG. 4PCC.3d.4

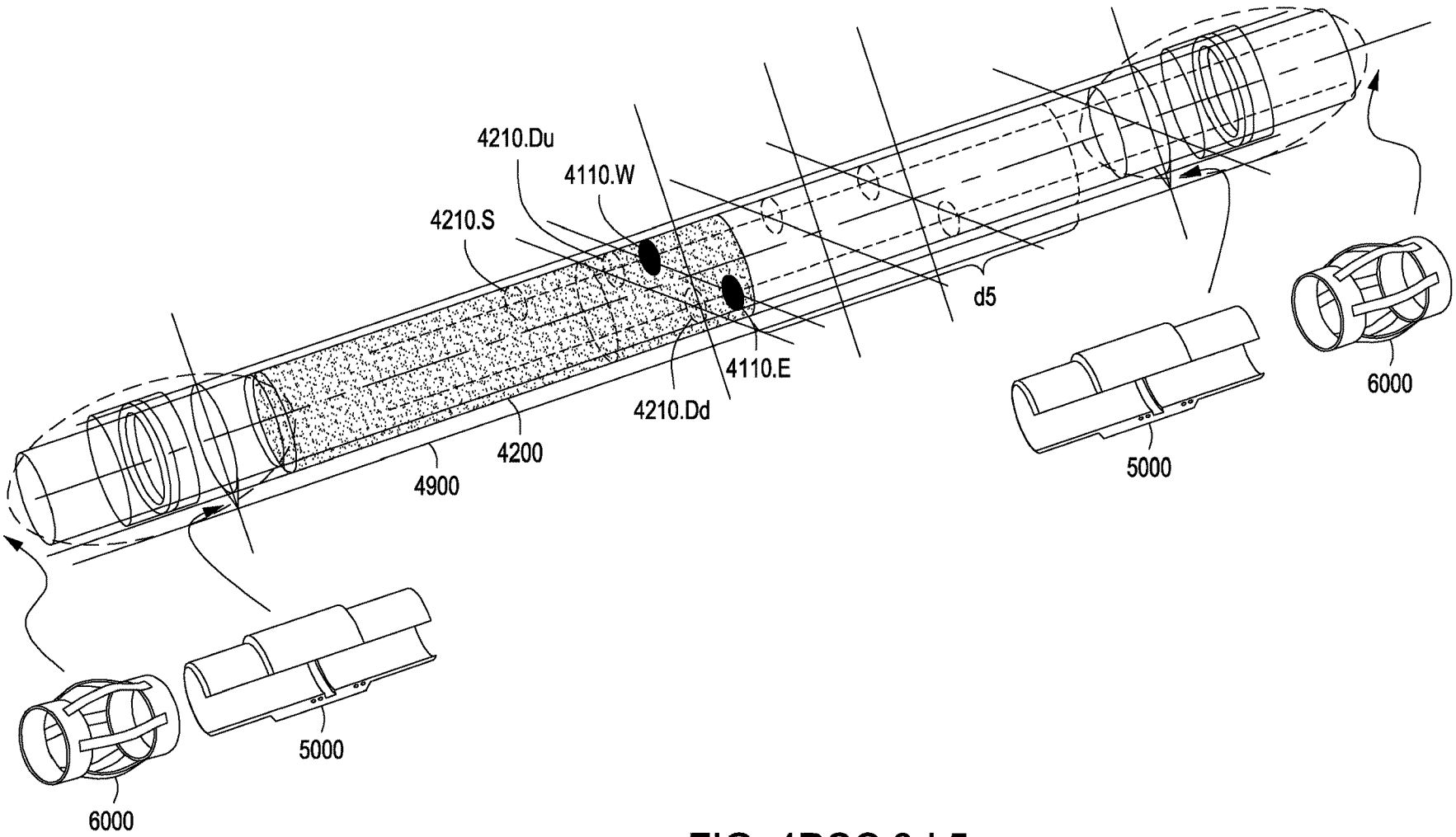
FIG. 4PCC.3d.5

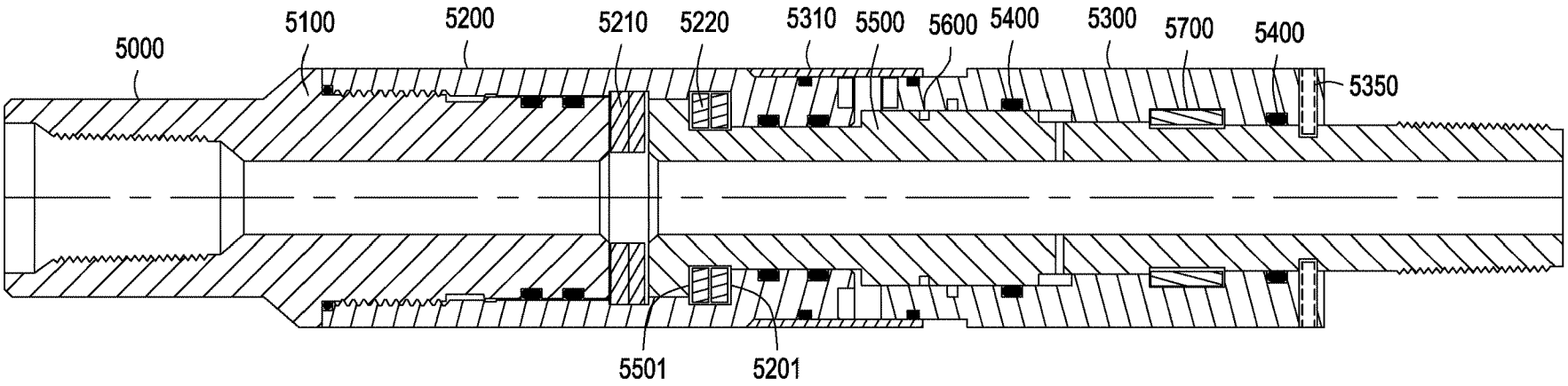
FIG. 4HLS

PORTED CASING COLLAR FOR DOWNHOLE OPERATIONS, AND METHOD FOR ACCESSING A FORMATION

STATEMENT OF RELATED APPLICATIONS

This application claims the benefit of U.S. Provisional Patent Appl. No. 62/617,108 filed Jan. 12, 2018. That application is entitled "Method of Avoiding Frac Hits During Formation Stimulation."

This application is also a Continuation-In-Part of U.S. patent application Ser. No. 15/009,623 filed Jan. 28, 2016. That application is entitled "Method of Forming Lateral Boreholes From A Parent Wellbore."

The parent application claims the benefit of U.S. Provisional Patent Appl. No. 62/198,575 filed Jul. 29, 2015. That application is entitled "Downhole Hydraulic Jetting Assembly, and Method for Forming Mini-Lateral Boreholes." The parent application also claims the benefit of U.S. Provisional Patent Appl. No. 62/120,212 filed Feb. 24, 2015 of the same title.

These applications are all incorporated by reference herein in their entireties.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of well completion. More specifically, the present disclosure relates to the completion and stimulation of a hydrocarbon-producing formation by the generation of small diameter boreholes from an existing wellbore using a hydraulic jetting assembly. The present disclosure further relates to a ported casing collar that may be selectively opened and closed using a setting tool in order to control access to a surrounding formation.

Discussion of Technology

In the drilling of an oil and gas well, a near-vertical wellbore is formed through the earth using a drill bit urged downwardly at a lower end of a drill string. After drilling to a predetermined bottomhole location, the drill string and bit are removed and the wellbore is lined with a string of casing. An annular area is thus formed between the string of casing and the formation penetrated by the wellbore. Particularly in a vertical wellbore, or the vertical section of a horizontal well, a cementing operation is conducted in order to fill or "squeeze" the annular volume with cement along part or all of the length of the wellbore. The combination of cement and casing strengthens the wellbore and facilitates zonal isolation behind the casing.

Advances in drilling technology have enabled oil and gas operators to economically "kick-off" and steer wellbore trajectories from a generally vertical orientation to a generally horizontal orientation. The horizontal "leg" of each of these wellbores now often exceeds a length of one mile, and sometimes two or even three miles. This significantly multiplies the wellbore exposure to a target hydrocarbon-bearing formation (or "pay zone"). As an example, consider a target pay zone having a (vertical) thickness of 100 feet. A one-mile horizontal leg exposes 52.8 times as much pay zone to a horizontal wellbore as compared to the 100-foot exposure of a conventional vertical wellbore.

FIG. 1A provides a cross-sectional view of a wellbore 4 having been completed in a horizontal orientation. It can be seen that the wellbore 4 has been formed from the earth surface 1, through numerous earth strata 2*a*, 2*b*, . . . 2*h* and down to a hydrocarbon-producing formation 3. The subsurface formation 3 represents a "pay zone" for the oil and gas operator. The wellbore 4 includes a vertical section 4*a* above the pay zone, and a horizontal section 4*c*. The horizontal section 4*c* defines a heel 4*b* and a toe 4*d* and an elongated leg there between that extends through the pay zone 3.

In connection with the completion of the wellbore 4, several strings of casing having progressively smaller outer diameters have been cemented into the wellbore 4. These include a string of surface casing 6, and may include one or more strings of intermediate casing 9, and finally, a production casing 12. (Not shown is the shallowest and largest diameter casing referred to as conductor pipe, which is a short section of pipe separate from and immediately above the surface casing.) One of the main functions of the surface casing 6 is to isolate and protect the shallower, fresh water bearing aquifers from contamination by any wellbore fluids. Accordingly, the conductor pipe and the surface casing 6 are almost always cemented 7 entirely back to the surface 1.

Surface casing 6 is shown as cemented 7 fully from a surface casing shoe 8 back to the surface 1. An intermediate casing string 9 is only partially cemented 10 from its shoe 11. Similarly, production casing string 12 is only partially cemented 13 from its casing shoe 14, though sufficiently isolating the pay zone 3.

The process of drilling and then cementing progressively smaller strings of casing is repeated several times until the well has reached total depth. In some instances, the final string of casing 12 is a liner, that is, a string of casing that is not tied back to the surface 1. The final string of casing 12, referred to as a production casing, is also typically cemented 13 into place. In the case of a horizontal completion, the production casing 12 may be cemented, or may provide zonal isolation using external casing packers ("ECP's), swell packers, or some combination thereof.

Additional tubular bodies may be included in a well completion. These include one or more strings of production tubing placed within the production casing or liner (not shown in FIG. 1A). In a vertical well completion, each tubing string extends from the surface 1 to a designated depth proximate the production interval 3, and may be attached to a packer (not shown). The packer serves to seal off the annular space between the production tubing string and the surrounding casing 12. In a horizontal well completion, the production tubing is typically landed (with or without a packer) at or near the heel 4*b* of the wellbore 4.

In some instances, the pay zone 3 is incapable of flowing fluids to the surface 1 efficiently. When this occurs, the operator may install artificial lift equipment (not shown in FIG. 1A) as part of the wellbore completion. Artificial lift equipment may include a downhole pump connected to a surface pumping unit via a string of sucker rods run within the tubing. Alternatively, an electrically-driven submersible pump may be placed at the bottom end of the production tubing. As part of the completion process, a wellhead 5 is installed at the surface 1. The wellhead 5 serves to contain wellbore pressures and direct the flow of production fluids at the surface 1.

Within the United States, many wells are now drilled principally to recover oil and/or natural gas, and potentially natural gas liquids, from pay zones previously thought to be too impermeable to produce hydrocarbons in economically viable quantities. Such "tight" or "unconventional" formations may be sandstone, siltstone, or even shale formations. Alternatively, such unconventional formations may include coalbed methane. In any instance, "low permeability" typically refers to a rock interval having permeability less than 0.1 millidarcies.

In order to enhance the recovery of hydrocarbons, particularly in low-permeability formations, subsequent (i.e., after perforating the production casing or liner) stimulation techniques may be employed in the completion of pay zones. Such techniques include hydraulic fracturing and/or acidizing. In addition, "kick-off" wellbores may be formed from a primary wellbore in order to create one or more new directionally or horizontally completed boreholes. This allows a well to penetrate along the depositional plane of a subsurface formation to increase exposure to the pay zone. Where the natural or hydraulically-induced fracture plane(s) of a formation is vertical, a horizontally completed wellbore allows the production casing to intersect, or "source," multiple fracture planes. Accordingly, whereas vertically oriented wellbores are typically constrained to a single hydraulically-induced fracture plane per pay zone, horizontal wellbores may be perforated and hydraulically fractured in multiple locations, or "stages," along the horizontal leg 4*c*, producing multiple fracture planes.

FIG. 1A demonstrates a series of fracture half-planes 16 along the horizontal section 4*c* of the wellbore 4. The fracture half-planes 16 represent the orientation of fractures that will form in connection with a known perforating/fracturing operation. The fractures are formed by the injection of a fracturing fluid through perforations 15 formed in the horizontal section 4*c*.

The size and orientation of a fracture, and the amount of hydraulic pressure needed to part the rock along a fracture plane, are dictated by the formation's in situ stress field. This stress field can be defined by three principal compressive stresses which are oriented perpendicular to one another. These represent a vertical stress, a minimum horizontal stress, and a maximum horizontal stress. The magnitudes and orientations of these three principal stresses are determined by the geomechanics in the region and by the pore pressure, depth and rock properties.

According to principles of geo-mechanics, fracture planes will generally form in a direction that is perpendicular to the plane of least principal stress in a rock matrix. Stated more simply, in most wellbores, the rock matrix will part along vertical lines when the horizontal section of a wellbore resides below 3,000 feet, and sometimes as shallow as 1,500 feet, below the surface. In this instance, hydraulic fractures will tend to propagate from the wellbore's perforations 15 in a vertical, elliptical plane perpendicular to the plane of least principle stress. If the orientation of the least principle stress plane is known, the longitudinal axis of the leg 4*c* of a horizontal wellbore 4 is ideally oriented parallel to it such that the multiple fracture planes 16 will intersect the wellbore at-or-near orthogonal to the horizontal leg 4*c* of the wellbore, as depicted in FIG. 1A.

In actuality, and particularly in unconventional shale reservoirs, resultant fracture geometries are often more complex than a single, essentially two-dimensional elliptical plane. Instead, a more complex three-dimensional Stimulated Reservoir Volume ("SRV") is generated from a single hydraulic fracturing treatment. Hence, whereas for conventional reservoirs the key post-stimulation metric was propped frac length (or "half length") within the pay zone, for unconventional reservoirs the key metric is SRV.

In FIG. 1A, the fracture planes 16 are spaced apart along the horizontal leg 4*c*. The desired density of the perforated and fractured intervals along the horizontal leg 4*c* is optimized by calculating:

- the estimated ultimate recovery ("EUR") of hydrocarbons each fracture will drain, which requires a computation of the SRV that each fracture treatment will connect to the wellbore via its respective perforations; less
- any overlap with the respective SRV's of bounding fracture intervals; coupled with
- the anticipated time-distribution of hydrocarbon recovery from each fracture; versus
- the incremental cost of adding another perforated/fractured interval.

The ability to make this calculation and replicate multiple vertical completions along a single horizontal wellbore is what has made the pursuit of hydrocarbon reserves from unconventional reservoirs, and particularly shales, economically viable within relatively recent times. This revolutionary technology has had such a profound impact that currently Baker Hughes Rig Count information for the United States indicates only about one out of every fifteen (7%) of wells being drilled in the U.S. are classified as "Vertical", whereas the remainder are classified as either "Horizontal" or "Directional" (85% and 8%, respectively). That is, horizontal wells currently comprise approximately six out of every seven wells being drilled in the United States.

The additional costs in drilling and completing horizontal wells as opposed to vertical wells is not insignificant. In fact, it is not at all uncommon to see horizontal well drilling and completion ("D&C") costs top multiples (double, triple, or greater) of their vertical counterparts. Obviously, the vertical-vs-horizontal D&C cost multiplier is a direct function of the length of the horizontal leg 4*c* of wellbore 4.

Common perforation mechanisms are "plug-n-perf" operations where sequences of bridge plugs and perforating guns are pumped down the wellbore to desired locations, or hydra-jet perforations typically obtained from coiled tubing ("CT") conveyed systems, the former being perhaps the most common method. Though relatively simple, plug-n-perf systems leave a series of bridge plugs that must be later drilled out (unless they are dissolvable, and hence, typically more expensive), a function that becomes even more time consuming (and again, more expensive) as horizontal lateral lengths continue to get longer and longer. Even more elaborate mechanisms providing pressure communication between the casing I.D. and the pay zone 3 include ported systems activated by dissolvable balls (of graduated diameters) or plugs, or sliding sleeve systems typically opened or closed via a CT-conveyed tool.

Important to the economic success of any horizontal well is the achievement of satisfactory SRV's within the pay zone being completed. Many factors can contribute to the success or failure in achieving the desired SRV's, including the rock properties of the pay zone and how these properties contrast with bounding rock layers both above and below the pay zone. For example, if either bounding layer is weaker than the pay zone, hydraulic fractures will tend to propagate out-of-zone into that weaker layer, thus commensurately reducing the SRV that might have otherwise been obtained. Similarly, pressure depletion from offset well production of the pay zone's reservoir fluids can significantly weaken the in situ stress profile within the pay zone itself. Stated another way, reservoir depletion that has occurred as a result of production operations in the parent wellbores will reduce pore pressure in the formation, which reduces the principal horizontal stresses of the rock matrix itself. The weakened rock fabric now superimposes a new "path of least resistance" for the high pressure frac fluids during formation stimulation. This means that fractures and fracturing fluids will now tend to migrate toward pressure depleted areas formed by adjacent wells.

In some instances, a sweeping of fracturing fluids towards a producing well can be beneficial, providing an increase in formation pressure and, possibly, increased fracture connectivity. This occurrence is sometimes referred to as a "pressure hit." However, the migration of fracturing fluids may also create an issue of redundancy. In this respect, a portion, if not a majority of costs of a child well's frac stage (including its constituent frac fluids, additives, proppant, hydraulic horsepower ("HHP") and other costs) is spent building SRV in a portion of the pay zone already being drained by the parent wellbore. Additionally, there is now child-vs-parent competition to drain reserves that would have eventually been drained by the parent alone.

In more extreme instances, pressure in an adjacent wellbore can suddenly increase significantly, such as up to 1,000 psi or greater. This is an obvious symptom of fluid communication between a child wellbore and the neighboring parent. This is what is known as a "frac hit." When a frac hit occurs, downhole production equipment in the neighboring parent wellbore can suffer proppant (typically sand) erosion, with the parent's tubulars becoming filled with sand. Events of collapsed casing, blown-out stuffing boxes and resultant surface streams of frac fluids have also been reported. The parent's previously productive SRV's may never recover. In a worst case scenario, the parent's tubulars and/or wellhead connections may experience failure associated with exposure to high burst and/or collapse pressures. Accordingly, frac hit damage may not be contained within the 'hit' parent wellbore itself.

Those of ordinary skill in the art will appreciate that frac hits are generally a by-product of in-fill drilling, meaning that a new wellbore (sometimes referred to as a "child well") is being completed in proximity to existing wellbores (referred to as "offset" or "parent wells") within a hydrocarbon-producing field. Frac hits are also, of course, a by-product of tight well spacing. Ultimately, however, frac hits are the result of the operator being unable to control or "direct" the propagation of fractures within the pay zone.

The problem of frac hits is receiving a great deal of attention in the oil and gas industry. It is estimated that in the last 18 months 100 technical papers have been published. Currently, a technical work dealing with "frac hits" is being produced every 2.75 working days. This is in addition to the litigation that is taking place between well owners and service companies based on "improper drilling techniques." Quite often, a parent's hit damage is sometimes self-inflicted, that is, an operator is causing a frac-hit to occur on its own offset well.

A "frac hits" lobbying group, the Oklahoma Energy Producers Alliance ("OEPA"; https://okenergyproducers.org/), has been recently formed. This organization cites "Hundreds if not thousands of wells are being destroyed by horizontal frac jobs . . . ". The group seeks to find regulatory and legislative solutions to the problem of frac hits and the protection of "vertical rights" among operators. Partly as a result of efforts by the OEPA and groups like it, many frac operations now require notification of offset parent operators, affording them the opportunity to (before child frac), pull the rods, the pump, and the production tubing and to strategically place retrievable bridge plugs in order to preclude downhole and surface damages. Such efforts are commonly referred to as a "de-completion", and can cost upwards of $200,000 per well.

Accordingly, a need exists for controlling, directing, or at least influencing the directions and dimensions by which a hydraulic fracture ("frac") propagates within a pay zone, such that in-the-pay SRV can be created and frac hits can be minimized or avoided altogether. Thus, a need exists for a method of forming pre-frac mini-lateral boreholes off of a parent wellbore wherein the small, lateral boreholes are formed in controlled directions and at pre-selected lengths and configurations.

Additionally, a need exists for a method of forming lateral boreholes wherein access ports for the lateral boreholes can be selectively opened and closed along the casing, thus enabling pre-frac depletion of the rock matrix surrounding a selected mini-lateral(s), with commensurate weakening making them the new preferred paths for frac and SRV propagation. A need further exists for a downhole casing collar having custom ports that enable the boreholes to be jetted through the ports in pre-set "east and west" directions.

Also, a need exists for a downhole assembly having a jetting hose and a whipstock, whereby the assembly can be conveyed into any wellbore interval of any inclination, including an extended horizontal leg. A need further exists for a hydraulic jetting system that provides for substantially a 90° turn of the jetting hose opposite the point of a casing exit, preferably utilizing the entire casing inner diameter as the bend radius for the jetting hose, thereby providing for the maximum possible inner diameter of jetting hose, and thus providing the maximum possible hydraulic horsepower to the jetting nozzle.

Further, a need exists for a downhole jetting assembly that can, in a single trip of the assembly into the wellbore, repeatably generate both: (1) hydraulically jetted casing exits and subsequent mini-lateral boreholes from any point in the production casing; and, (2) mateably enjoin and operate ported casing collars, wherein the casing exits are pre-formed by the ports and jetting of mini-lateral boreholes into the pay zone is initiated therefrom.

Additionally, a need exists for improved methods of forming lateral wellbores using hydraulically directed forces, wherein a desired length of jetting hose can be conveyed even from a horizontal wellbore. Further, a need exists for a method of forming mini-lateral boreholes off of a horizontal leg wherein the extent of the mini-laterals is limited or even avoided in a direction of a neighboring wellbore.

A need further exists for a method of hydraulically fracturing mini-lateral boreholes jetted off of the horizontal leg of a wellbore immediately following lateral borehole formation, and without the need of pulling the jetting hose, whipstock, and conveyance system out of the parent wellbore. A need further exists for a method of controlling the erosional excavation path of the jetting nozzle and connected hydraulic hose, such that a lateral borehole, or multiple lateral borehole "clusters," can be directed to avoid frac hits in an adjacent wellbore during a subsequent formation fracturing operation, or to enable newly created SRV to reach and recover otherwise stranded reserves.

SUMMARY OF THE INVENTION

The systems and methods described herein have various benefits in the conducting of oil and gas well completion activities. In the present disclosure, a ported casing collar is first provided.

The ported casing collar first comprises a tubular body. The tubular body defines an upper end and a lower end, forming an outer sleeve. The outer sleeve includes a first port disposed on a first side of the outer sleeve defining an "east" portal. The outer sleeve additionally includes a second port disposed on a second opposing side of the outer sleeve defining a "west" portal.

The ported casing collar also includes an inner sleeve. The inner sleeve defines a cylindrical body rotatably residing within the outer sleeve. The inner sleeve has a plurality of inner portals.

A control slot resides along an outer diameter of the inner sleeve. The control slot receives a pair of opposing torque pins. The torque pins fixedly resides within the outer sleeve, and protrude into the control slot of the inner sleeve.

The inner sleeve is configured to be manipulated by a setting tool such that:

- in a first position, the inner portals of the inner sleeve are out of alignment with the "east" and "west" portals of the outer sleeve,
- in a second position, one of the inner portals of the inner sleeve is in alignment with the "east" portal of the outer sleeve,
- in a third position, one of the inner portals of the inner sleeve is in alignment with the "west" portal of the outer sleeve,
- in a fourth position, inner portals of the inner sleeve are together in alignment with the respective "east" and "west" portals of the outer sleeve; and
- in a fifth position, the inner portals of the inner sleeve are once again out of alignment with the "east" and "west" portals of the outer sleeve.

The ported casing collar also includes a beveled shoulder. The beveled shoulder resides along an inner diameter of the outer sleeve, and further resides proximate the upper end of the outer sleeve. The beveled shoulder offers a profile that leads to an alignment slot on opposing sides of the outer sleeve. The alignment slot is configured to receive an alignment block of a setting tool.

The ported casing collar also comprises a pair of shift dog grooves. The shift dog grooves (which may be a single continuous groove) are located along an inner diameter of the inner sleeve, proximate the upper end of the tubular body. The shift dog grooves are configured to receive a mating shift dog also residing along an outer diameter of the setting tool. The shift dogs, in turn, are located along the outer diameter of the setting tool above the alignment blocks.

The ported casing collar optionally includes two or more set screws. The set screws reside in the outer sleeve and extends into the inner sleeve. The set screws fix a position of the inner sleeve relative to the outer sleeve, until sheered by a rotational forced applied by the setting tool.

In one embodiment, the ported casing collar also comprises a first swivel and a second swivel. The first swivel is secured to the tubular body at the upper end while the second swivel is secured to the tubular body at the lower end. Each swivel is configured to be threadedly connected to a joint of production casing.

In one aspect, the outer sleeve comprises an enlarged wall portion. The enlarged wall portion creates an eccentric profile to the tubular body. Of interest, the enlarged wall portion provides added weight to the tubular body along one of its side, such that when the ported casing collar is placed along the horizontal leg of a wellbore, the opposing first and second swivels permit the tubular body to rotate such that the enlarged wall portion gravitationally rotates around to a bottom of the horizontal leg. The ported casing collar is configured such that upon such rotation, the east portal and the opposing west portal are positioned horizontally within the wellbore.

Concerning the setting tool, the setting tool may define a tubular body having an inner diameter and an outer diameter. The outer diameter receives the shift dogs and the alignment blocks. The inner diameter defines a curved whipstock face configured to receive a jetting hose and connected jetting nozzle. The setting tool further comprises an exit portal, wherein the exit portal aligns with a designated inner portal of the inner sleeve when the alignment blocks are placed within the respective alignment slots.

Preferably, the setting device is configured to rotate freely at the end of a run-in string. Outer faces of the alignment blocks protrude from the outer diameter of the setting tool. Each alignment block comprises a plurality of springs that bias individual block segments outwardly. When the setting tool is lowered into the inner diameter of the ported casing collar, the block segments comprising the respective alignment blocks are configured to ride along the beveled shoulders, rotating the setting tool, and landing the alignment blocks in the alignment slots.

A method of accessing a rock matrix in a subsurface formation is also provided herein. The method first comprises providing a ported casing collar. The ported casing collar is in accordance with the casing collar described above, in its various embodiments.

The method includes threadedly securing the upper end of the tubular body to a first joint of production casing, and threadedly securing the lower end of the tubular body to a second joint of production casing. The method further includes running the joints of production casing and the ported casing collar into a horizontal portion of a wellbore.

The method additionally includes running a setting tool into the wellbore. The setting tool may be the whipstock as described above. The method then includes manipulating the setting tool to move the torque pins along the control slot, thereby selectively aligning inner portals of the inner sleeve with the "east" and "west" portals of the outer sleeve.

In one aspect of the method, the inner sleeve is in its first position when the ported casing collar is run into the wellbore. In this position, the inner portals of the inner sleeve are out of alignment with the "east" and "west" portals of the outer sleeve.

Manipulating the setting tool comprises:

- placing the inner sleeve in a second position, wherein one of the inner portals of the inner sleeve is in alignment with the "east" portal of the outer sleeve, placing the inner sleeve in a third position, wherein one of the inner portals of the inner sleeve is in alignment with the "west" portal of the outer sleeve, and placing the inner sleeve in a fourth position, wherein inner portals of the inner sleeve are together in alignment with the respective "east" and "west" portals of the outer sleeve.

In one aspect, the ported casing collar again comprises a first swivel and a second swivel. The first swivel is secured to the tubular body at the upper end, while the second swivel is secured to the tubular body at the lower end. The tubular body is threadedly connected to the first joint of production casing through the first swivel, and the tubular body is threadedly connected to the second joint of production casing through the second swivel.

The method may then include pumping hydraulic fluid down a working string and through the setting tool in order to lock the first and second swivels from rotating, thereby locking the threadedly connected outer sleeve as well.

Concerning the setting tool, the setting tool may define a tubular body having an inner diameter and an outer diameter. The outer diameter receives the shift dogs and the alignment blocks. The inner diameter defines a curved whipstock face configured to receive a jetting hose and connected jetting nozzle. The setting tool further comprises an exit portal, wherein the exit portal aligns with a designated inner portal of the inner sleeve when the alignment blocks are placed within the respective alignment slots.

The inner diameter of the setting tool comprises a bending tunnel for receiving the jetting hose and connected jetting nozzle. A centerline of the bending tunnel lies along a centerline of a longitudinal axis of the setting tool. The whipstock face resides at a lower end of the bending tunnel and spans the entire outer diameter of the setting tool. The bending tunnel is configured to receive the jetting hose and connected jetting nozzle such that the jetting hose travels across the whipstock face to the exit portal at a radius "R."

In the method, manipulating the setting tool to move the torque pins may comprise:

applying a downward force to the setting tool and landing the shift dogs of the setting tool into the shift dog grooves of the inner sleeve, the inner sleeve being in its first position;

rotating the whipstock clockwise, thereby applying torque to the inner sleeve through the alignment blocks until the set screws are sheared, and thereby placing the torque pins in a first axial portion of the control slot; and applying an upward force to the setting tool and connected inner sleeve to raise the torque pins along the first axial portion of the control slot, followed by a counter-clockwise rotation of the setting tool, thereby moving the torque pins along the control slot and placing the inner sleeve in its second position.

Manipulating the setting tool to move the torque pins may further comprise:

again rotating the whipstock clockwise, thereby applying torque to the inner sleeve through the alignment blocks and thereby placing the torque pins in a second axial portion of the control slot;

again applying an upward force to the setting tool and connected inner sleeve, followed by another clockwise rotation of the setting tool, thereby moving the torque pins along the control slot and placing the inner sleeve in its third position;

rotating the whipstock counter-clockwise, thereby applying torque to the inner sleeve through the alignment blocks and thereby placing the torque pins back in the second axial portion of the control slot;

again applying an upward force to the setting tool and connected inner sleeve to raise the torque pins along the second axial portion of the control slot, followed by another clockwise rotation of the setting tool, thereby moving the torque pins along the control slot and placing the inner sleeve in its fourth position;

rotating the whipstock counter-clockwise, thereby applying torque to the inner sleeve through the alignment blocks and thereby placing the torque pins in a third axial portion of the control slot; and again applying an upward force to the setting tool and connected inner sleeve to raise the torque pins along the third axial portion of the control slot, followed by a counter-clockwise rotation of the setting tool, thereby moving the torque pins along the control slot and placing the inner sleeve in its fifth position.

Using the ported casing collar, a formation stimulation operation may be conducted. The operation involves the forming of one or more small, lateral boreholes off of a child wellbore. The lateral boreholes are hydraulically excavated through the aligned portals and into a pay zone that exists within a surrounding rock matrix. The pay zone has been identified as holding, or at least potentially holding, hydrocarbon fluids or organic-rich rock.

The ported casing collar may be arranged such that:

subsequent to the enlarged wall portion gravitationally rotating to at-or-near a true vertical bottom, the ported casing collar is configured such the east portal has been positioned less than or greater than true horizontal, and the opposing west portal has been positioned less than or greater than true horizontal, such that a vector drawn from the center of the east portal through the center of the west portal comprises a straight line that is at-or-near parallel to the bedding plane of the host pay zone.

Alternatively, the ported casing collar may be arranged such that:

subsequent to the enlarged wall portion gravitationally rotating to at-or-near a true vertical bottom, the ported casing collar is configured such the east portal has been positioned at-or-near the top of true vertical, and the opposing west portal has been positioned at-or-near the bottom of true vertical, such that a vector drawn from the center of the east portal through the center of the west portal would comprise a straight line that is at-or-near true vertical.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 4A-1 is an axial, cross-sectional view of the coiled tubing conveyance medium of FIG. 4A. In this embodiment, an inner coiled tubing is "bundled" concentrically with both electrical wires and data cables within a protective outer layer.

FIG. 4A-2 is another axial, cross-sectional view of the coiled tubing conveyance medium of FIG. 4A, but in a different embodiment. Here, the inner coiled tubing is "bundled" eccentrically within the protective outer layer to provide more evenly-spaced protection of the electrical wires and data cables.

FIG. 4B-1*a* is an enlarged, perspective view of the crossover connection of FIG. 4B, seen between cross-sections E-E' and F-F'. This view highlights the wiring chamber's general transition in cross-sectional shape from circular to elliptical.

FIG. 4C is a longitudinal, cross-sectional view of the main control valve of the external system of FIG. 4.

FIG. 4C-1*a* is a cross-sectional view of the main control valve, taken across line G-G' of FIG. 4C.

FIG. 4C-1*b* is a perspective view of a sealing passage cover of the main control valve, shown exploded away from FIG. 4C-1*a*.

FIG. 4D-1*a* is an enlarged, perspective view of the transition between lines I-I' and J-J' of FIG. 4D.

FIG. 4D-2 shows an enlarged view of a portion of the jetting hose pack-off section. Internal seals of the pack-off section conform to the outer circumference of the jetting hose residing therein. A pressure regulator valve is shown schematically adjacent the pack-off section.

FIG. 4E-1*a* is an axial, cross-sectional view of the whipstock member, with a perspective view of sequential axial jetting hose cross-sections depicting its path downstream from the center of the whipstock member taken across line O-O' of FIG. 4E to the start of the jetting hose's bend radius as it approaches line P-P'.

FIG. 4E-1*b* depicts an axial, cross-sectional view of the whipstock member taken across line P-P' of FIG. 4E.

FIG. 4MW is a longitudinal cross-sectional view of a modified whipstock designed to be mateably received within a ported casing collar. Translational and rotational movement of the modified whipstock actuates movement of an inner sleeve of the ported casing collar, providing a preformed casing exit.

FIG. 4MW.1 is an exploded view of the modified whipstock wherein a jetting hose exit is aligned with portals of inner and outer sleeves of the casing collar.

FIG. 4MW.2 is an enlarged view of the whipstock of FIG. 4MW.1. Here, the whipstock is rotated 90° about a longitudinal access, revealing a pair of opposing "shift dogs."

FIG. 4MW.2.SD is an exploded, cross-sectional view of one of the two spring-loaded shift dogs.

FIG. 4MW.2.AB is an exploded, cross-sectional view of a portion of one of the spring-loaded alignment blocks of FIG. 4MW.

FIG. 4PCC.1 is a longitudinal cross-sectional view of the ported casing collar of FIG. 4MW.

FIG. 4PCC.1.SDG is an exploded, longitudinal cross-sectional view of a shift dog groove that resides in the ported casing collar of FIG. 4PCC.1. The shift dog groove is dimensioned to receive the shift dogs of the modified whipstock.

FIG. 4PCC.1.CLD is an exploded cross-sectional view of a collet latch dog of the ported casing collar of FIG. 4PCC.1.

FIG. 4PCC.1.CSP is a two-dimensional "roll-out" view of a control slot pattern for the inner sleeve of the ported casing collar, showing each of five possible slot positions.

FIG. 4PCC.2 is an operational series showing the relative positions of each of the outer sleeve's two stationary portals versus each of the inner sleeve's three portals as the inner sleeve is translated and rotated into each of its five possible positions.

FIGS. 4PCC.3*d*.1 through 4PCC.3*d*.5 is a series of perspective views of the ported casing collar of FIG. 4PCC.1. These figures illustrate positions of the ported casing collar when placed along a production casing string per the control slot positions of FIG. 4PCC.2.

FIG. 4PCC.3*d*.1 shows the ported casing collar in a position where the inner sleeve portals and the outer sleeve portals are out of alignment. This is a "closed" position.

FIG. 4PCC.3*d*.2 shows an alignment of certain inner sleeve portals with certain outer sleeve portals where "east" ports are open.

FIG. 4PCC.3*d*.3 shows an alignment of certain inner sleeve portals with certain outer sleeve portals where "west" ports are open.

FIG. 4PCC.3*d*.4 shows an alignment of certain inner sleeve portals with certain outer sleeve portals where both the "east" and the "west" ports are open.

FIG. 4PCC.3*d*.5 again shows the inner sleeve portals and the outer sleeve portals out of alignment. This is another closed position.

FIG. 4HLS is a longitudinal, cross-sectional view of a hydraulic locking swivel as may be placed at each end of the ported casing collar of FIG. 4PCC.3*d*.

DETAILED DESCRIPTION OF CERTAIN EMBODIMENTS

Definitions

Figure 1A:
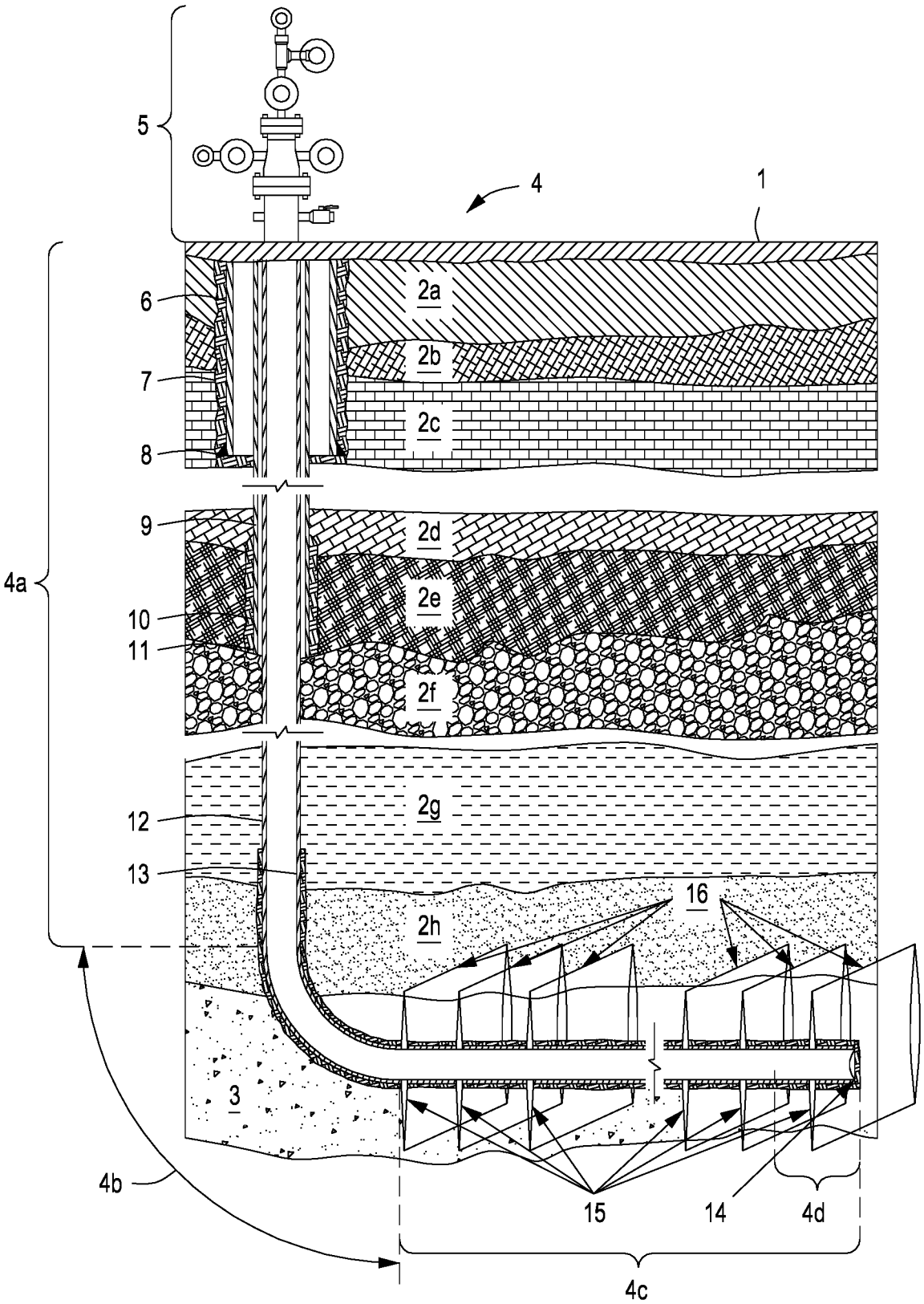
FIG. 1A is a cross-sectional view of an illustrative horizontal wellbore. Half-fracture planes are shown in 3-D along a horizontal leg of the wellbore to illustrate fracture stages and fracture orientation relative to a subsurface formation.

As used herein, the term "hydrocarbon" refers to an organic compound that includes primarily, if not exclusively, the elements hydrogen and carbon. Examples of hydrocarbon-containing materials include any form of natural gas, oil, coal, and bitumen that can be used as a fuel or upgraded into a fuel.

As used herein, the term "fluid" refers to gases, liquids, and combinations of gases and liquids, as well as to combinations of gases and solids, and combinations of liquids and solids.

As used herein, the term "hydrocarbon fluids" refers to a hydrocarbon or mixtures of hydrocarbons that are gases or liquids at formation conditions, at processing conditions, or at ambient conditions. Examples include oil, natural gas, condensate, coal bed methane, shale oil, shale gas, and other hydrocarbons that are in a gaseous or liquid state.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," "reservoir", or "interval" may be used.

The term "borehole" as used herein refers to the excavated void space in the subsurface, typically of circular cross-section and generated by excavation mechanisms; for example, of either drilling or jetting. A borehole may have almost any longitudinal azimuth or orientation, and may be up to hundreds (jetting) or more typically thousands or tens of thousands of feet in length (drilling).

As used herein, the term "wellbore" refers to a borehole excavated by drilling and subsequently cased (typically with steel casing) along much if not its entire length. Usually at least 3 or more concentric strings of casing are required to form a wellbore for the production of hydrocarbons. Each casing is typically cemented within the borehole along a significant portion(s) of its length, with the cementing of the larger diameter, shallower strings requiring circulation to surface. As used herein, the term "well" may be used interchangeably with the term "wellbore."

The term "jetting fluid" refers to any fluid pumped through a jetting hose and nozzle assembly for the purpose of erosionally boring a lateral borehole from an existing wellbore. The jetting fluid may or may not contain an abrasive material.

The term "abrasive material" or "abrasives" refers to small, solid particles mixed with or suspended in the jetting fluid to enhance the erosional degradation of the target by the (jetting) liquid by adding to it destruction of the target face via the solid impact force(s) of the abrasive. Targets typically referenced herein are: (1) the pay zone; and/or (2) the cement sheath between the production casing and pay zone; and/or (3) the wall of the production casing at the point of desired casing exit.

The terms "tubular" or "tubular member" refer to any pipe, such as a joint of casing, a portion of a liner, a joint of tubing, a pup joint, or coiled tubing.

The terms "lateral borehole" or "mini-lateral" or "ultra-deep perforation" ("UDP") refer to the resultant borehole in a subsurface formation, typically upon exiting a production casing and its surrounding cement sheath in a child wellbore, with the borehole being formed in a pay zone. For the purposes herein, a UDP is formed as a result of hydraulic jetting forces erosionally boring through the pay zone with a high pressure jetting fluid directed through a jetting hose and out a jetting nozzle affixed to the terminal end of the jetting hose.

The terms "steerable" or "guidable", as applied to a hydraulic jetting assembly, refers to a portion of the jetting assembly (typically, the jetting nozzle and/or the portion of jetting hose immediately proximal the nozzle) for which an operator can direct and control its geo-spatial orientation while the jetting assembly is in operation. This ability to direct, and subsequently re-direct the orientation of the jetting assembly during the course of erosional excavation can yield UDP's with directional components in one, two, or three dimensions, as desired.

The term "perforation cluster" refers to a group of conventional perforations, and/or sliding sleeve ports generally proximal to one another in a common wellbore. A given perforation cluster is generally hydraulically fracture stimulated with a common frac "stage," typically with the intent of creating a single contiguous Stimulated Reservoir Volume ("SRV") within the pay zone. In this disclosure, a "cluster" may be used to refer to two or more lateral boreholes formed at a single casing exit location for a frac stage.

The term "stage" references a discreet portion of a stimulation treatment applied in completing or recompleting a specific pay zone, or specific portion of a pay zone. In the case of a cased horizontal child wellbore, up to 10, 20, 50 or more stages may be applied to their respective perforation borehole clusters. Typically, this requires some form of zonal isolation prior to pumping each stage.

The terms "contour" or "contouring" as applied to individual UDP's, or groupings of UDP's in a "cluster", refers to steerably excavating the lateral borehole so as to optimally receive, direct, and control stimulation fluids, or fluids and proppants, of a given stimulation (typically, fracking) stage. The result is an optimized Stimulated Reservoir Volume ("SRV").

The terms "real time" or "real time analysis" of geophysical data (such as micro-seismic, tiltmeter, and or ambient micro-seismic data) and/or pressure data (such as obtained from pressure "bombs") that is obtained during the course of pumping a stage of a stimulation (such as fracking) treatment means that results of said data analysis can be applied to: (1) altering the remaining portion of the stimulation treatment (yet to be pumped) in its pump rates, treating pressures, fluid rheology, and proppant concentration in order to optimize the benefits therefrom; and, (2) optimizing the placement of perforations, or contouring the trajectories of UDP's, within the subsequent "cluster(s)" to optimize the SRV obtained from the subsequent stimulation stages.

The term "parent wellbore" refers to a wellbore that has already been completed in and is producing reservoir fluids from a pay zone for a period of time, creating an area of pressure depletion within the pay zone. A "parent" wellbore may be a vertical, horizontal, or directional well.

The term "child wellbore" refers to a well being completed in a common pay zone proximal an offsetting "parent" wellbore.

The term "frac hit" describes an interwell communication event wherein a "parent" well is affected by the pumping of a hydraulic fracturing treatment in a new "child" well. A frac hit from a single child well can hit more than one parent well.

The term "jetting hose" refers to a flexible fluid conduit, capable of conducting relatively small volumes of fluids at relatively high pressures, typically up to thousands of psi.

DESCRIPTION OF SPECIFIC EMBODIMENTS

A method of stimulating a subsurface formation is provided herein. Specifically, a method of stimulating a formation, such as through hydraulic fracturing, is provided wherein a so-called "frac hit" of a neighboring wellbore is avoided or wherein an otherwise stranded portion of a reservoir is accessed.

The method employs a novel downhole hydraulic jetting assembly as disclosed in co-owned U.S. Pat. No. 9,976,351 entitled "Downhole Hydraulic Jetting Assembly." This assembly allows an operator to run a jetting hose into the horizontal section of a wellbore, and then "push" the jetting hose out of a tubular jetting hose carrier using hydraulic forces. Beneficially, the jetting hose is extruded out of the jetting hose carrier and against the concave face of a whipstock, whereupon jetting fluids may be injected through the jetting hose and a connected nozzle. A mini-lateral borehole may then be formed extending from the wellbore.

In accordance with industry procedures, a hydraulic fracturing (or other formation treating procedure) is conducted in the horizontally formed wellbore. In this instance, fracing is conducted by injecting fracturing fluids into the lateral borehole. In the present method, wellbore pressure in an offset well is monitored during the fracing stage. In the event pressures indicative of an impending frac hit are detected, the pumping of fracturing fluids into the lateral borehole is discontinued.

In one aspect of the present method, a specially-designed whipstock of the jetting assembly is provided. The whipstock is designed to be mateably received by a novel ported casing collar, which is also provided herein. The whipstock may be manipulated at the surface to selectively align portals within the casing collar, thereby creating casing windows, or "casing exits," through which the jetting nozzle and connected hydraulic hose may pass. One or more boreholes may then be "jetted" outwardly into a surrounding subsurface formation through the aligned portals.

The lateral boreholes essentially represent ultra-deep perforations ("UDP's") that are formed by using hydraulic forces directed through a flexible, high pressure jetting hose. Both the trajectory and the length of the borehole may be controlled. Using the downhole assembly, the operator is able to use a single hose and nozzle to jet a series of lateral boreholes within the leg of a horizontal wellbore in a single trip.

FIG. 1A is a schematic depiction of a horizontal well 4. A wellhead 5 is located above the well 4 at an earth's surface 1. The well 4 penetrates through a series of subsurface strata 2*a* through 2*h* before reaching a pay zone 3. The well 4 includes a horizontal section 4*c*. The horizontal section 4*c* is depicted between a "heel" 4*b* and a "toe" 4*d*.

Conventional perforations 15 within the production casing 12 are shown in up-and-down pairs. The perforations 15 are depicted with subsequent hydraulic fracture half-planes (or, "frac wings") 16.

Figure 1B:
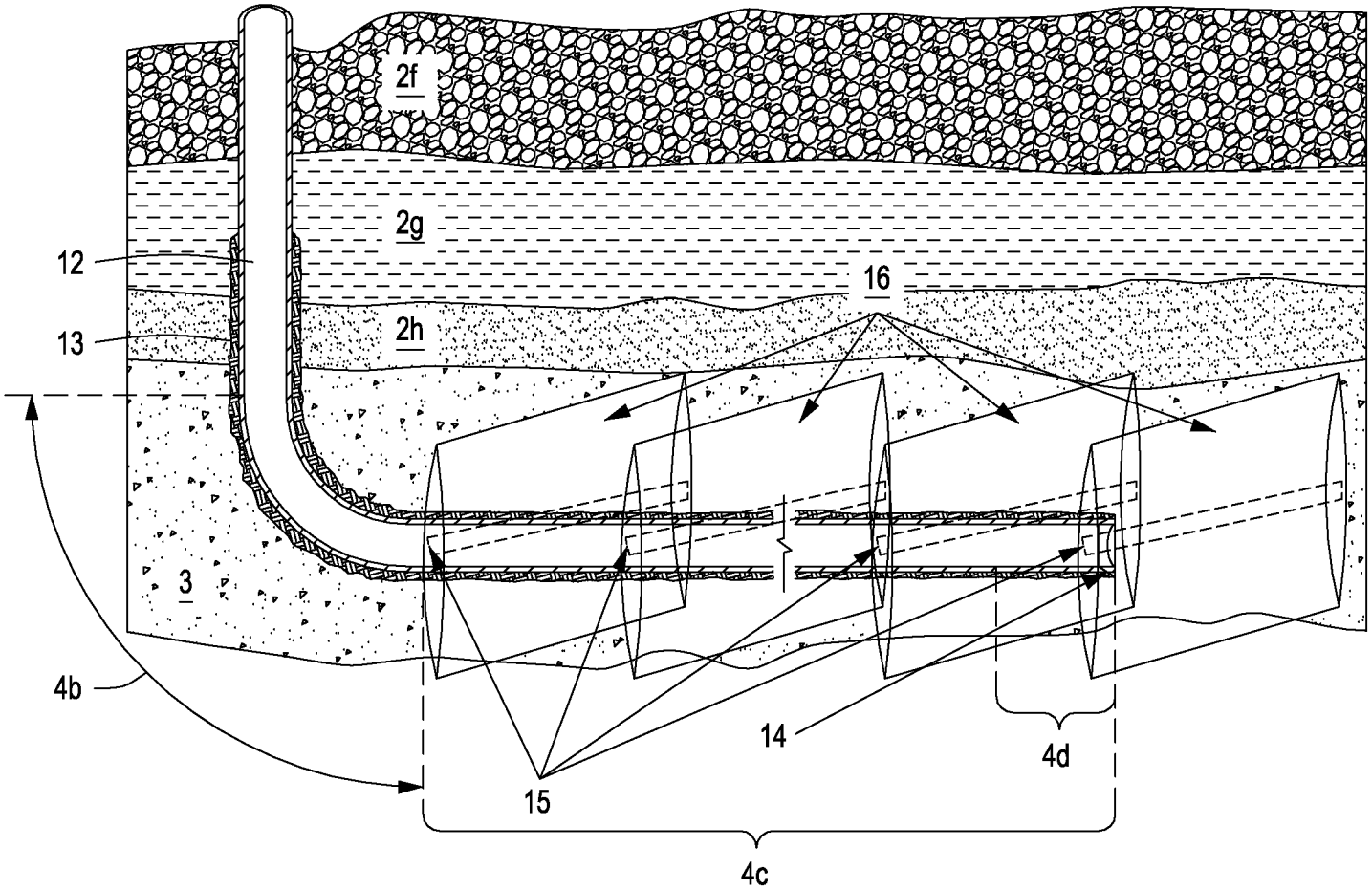
FIG. 1B is an enlarged view of the horizontal portion of the wellbore of FIG. 1A. Conventional perforations are replaced by ultra-deep perforations ("UDP's"), or mini-lateral boreholes, that are subsequently fracked to create fracture planes.

FIG. 1B is an enlarged view of the lower portion of the well 4 of FIG. 1A. Here, the horizontal section 4*c* between the heel 4*b* and the toe 4*d* is more clearly seen. In this depiction, application of the subject apparati and methods herein replaces the conventional perforations (15 in FIG. 1A) with pairs of opposing lateral boreholes 15 Of interest, the lateral boreholes include subsequently generated fracture half-planes 16. In the view of FIG. 1B, the frac wings 16 are now better confined within the pay zone 3, while reaching much further out from the horizontal wellbore 4*c* into the pay zone 3. Stated another way, in-zone fracture propagation is enhanced by the pre-formed UDP's 15, forming an enhanced Stimulated Reservoir Volume, or "SRV."

Figure 2:
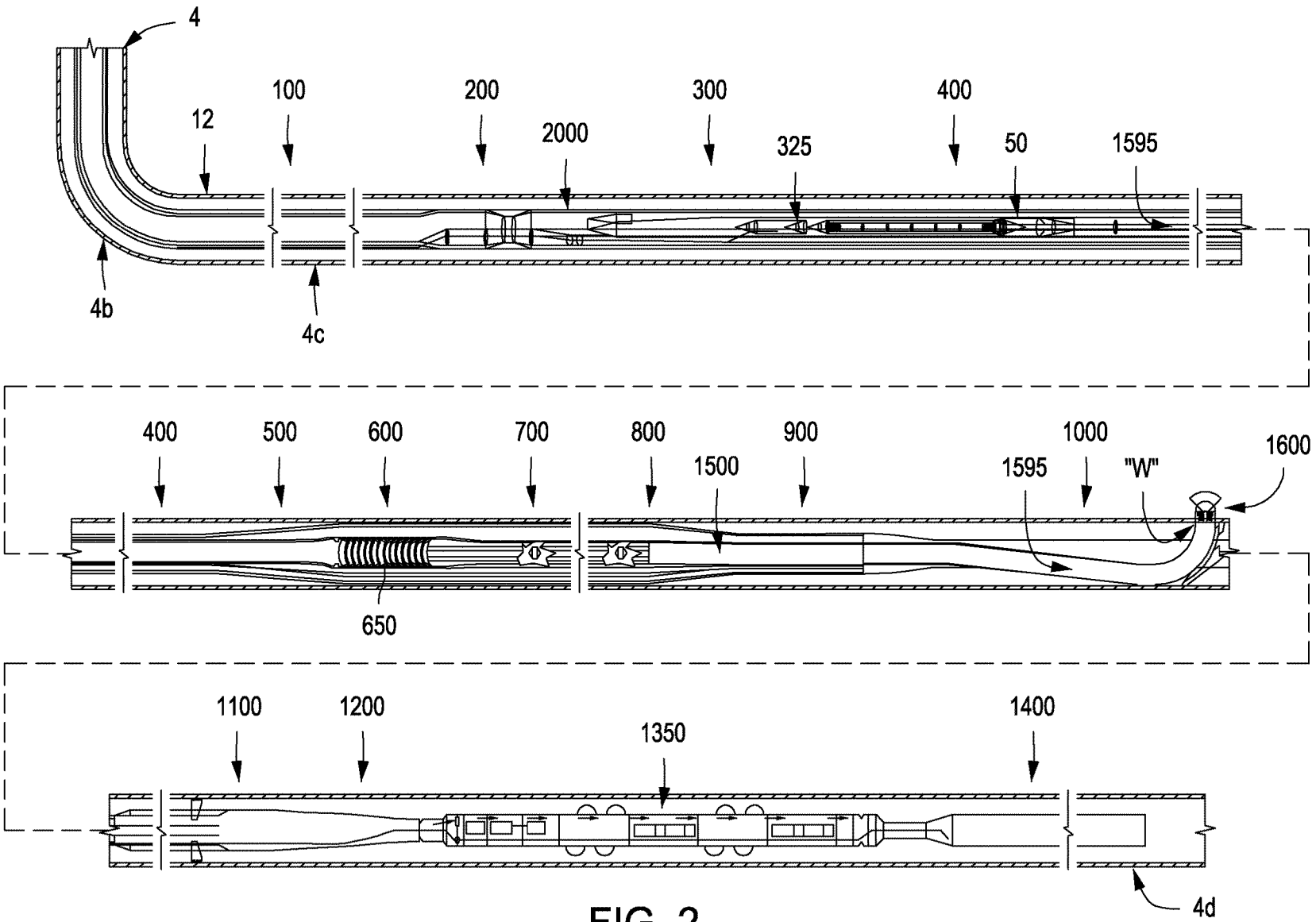
FIG. 2 is a longitudinal, cross-sectional view of a downhole hydraulic jetting assembly of the present invention, in one embodiment. The assembly is shown within a horizontal section of a production casing. The jetting assembly has an external system and an internal system.

FIG. 2 provides a longitudinal, cross-sectional view of a downhole hydraulic jetting assembly 50, in one embodiment. The jetting assembly 50 is shown residing within a string of production casing 12. The production casing 12 may have, for example, a 4.5-inch O.D. (4.0-inch I.D.). The production casing 12 is presented along a horizontal portion 4*c* of the wellbore 4. As noted in connection with FIGS. 1A and 1B, the horizontal portion 4*c* defines a heel 4*b* and a toe 4*d*.

The jetting assembly 50 generally includes an internal system 1500 and an external system 2000. The jetting assembly 50 is designed to be run into a wellbore 4 at the end of a working string, sometimes referred to herein as a "conveyance medium." Preferably, the working string is a string of coiled tubing, or more preferably, coiled tubing with electric line ("e-coil") 100. Alternatively, a "bundled" product that incorporates electrically conductive wiring and data conductive cables (such as fiber optic cables) around the coiled tubing core may be used.

It is preferred to maintain an outer diameter of the coiled tubing 100 that leaves an annular area within the approximate 4.0" I.D. of the casing 12 that is greater than or equal to the cross-sectional area open to flow for a 3.5" O.D. frac (tubing) string. This is because, in the preferred method (after jetting one or more, preferably two opposing mini-laterals, or even specially contoured "clusters" of small-diameter lateral boreholes), fracture stimulation can immediately (after repositioning the tool string slightly downhole) take place down the annulus between the coiled tubing 100 plus the external system 2000, and the well casing 12. For 9.2 #, 3.5" O.D. tubing (i.e., frac string equivalent), the I.D. is 2.992 inches, and the cross-sectional area open to flow is 7.0309 square inches. Back-calculating from this same 7.0309 $in^2$ equivalency yields a maximum O.D. available for both the coiled tubing conveyance medium 100 and the external system 2000 (having generally circular cross-sections) of 2.655". Of course, a smaller O.D. for either may be used provided such accommodate a jetting hose 1595.

In the view of FIG. 2, the assembly 50 is in an operating position, with a jetting hose 1595 being run through a whipstock 1000, and a jetting nozzle 1600 passing through a first window "W" of the production casing 12. The jetting hose 1595 will preferably have a core that is fluid impermeable and that has a low friction resistance to the flowing fluid. Suitable core materials include PTFE (or "Teflon®"). The jetting hose 1595 will also have one or more layers of reinforcement surrounding the core, such as spiral or braided steel wire or braided Kevlar. Finally, a cover or shroud is placed around the reinforcement layer.

The nozzle 1600 may be any known jetting nozzle, including those described in the '351 patent, useful for jetting through casing, cement and a rock formation. However, it is preferred that a unique, electric-driven, rotatable "fan jet" jetting nozzle be employed as part of the external system. The nozzle can emulate the hydraulics of conventional hydraulic perforators, thereby precluding the need for a separate run with a milling tool to form a casing exit. The nozzle optionally includes rearward thrusting jets about the body to enhance forward thrust and borehole cleaning during lateral borehole formation, and to provide clean-out and borehole expansion during pull-out.

As an alternative feature, the whipstock 1000 may operate in conjunction with a novel casing collar. In this instance, the whipstock 1000 latches into and manipulates an inner sleeve of the collar using an extension mechanism (discussed below). In this way, portals of the inner sleeve can be selectively aligned with portals of an outer sleeve that has self-oriented by virtue of gravitational forces applied to its weighted belly. Hydraulic pressure then locks the outer sleeve into this desired orientation, thereby rendering it stationary relative to the inner sleeve. The whipstock 1000 can then mateably attach to, and manipulate both rotationally and translationally, the inner sleeve, thereby creating access to pre-fabricated and pre-oriented casing exit alternatives.

In FIG. 2, a string of coiled tubing 100 is used as the conveyance medium for the downhole hydraulic jetting assembly. The jetting assembly 50 includes an internal system (shown in FIG. 3A at 1500) and an external system (shown in FIG. 4 at 2000). The internal system 1500 largely resides within the external system 2000 during run-in.

Near the proximal end of the jetting assembly 50, just downstream to its connection to the conveyance medium coiled tubing 100, is a main control valve, indicated at 300. The main control valve 300 directs fluids selectively to either: (1) the internal system 1500, and specifically to the jetting hose 1595; or, (2) annuli associated with the external system 2000.

Figure 4:
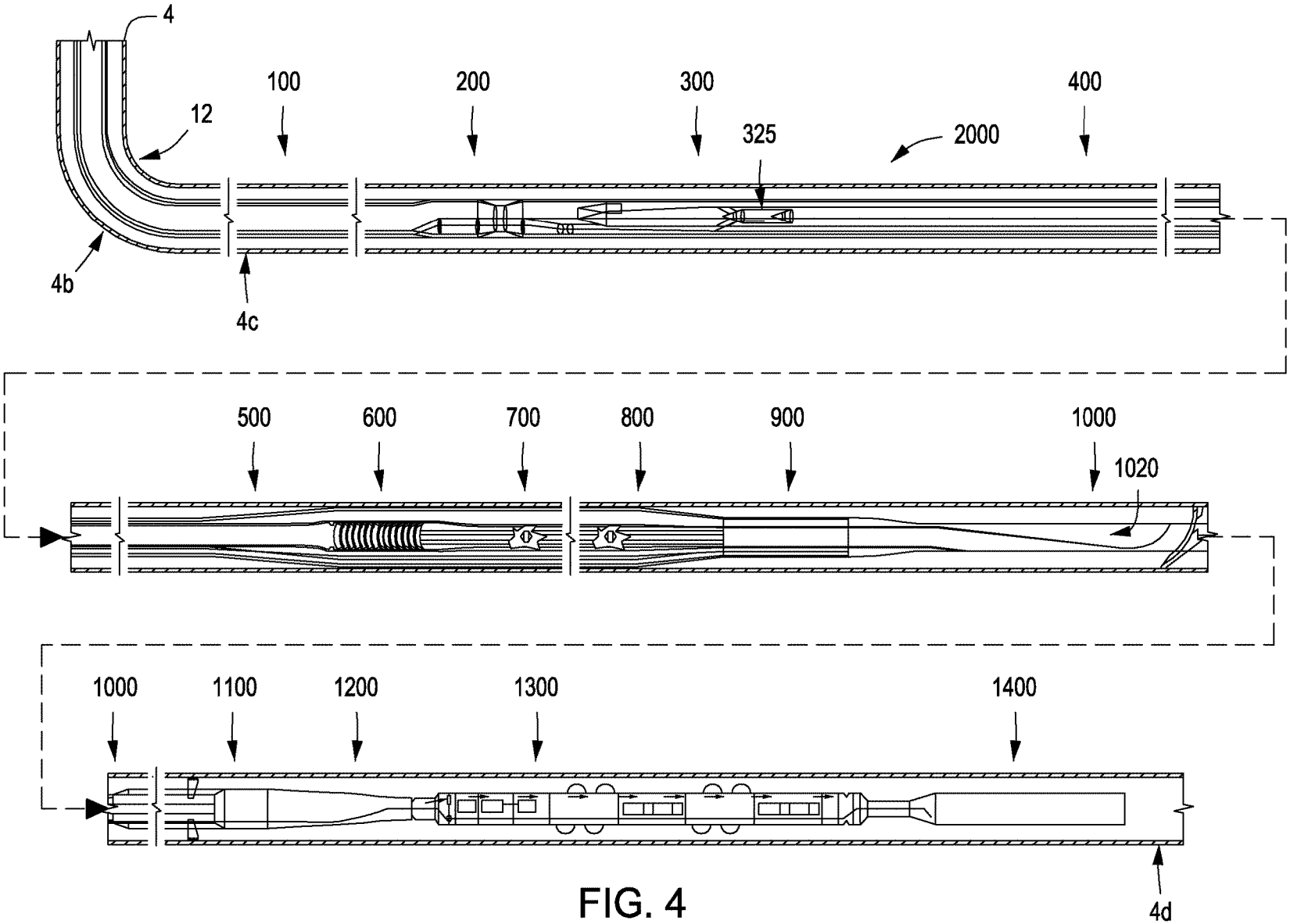
FIG. 4 is a longitudinal, cross-sectional view of the external system of the downhole hydraulic jetting assembly of FIG. 2, in one embodiment. The external system resides within production casing of the horizontal leg of the wellbore of FIG. 2.
Figures 1, 4A:
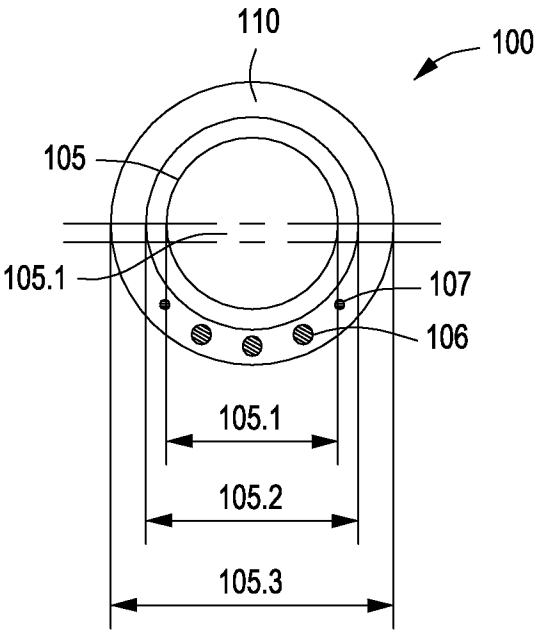
Figure 4A:
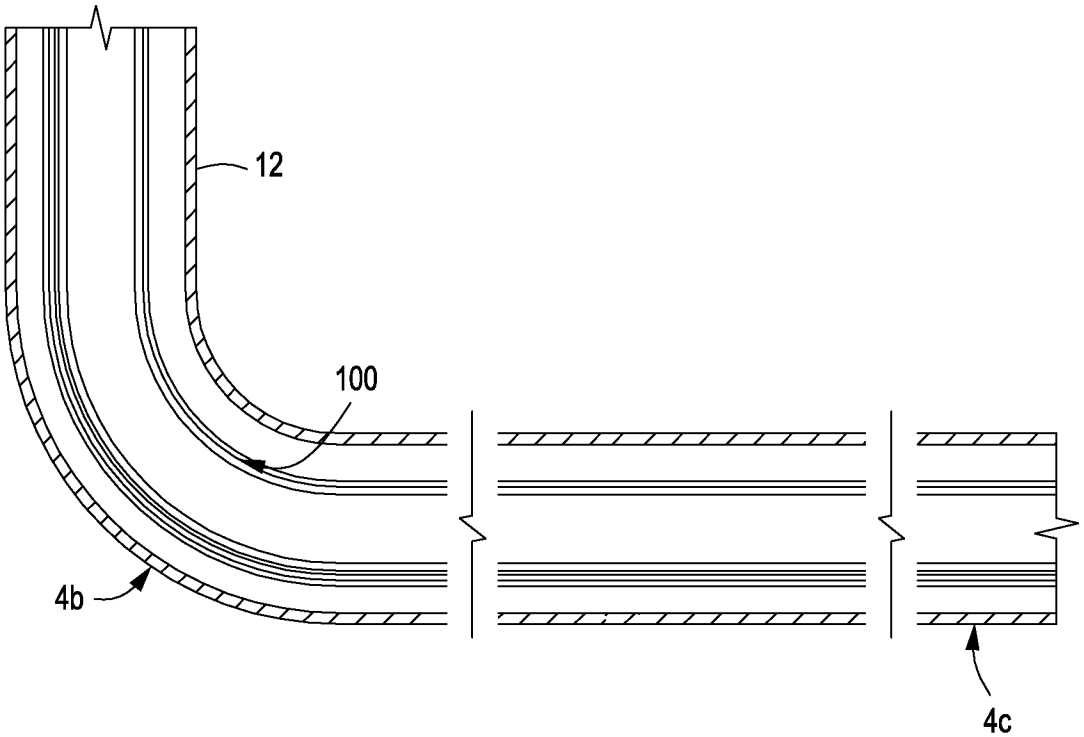
FIG. 4A is an enlarged, longitudinal cross-sectional view of a portion of a bundled coiled tubing conveyance medium which conveys the external system of FIG. 4 into and out of the wellbore.
Figures 2, 4A:
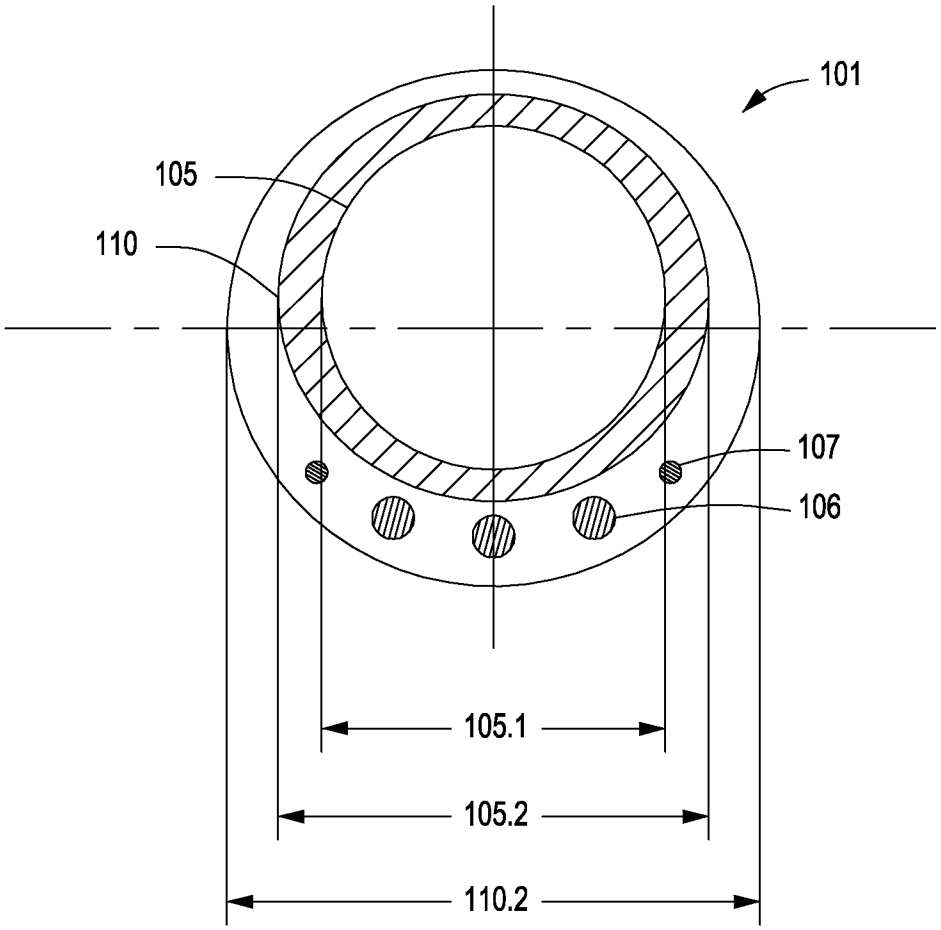

A jetting hose carrier 400 is shown in FIG. 1. The jetting hose carrier 400 is part of the external system 2000, and closely holds the jetting hose 1595 during run-in and pull-out. A micro-annulus resides between the jetting hose 1595 and the jetting hose carrier 400. The micro-annulus is sized to prevent buckling of the jetting hose 1595.

Crossover sections are shown at 500, 800 and 1200. The crossover sections 500, 800 are also part of the external system 2000. In addition, a pack-off section 600 and an optional internal tractor system 700 are provided. The features are described in the '351 patent.

At the end of the jetting assembly 50, and below the whipstock 1000, are optional components. These may include a conventional tractor 1350 and a logging sonde 1400.

Figure 3A:
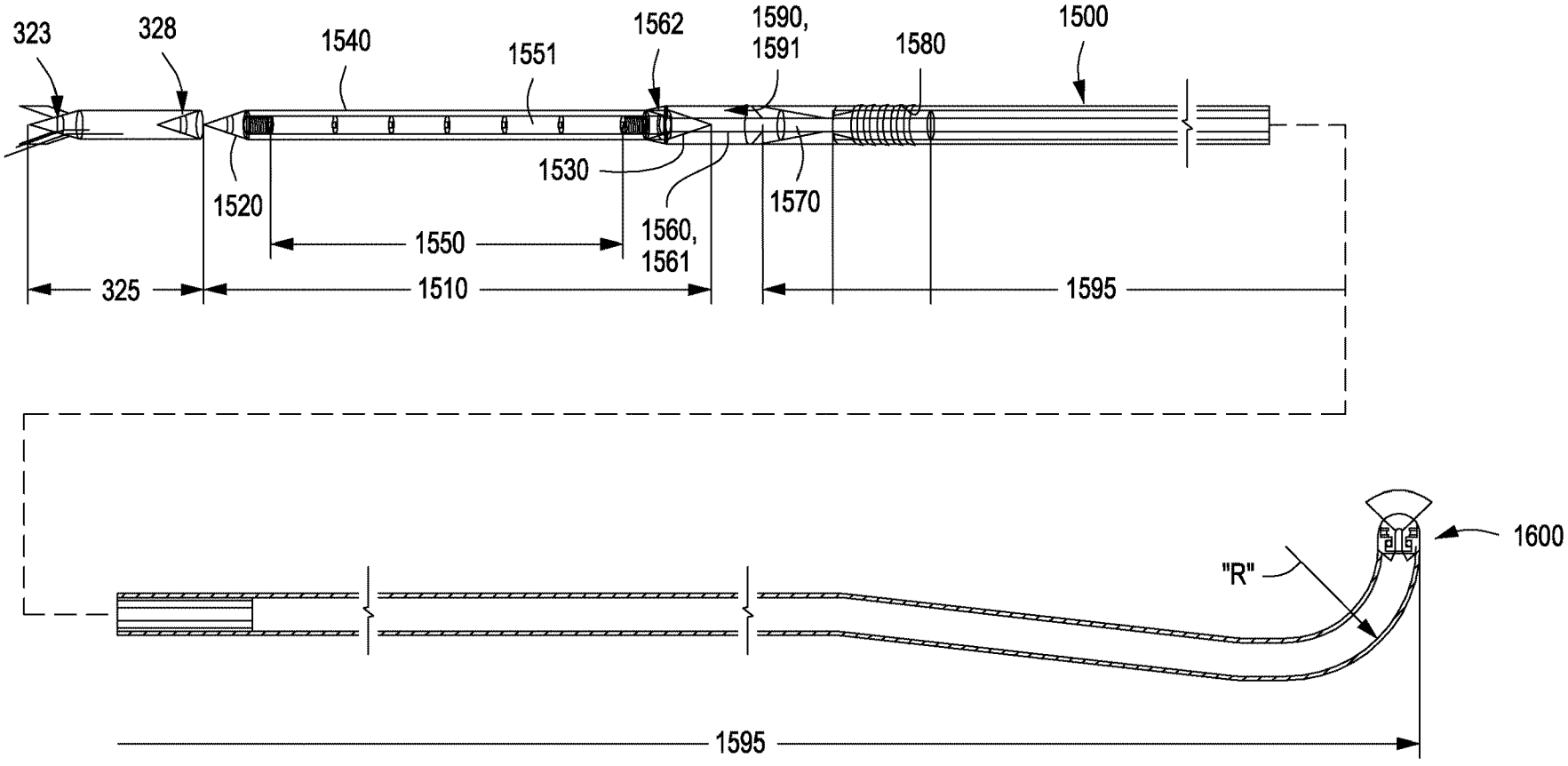
FIG. 3A is a longitudinal, cross-sectional view of the internal system of the hydraulic jetting assembly of FIG. 2. The internal system extends from an upstream battery pack end cap (that mates with the external system's docking station) at its proximal end to an elongated hose having a jetting nozzle at its distal end.

FIG. 3A is a longitudinal, cross-sectional view of the internal system 1500 of the hydraulic jetting assembly 50 of FIG. 2. The internal system 1500 is a steerable system that, when in operation, is able to move within and extend out of the external system 2000. The internal system 1500 is comprised primarily of:

(1) power and geo-control components;
(2) a jetting fluid intake;
(3) the jetting hose 1595; and
(4) the jetting nozzle 1600.

The internal system 1500 is designed to be housed within the external system 2000 while being conveyed by the coiled tubing 100 and the attached external system 2000 into and out of the child wellbore 4. Extension of the internal system 1500 from and retraction back into the external system 2000 is accomplished by the application of: (a) hydraulic forces; (b) mechanical forces; or (c) a combination of hydraulic and mechanical forces. Beneficial to the design of the internal 1500 and external 2000 systems comprising the hydraulic jetting apparatus 50 is that transport, deployment, or retraction of the jetting hose 1595 never requires the jetting hose 1595 to be coiled. Specifically, the jetting hose 1595 is never subjected to a bend radius smaller than the I.D. of the production casing 12, and that only incrementally while being advanced along the whipstock 1050 of the jetting hose whipstock member 1000 of the external system 2000. Note the jetting hose 1595 is typically ¼th" to ⅝ths" I.D., and up to approximately 1" O.D., flexible tubing that is capable of withstanding high internal pressures.

During jetting, the path of the high pressure hydraulic jetting fluid is as follows:

(1) Jetting fluid is discharged from a high pressure pump at the surface 1 down the I.D. of the coiled tubing conveyance medium 100, at the end of which it enters the external system 2000;
(2) Jetting fluid enters the external system 2000 through a coiled tubing transition connection 200;
(3) Jetting fluid enters the main control valve 300 through a jetting fluid passage;
(4) Because the main control valve 300 is positioned to receive jetting fluid (as opposed to hydraulic fluid), a sealing passage cover will be positioned to seal a hydraulic fluid passage, leaving the only available fluid path through the jetting fluid passage; and
(5) Because of an upper seal assembly 1580 at the top of the jetting hose carrier 400, which seals a micro-annulus between the jetting hose 1595 and the jetting hose carrier 400, jetting fluid cannot go around the jetting hose 1595 (note this hydraulic pressure on the seal assembly 1580 is the force that tends to pump the internal system 1500, and hence the jetting hose 1595, "down the hole") and thus jetting fluid is forced to go through the jetting hose 1595.

Features of the internal system 1500 as depicted in FIG. 3A are also described in the '351 patent. These include the optional battery pack 1510 with its upstream and downstream battery pack end caps 1520 and 1530, the battery pack casing 1540, the batteries 1551, columnar supports 1560, a fluid receiving funnel 1570, end caps 1562, 1563, the seal assembly 1580 and electrical wires 1590. In addition, a docking station 325 with a conically shaped end cap 323 is described in the '351 patent.

The downward hydraulic pressure of the jetting fluid acting upon the axial cross-sectional area of the jetting hose's fluid receiving funnel 1570 creates an upstream-to-downstream force that tends to "pump" the seal assembly 1580 and connected jetting hose 1595 "down the hole." In addition, because the components of the fluid receiving funnel 1570 and a supporting upper seal 1580U of the seal assembly 1580 are slightly flexible, the net pressure drop described above serves to swell and flare the outer diameters of upper seal 1580 radially outwards, thus producing a fluid seal that precludes fluid flow behind the hose 1595.

Figure 3B:
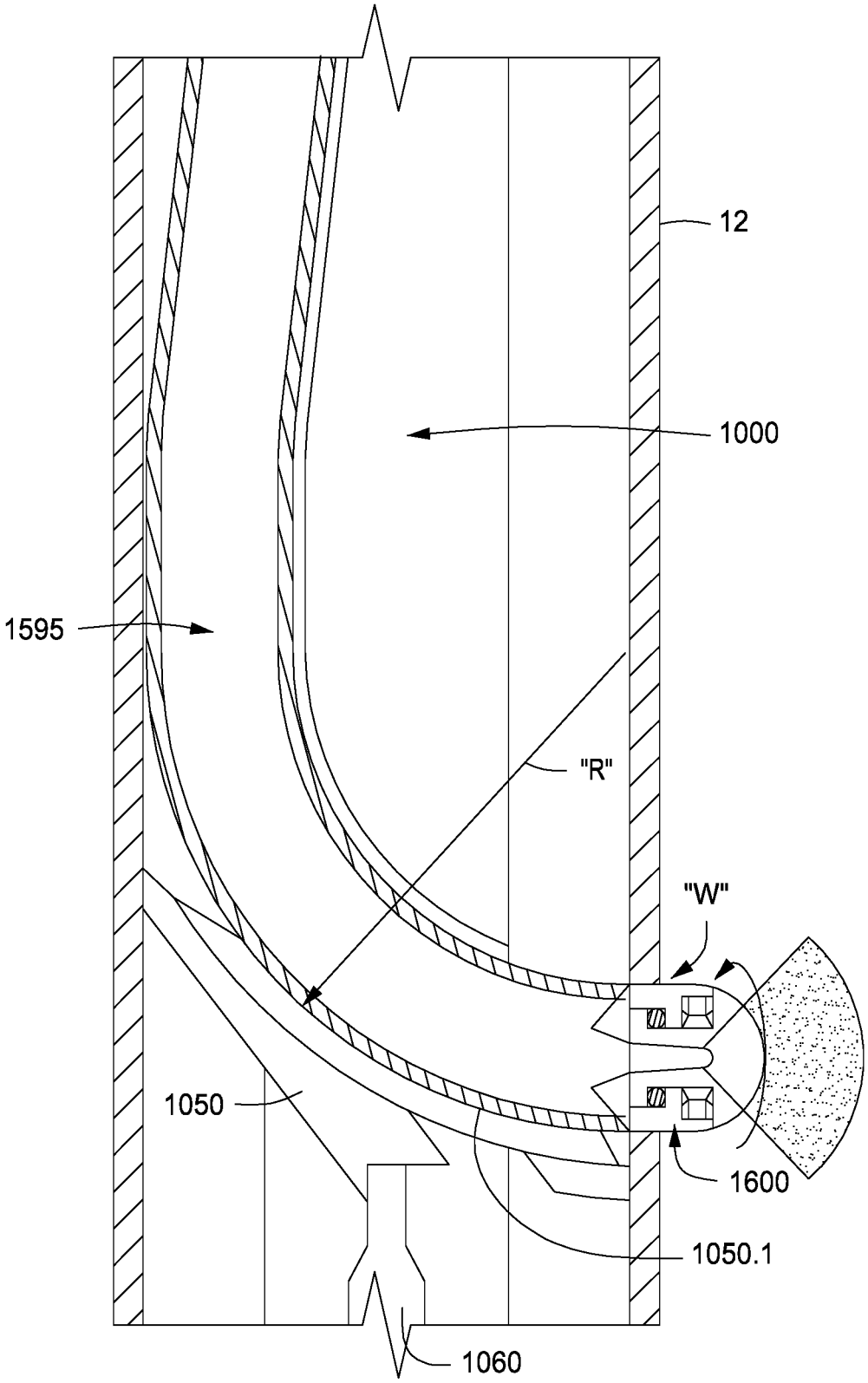
FIG. 3B is an expanded cross-sectional view of the terminal end of the jetting hose of FIG. 3A, showing the nozzle of the internal system. The bend radius of the jetting hose "R" is shown within a cut-away section of the whipstock of the external system of FIG. 3.

Moving down the hose 1595 to the distal end, FIG. 3B provides an enlarged, cross sectional view of the end of the jetting hose 1595. Here, the jetting hose 1595 is passing through the whipstock 1000 along the whipstock face 1050.1. A jetting nozzle 1600 is attached to the distal end of the jetting hose 1595. The jetting nozzle 1600 is shown in a position immediately subsequent to forming an exit opening, or window "W" in the production casing 12. Of course, it is understood that the present assembly 50 may be reconfigured for deployment in an uncased wellbore.

As described in the parent applications, the jetting hose 1595 immediately preceding this point of casing exit "W" spans the entire I.D. of the production casing 12. In this way, a bend radius "R" of the jetting hose 1595 is provided that is always equal to the I.D. of the production casing 12. This allows the assembly 50 to utilize the entire casing (or wellbore) I.D. as the bend radius "R" for the jetting hose 1595, thereby providing for utilization of the maximum I.D./O.D hose. This, in turn, provides for placement of maximum hydraulic horsepower ("HHP") at the jetting nozzle 1600, which further translates into the capacity to maximize formation jetting results such as penetration rate for the lateral boreholes.

It is observed from FIG. 3B that there are three "touch points" for the bend radius "R" of the jetting hose 1595. First, there is a touch point where the hose 1595 contacts the I.D. of the casing 12. This occurs at a point directly opposite and slightly (approximately one casing I.D. width) above the point of casing exit "W." Second, there is a touch point along a whipstock curved face 1050.1 of the whipstock member 1000 itself. Finally, there is a touch point against the I.D. of the casing 12 at the point of casing exit "W," at least until the window "W" is formed. Note these same three touch points may be provided by the arcuate path of the jetting hose tunnel 3050 within the modified whipstock 3000, discussed later herein.

Note that this hydraulic horsepower may be utilized in boring operations via five distinct modes:

(1) jetting with purely high pressure fluid, such that the boring mechanism is purely erosional;

(2) adding to erosion the destruction (boring) mechanism of cavitation, as with high pressure fluid discharged from a vortex nozzle, or jetting with a supercritical gas;

(3) adding an abrasive to the fluid jetting streams of (1) and (2); and lastly, (4) boring through the rock target mechanically, via the interface of blades, teeth, or "buttons", protruding from the nozzle face such that the destructive force of the fluid jets are augmented by mechanical forces expended directly on the rock.

In any of these cases, an indexing mechanism in the tool string allows the whipstock 1050 to be oriented in discreet increments radially about the longitudinal axis of the wellbore. Once the slips are set, the indexing mechanism utilizes a hydraulically actuated ratchet-like action that can rotate an upstream portion of the whipstock 1000 in discreet, say 5° or 10° increments. The indexing mechanism is hydraulically actuated, meaning that it relies upon pressure pulses to rotate about the wellbore. Optionally, a modified whipstock 3000 may be rotated electromechanically rotated into the desired position. A gyroscopic/geospatial device may be incorporated in the whipstocks 1050 or 3000, or otherwise along the tool string 50 to provide a real-time measurement of whipstock orientation. The indexing section is described in detail in U.S. Pat. No. 9,856,700, which is incorporated herein by reference in its entirety. In this way, the whipstock face 1050.1 is set to direct the jetting nozzle 1600 in a desired orientation, such as away from a neighboring parent wellbore.

In an alternate embodiment, the hydraulically operated indexing mechanism is replaced by an electrically powered motor that rotates the whipstock. Such an assembly can include orientation sensors (such as gyroscopic sensors, magnetometers, accelerometers, or some combination thereof) that provide a direct, real-time measurement of the whipstock face 1050.1 orientation. Particularly since the advent of horizontal drilling, this sensor technology has become quite robust and commonplace. Such a directional sensor package, particularly developed to be extremely compact (1.04" O.D.×12.3" long) and rated for high temperatures (175° C./347° F.) is provided in Applied Physics Systems' Model 850HT High Temperature, Small Diameter Directional Sensor package.

As depicted in FIG. 3B (and in FIG. 4E), the whipstock 1000 is in its set and operating position within the casing 12. (U.S. Pat. No. 8,991,522, which is incorporated herein by reference, also demonstrates the whipstock member 1050 in its run-in position.) The actual whipstock 1050 within the whipstock member 1000 is supported by a lower whipstock rod 1060. When the whipstock member 1000 is in its set-and-operating position, the upper curved face 1050.1 of the whipstock member 1050 itself spans substantially the entire I.D. of the casing 12. If, for example, the casing I.D. were to vary slightly larger, this would obviously not be the case. The three aforementioned "touch points" of the jetting hose 1595 would remain the same, however, albeit while forming a slightly larger bend radius "R" precisely equal to the (new) enlarged I.D. of casing 12.

Figure 4B:
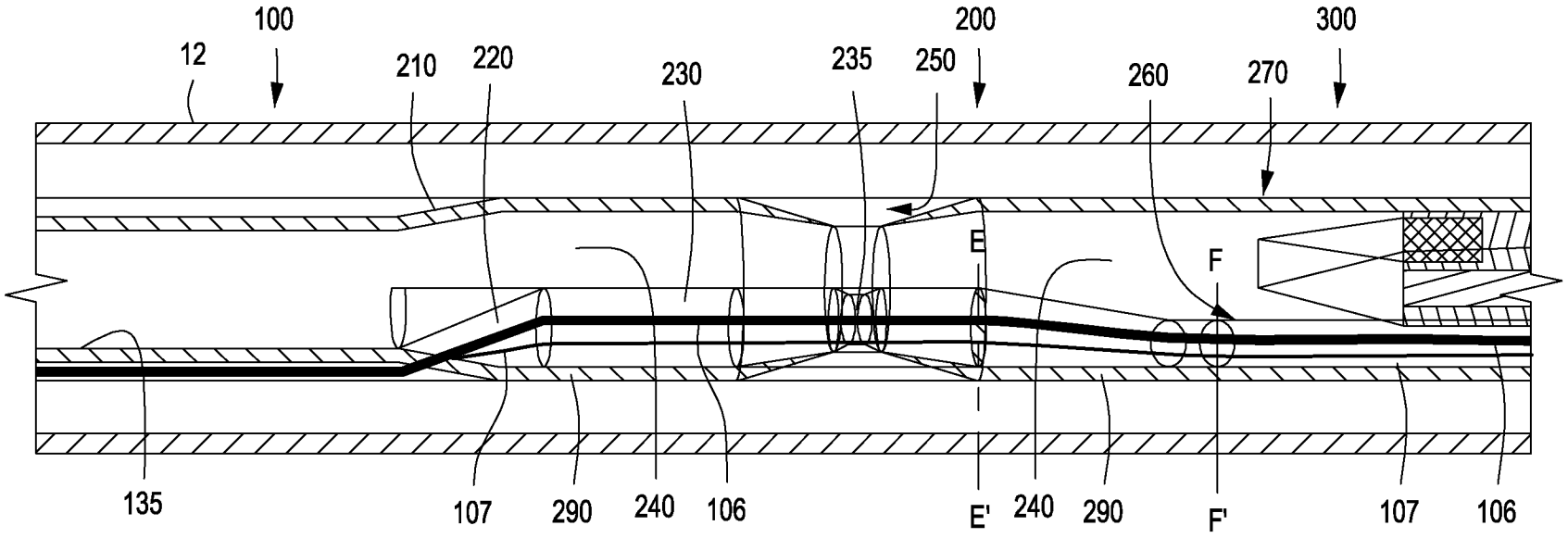
FIG. 4B is a longitudinal, cross-sectional view of a crossover connection, which is the upper-most member of the external system of FIG. 4. The crossover section is configured to join the coiled tubing conveyance medium of FIG. 4A to a main control valve.
Figures 1A, 4B:
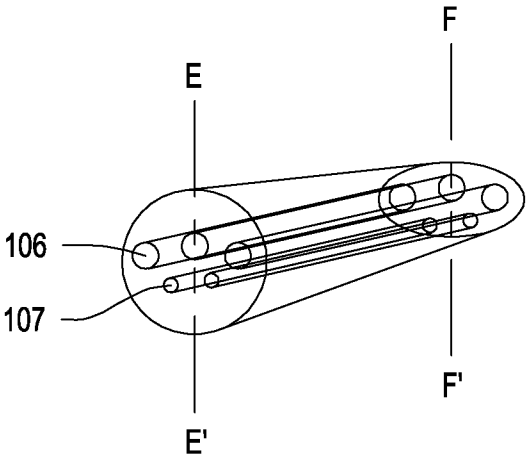
Figure 4D:
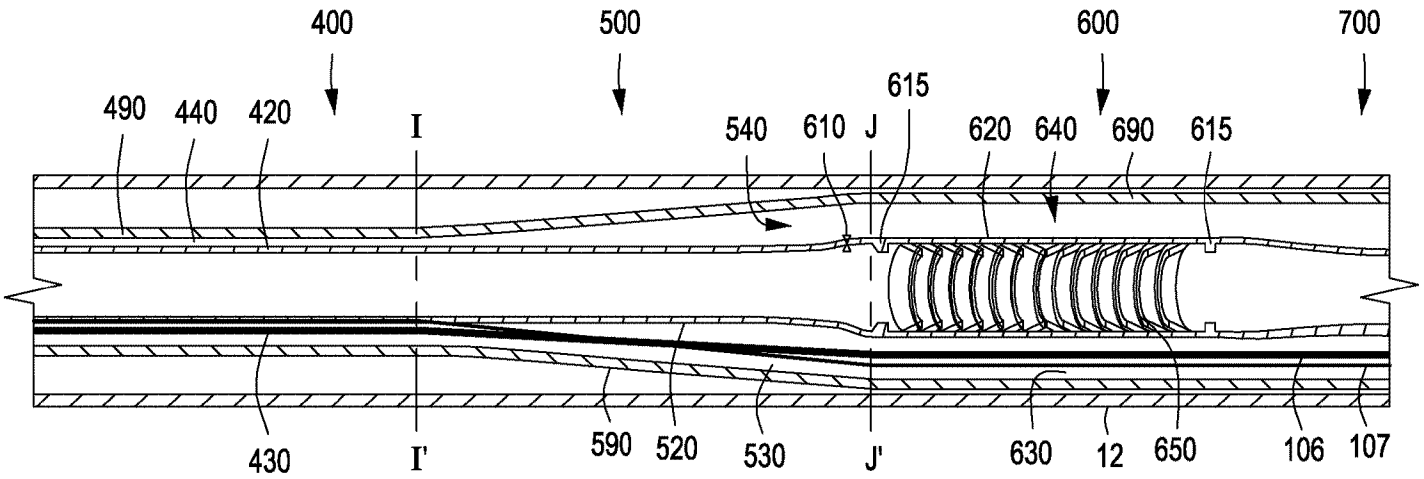
FIG. 4D is a longitudinal, cross-sectional view of selected portions of the external system of FIG. 4. Visible are a jetting hose pack-off section, and an outer body transition from the preceding circular body (I-I') of the jetting hose carrier section to a star-shaped body (J-J') of the jetting hose pack-off section
Figures 2, 4D:
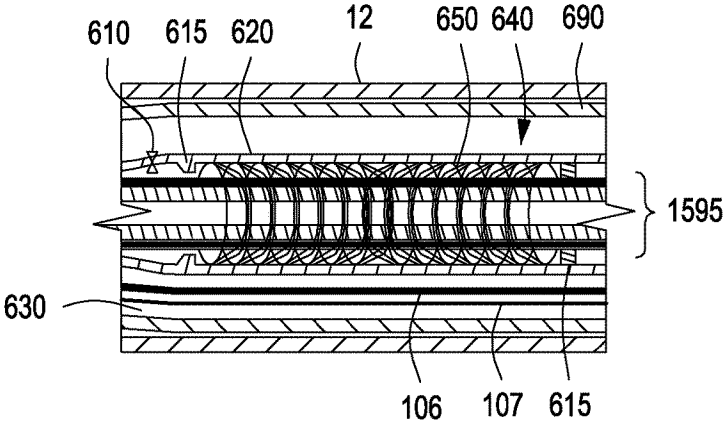
Figures 1A, 4D:
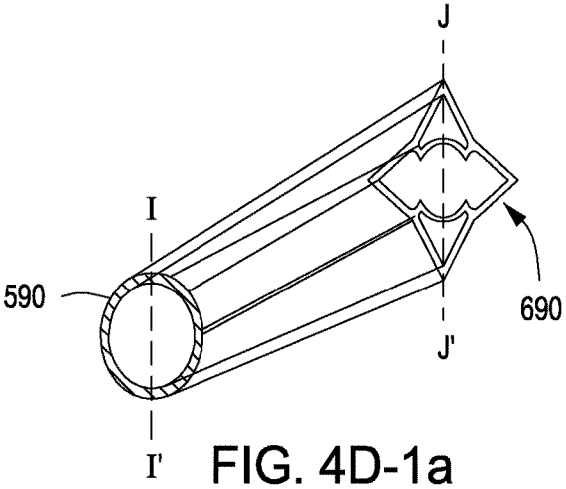
Figure 4E:
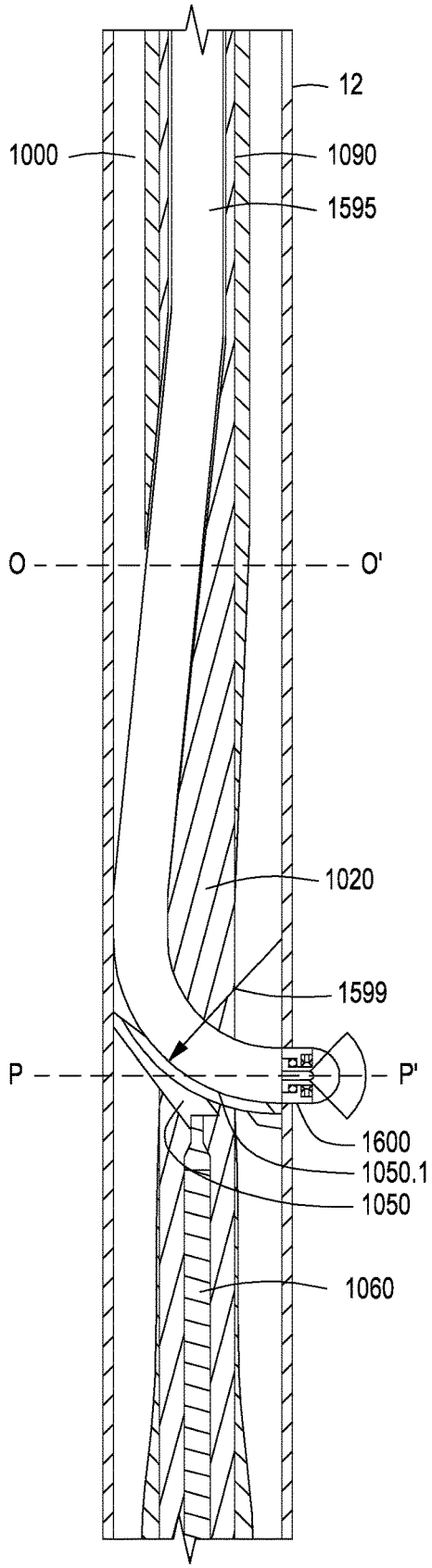
FIG. 4E is a cross-sectional view of a whipstock member of the external system of FIG. 4, but shown vertically instead of horizontally. The jetting hose of the internal system is shown bending across the whipstock, and extending through a window in the production casing. The jetting nozzle of the internal system is shown affixed to the distal end of the jetting hose.
Figures 1A, 4E:
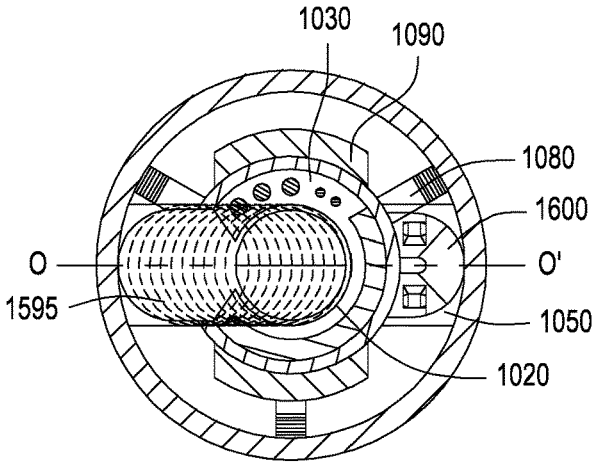
Figures 1B, 4E:
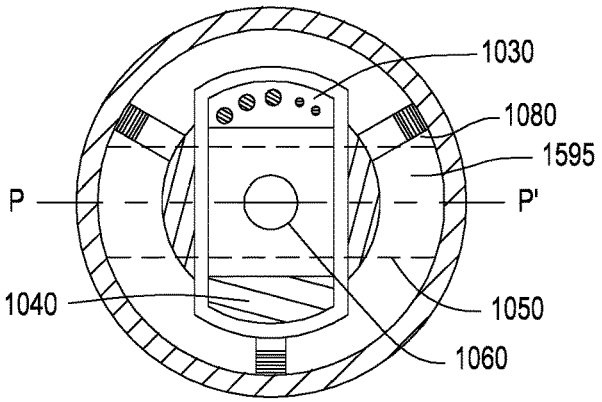

FIG. 4E is a cross-sectional view of the whipstock member 1000 of the external system of FIG. 4, but shown vertically instead of horizontally. The jetting hose 1595 of the internal system (FIG. 3) is shown bending across the whipstock face 1050.1, and extending through a window "W" in the production casing 12. The jetting nozzle 1600 of the internal system 1500 is shown affixed to the distal end of the jetting hose 1595.

FIG. 4E-1*a* is an axial, cross-sectional view of the whipstock member 1000. with a perspective view of sequential axial jetting hose cross-sections depicting its path downstream from the center of the whipstock member 1000. This view is taken across line O-O' of FIG. 4E, and presents sequential views of the jetting hose 1595 from the start of the bend radius as it approaches line P-P'.

FIG. 4E-1*b* depicts an axial, cross-sectional view of the whipstock member 1000 taken across line P-P' of FIG. 4E. Note the adjustments in location and configuration of both the whipstock member's wiring chamber and hydraulic fluid chamber from line O-O' to line P-P'.

In an alternative embodiment (discussed further below in connection with FIG. 4MW), the jetting hose assembly's whipstock 3000 is configured to be mateably received by a casing collar 4000 located downhole. The casing collar 4000 is not run in with the coiled tubing string 100 and is not part of the assembly 50; instead, the casing collar is run into the well 4*c* with the production casing during completion. In this instance, the whipstock 1050 is a single body having an integral curved face, and an outer diameter having a pair of opposing shift dogs that releasably latch into internal recesses of the casing collar.

As provided in full detail in the '351 patent, the internal system 1500 enables a powerful hydraulic nozzle 1600 to jet away subsurface rock in a controlled (or steerable) manner, thereby forming a mini-lateral borehole that may extend many feet out into a formation. The unique combination of the internal system's jetting fluid receiving funnel 1570, the upper seal 1580U, the jetting hose 1595, in connection with the external system's 2000 pressure regulator valve 610 and pack-off section 600 (discussed below) provide for a system by which advancement and retraction of the jetting hose 1595, regardless of the orientation of the wellbore 4, can be accomplished entirely by hydraulic means. Alternatively, mechanical means may be added through use of an internal tractor system 700.

Specifically, "pumping the hose 1595 down-the-hole" has the following sequence:

(1) the micro-annulus 1595.420 between the jetting hose 1595 and the jetting hose carrier's inner conduit 420 is filled by pumping hydraulic fluid through the main control valve 310, and then through the pressure regulator valve 610; then (2) the main control valve 310 is switched electronically using surface controls to begin directing jetting fluid to the internal system 1500; which (3) initiates a hydraulic force against the internal system 1500 directing jetting fluid through the intake funnel 1570, into the jetting hose 1595, and "down-the-hole"; such force being resisted by (4) compressing hydraulic fluid in the micro-annulus 1595.420; which is (5) bled-off, as desired, from surface control of the pressure regulator valve 610, thereby regulating the rate of "down-the-hole" decent of the internal system 1500.

Similarly, the internal system 1500 can be pumped back "up-the-hole" by directing the pumping of hydraulic fluid through the main control valve 310 and then through the pressure regulator valve 610, thereby forcing an ever-increasing volume of hydraulic fluid into the micro-annulus 1595.420 between the jetting hose 1595 and the jetting hose conduit 420. The hydraulic pressure pushes upwardly against the bottom seals 1580L of the jetting hose seal assembly 1580, thereby driving the internal system 1500 back "up-the-hole". Thus, hydraulic forces are available to assist in both conveyance and retrieval of the jetting hose 1595.

The FIG. 3 series of drawings, and the preceding paragraphs discussing those drawings, are directed to the internal system 1500 for the hydraulic jetting assembly 50. The internal system 1500 provides a novel system for conveying the jetting hose 1595 into and out of a child wellbore 4 for the subsequent steerable generation of multiple mini-lateral boreholes 15 in a single trip. The jetting hose 1595 may be as short as 10 feet or as long as 300 feet or even 500 feet, depending on the thickness and compressive strength of the formation or the desired geo-trajectory of each lateral borehole.

FIG. 4 is a longitudinal, cross-sectional view of the external system 2000 of the downhole hydraulic jetting assembly 50 of FIG. 2, in one embodiment. The external system 2000 is presented within the string of production casing 12. For clarification, FIG. 4 presents the external system 2000 as "empty"; that is, without containing the components of the internal system 1500 described above in connection with the FIG. 3 series of drawings. For example, the jetting hose 1595 is not shown. However, it is understood that the jetting hose 1595 is largely contained in the external system during run-in and pull-out.

In presenting the components of the external system 2000, it is assumed that the system 2000 is run into production casing 12 having a standard 4.50" O.D. and approximate 4.0" I.D. In one embodiment, the external system 2000 has a maximum outer diameter constraint of 2.655" and a preferred maximum outer diameter of 2.500". This O.D. constraint provides for an annular (i.e., between the system 2000 O.D. and the surrounding production casing 12 I.D.) area open to flow equal to or greater than 7.0309 $in^2$, which is the equivalent of a 9.2 #, 3.5" frac (tubing) string.

The external system 2000 is configured to allow the operator to optionally "frac" down the annulus between the coiled tubing conveyance medium 100 (with attached apparatus) and the surrounding production casing 12. Preserving a substantive annular region between the O.D. of the external system 2000 and the I.D. of the production casing 12 allows the operator to pump a fracturing (or other treatment) fluid down the subject annulus immediately after jetting the desired number of lateral bores and without having to trip the coiled tubing 100 with attached apparatus 2000 out of the child wellbore 4. Thus, multiple stimulation treatments may be performed with only one trip of the assembly 50 in to and out of the child wellbore 4. Of course, the operator may choose to trip out of the wellbore for each frac job, in which case the operator would utilize standard (mechanical) bridge plugs, frac plugs and/or sliding sleeves. However, this would impose a much greater time requirement (with commensurate expense), as well as much greater wear and fatigue of the coiled tubing-based conveyance medium 100.

FIG. 4A-1 is a longitudinal, cross-sectional view of a "bundled" coiled tubing string 100. The coiled tubing 100 serves as a conveyance system for the downhole hydraulic jetting assembly 50 of FIG. 2. The coiled tubing 100 is shown residing within the production casing 12 of a child wellbore 4, and extending through a heel 4*b* and into the horizontal leg 4*c*.

FIG. 4A-1*a* is an axial, cross-sectional view of the coiled tubing string 100 of FIG. 4A-1. It is seen that the illustrative coiled tubing 100 includes a core 105. In one aspect, the coiled tubing core 105 is comprised of a standard 2.000" O.D. (105.2) and 1.620" I.D. (105.1), 3.68 lbm/ft. HSt110 coiled tubing string, having a Minimum Yield Strength of 116,700 lbm and an Internal Minimum Yield Pressure of 19,000 psi. This standard sized coiled tubing provides for an inner cross-sectional area open to flow of 2.06 $in^2$. As shown, this "bundled" product 100 includes three electrical wire ports 106 of up to 0.20" in diameter, which can accommodate up to AWG #5 gauge wire, and 2 data cable ports 107 of up to 0.10" in diameter.

The coiled tubing string 100 also has an outermost, or "wrap," layer 110. In one aspect, the outer layer 110 has an outer diameter of 2.500", and an inner diameter bonded to and exactly equal to that of the O.D. 105.2 of the core coiled tubing string 105 of 2.000".

Both the axial and longitudinal cross-sections presented in FIGS. 4A-1 and 4A-1*a* presume bundling the product 100 concentrically, when in actuality, an eccentric bundling may be preferred. An eccentric bundling provides more wrap layer protection for the electrical wiring 106 and data cables 107. Such a depiction is included as FIG. 4A-2 for an eccentrically bundled coiled tubing conveyance medium 101. Fortunately, eccentric bundling would have no practical ramifications on sizing pack-off rubbers or wellhead injector components for lubrication into and out of the child wellbore, since the O.D. 105.2 and circularity of the outer wrap layer 110 of an eccentric conveyance medium 101 remain unaffected.

Moving further down the external system 2000, FIG. 4B presents a longitudinal, cross-sectional view of a crossover connection, which is the coiled tubing crossover connection 200. FIG. 4B-1*a* shows a portion of the coiled tubing crossover connection 200 in perspective view. Specifically, the transition between lines E-E' and line F-F' of FIG. 4B is shown. In this arrangement, an outer profile transitions from circular to oval to bypass the main control valve 300.

The main functions of this crossover connection 200 are as follows:

(1) To connect the coiled tubing 100 to the jetting assembly 50 and, specifically, to the main control valve 300. In FIG. 4B, this connection is depicted by the steel coiled tubing core 105 connected to the main control valve's outer wall 290 at connection point 210.

(2) To transition electrical cables 106 and data cables 107 from the outside of the core 105 of the coiled tubing 100 to the inside of the main control valve 300. This is accomplished with a wiring port 220 facilitating the transition of wires/cables 106/107 inside outer wall 290.

(3) To provide an ease-of-access point, such as the threaded and coupled collars 235 and 250, for the splicing/connection of electrical cables 106 and data cables 107. and (4) To provide separate, non-intersecting and non-interfering pathways for electrical cables 106 and data cables 107 through a pressure- and fluid-protected conduit, that is, a wiring chamber 230.

The next component in the external system 2000 is the main control valve 300. FIG. 4C provides a longitudinal, cross-sectional view of the main control valve 300. FIG. 4C-1*a* provides an axial, cross-sectional view of the main control valve 300, taken across line G-G' of FIG. 4C. The main control valve 300 will be discussed in connection with both FIGS. 4C-1 and 4C-1*a* together.

The function of the main control valve 300 is to receive high pressure fluids pumped from within the coiled tubing 100, and to selectively direct them either to the internal system 1500 or to the external system 2000. The operator sends control signals to the main control valve 300 by means of the wires 106 and/or data cable ports 107.

The main control valve 300 includes two fluid passages. These comprise a hydraulic fluid passage 340 and a jetting fluid passage 345. Visible in FIGS. 4C, 4C-1*a* and 4C-1*b* (longitudinal cross-sectional, axial cross-sectional, and perspective view, respectively) is a sealing passage cover 320. The sealing passage cover 320 is fitted to form a fluid-tight seal against inlets of both the hydraulic fluid passage 340 and the jetting fluid passage 345. Of interest, FIG. 4C-1*b* presents a three dimensional depiction of the passage cover 320. This view illustrates how the cover 320 can be shaped to help minimize frictional and erosional effects.

The main control valve 300 also includes a cover pivot 350. The passage cover 320 rotates with rotation of the passage cover pivot 350. The cover pivot 350 is driven by a passage cover pivot motor 360. The sealing passage cover 320 is positioned by the passage cover pivot 350 (as driven by the passage cover pivot motor 360) to either: (1) seal the hydraulic fluid passage 340, thereby directing all of the fluid flow from the coiled tubing 100 into the jetting fluid passage 345, or (2) seal the jetting fluid passage 345, thereby directing all of the fluid flow from the coiled tubing 100 into the hydraulic fluid passage 340.

The main control valve 300 also includes a wiring conduit 310. The wiring conduit 310 carries the electrical wires 106 and data cables 107. The wiring conduit 310 is optionally elliptically shaped at the point of receipt (from the coiled tubing transition connection 200, and gradually transforms to a bent rectangular shape at the point of discharging the wires 106 and cables 107 into the jetting hose carrier system 400. Beneficially, this bent rectangular shape serves to cradle the jetting hose conduit 420 throughout the length of the jetting hose carrier system 400.

FIG. 4 also shows a jetting hose carrier system 400 as part of the external system 2000. The jetting hose carrier system 400 includes a jetting hose carrier 490. The jetting hose carrier 490 houses, protects, and stabilizes the internal system 1500 and, particularly, the jetting hose 1595. The micro-annulus 1595.420 referenced above resides between the jetting hose 1595 and the surrounding jetting hose carrier 490.

The length of the jetting hose carrier 490 is quite long, and should be approximately equivalent to the desired length of jetting hose 1595, and thereby defines the maximum reach of the jetting nozzle 1600 orthogonal to the wellbore 4, and the corresponding length of the mini-laterals 15. The inner diameter specification defines the size of the micro-annulus 1595.420 between the jetting hose 1595 and the surrounding jetting hose conduit 420. The I.D. should be close enough to the O.D. of the jetting hose 1595 so as to preclude the jetting hose 1595 from ever becoming buckled or kinked, yet it must be large enough to provide sufficient annular area for a robust set of seals 1580L by which hydraulic fluid can be pumped into the sealed micro-annulus 1595.420 to assist in controlling the rate of deployment of the jetting hose 1595, or assisting in hose retrieval.

The jetting hose carrier system 400 also includes an outer conduit 490. The outer conduit 490 resides along and circumscribes the jetting hose conduit 420. In one aspect, the outer conduit 490 and the jetting hose conduit 420 are simply concentric strings of 2.500" O.D. and 1.500" O.D. HSt100 coiled tubing, respectively. The jetting hose conduit 420 is sealed to and contiguous with the jetting fluid passage 345 of the main control valve 300. When high pressure jetting fluid is directed by the valve 300 into the jetting fluid passage 345, the fluid flows directly and only into the jetting hose conduit 420 and then into the jetting hose 1595.

A separate annular area exists between the inner (jetting hose) conduit 420 and the surrounding outer conduit 490. The annular area is also fluid tight, directly sealed to and contiguous with the hydraulic fluid passage 340 of the control valve 300. When high pressure hydraulic fluid is directed by the main control valve 300 into the hydraulic fluid passage 340, the fluid flows directly into the conduit-carrier annulus.

The external system 2000 next includes the second crossover connection 500, transitioning to the jetting hose pack-off section 600. The main function of the jetting hose pack-off section 600 is to "pack-off", or seal, the annular space between the jetting hose 1595 and the surrounding inner conduit 620. The jetting hose pack-off section 600 is a stationary component of the external system 2000. Through transition 500, and partially through pack-off section 600, there is a direct extension of the micro-annulus 1595.420. This extension terminates at the pressure/fluid seal of the jetting hose 1595 against the inner faces of seal cups making up a pack-off seal assembly.

Immediately prior to this terminus point is the location of a pressure regulator valve. The pressure regulator valve serves to either communicate or segregate the annulus 1595.420 from the hydraulic fluid running throughout the external system 2000. The hydraulic fluid takes its feed from the inner diameter of the coiled tubing conveyance medium 100 (specifically, from the I.D. 105.1 of coiled tubing core 105) and proceeds through the continuum of hydraulic fluid passages 240, 340, 440, 540, 640, 740, 840, 1040, and 1140, then through the transitional connection 1200 to the coiled tubing mud motor 1300, and eventually terminating at the tractor 1350 (or, terminating at the operation of some other conventional downhole application, such as a hydraulically set retrievable bridge plug.)

Additional details concerning the jetting hose conduit 420, the outer conduit 490, the crossover section 500, the regulator valve and the pack-off section 600 are taught in U.S. Pat. No. 9,976,351 referenced several times above.

Returning to FIG. 4, and as noted above, the external system 2000 also includes a whipstock 1000. The jetting hose whipstock 1000 is a fully reorienting, resettable, and retrievable whipstock means similar to those described in the precedent works of U.S. Provisional Patent Application No. 61/308,060 filed Feb. 25, 2010, U.S. Pat. No. 8,752,651 issued Jun. 17, 2014, and U.S. Pat. No. 8,991,522 issued Mar. 31, 2015. Those applications are again referred to and incorporated herein for their discussions of setting, actuating and indexing the whipstock. Accordingly, detailed discussion of the jetting hose whipstock 1000 will not be repeated herein.

FIG. 4E provides a longitudinal cross-sectional view of a portion of the wellbore 4 from FIG. 2. Specifically, the jetting hose whipstock 1000 is seen. The jetting hose whipstock 1000 is in its set position, with the upper curved face 1050.1 of the whipstock 1050 receiving a jetting hose 1595. The jetting hose 1595 is bending across the hemispherically-shaped channel that defines the face 1050.1. The face 1050.1, combined with the inner wall of the production casing 12, forms the only possible pathway within which the jetting hose 1595 can be advanced through and later retracted from the casing exit "W" and lateral borehole 15.

A nozzle 1600 is also shown in FIG. 4E. The nozzle 1600 is disposed at the end of the jetting hose 1595. Jetting fluids are being dispersed through the nozzle 1600 to initiate formation of a mini-lateral borehole into the formation. The jetting hose 1595 extends down from the inner wall 1020 of the jetting hose whipstock member 1000 in order to deliver the nozzle 1600 to the whipstock member 1050.

As discussed in U.S. Pat. No. 8,991,522, the jetting hose whipstock 1000 is set utilizing hydraulically controlled manipulations. In one aspect, hydraulic pulse technology is used for hydraulic control. Release of the slips is achieved by pulling tension on the tool. These manipulations were designed into the whipstock member 1000 to accommodate the general limitations of the conveyance medium (conventional coiled tubing) 100, which can only convey forces hydraulically (e.g., by manipulating surface and hence, downhole hydraulic pressure) and mechanically (i.e., tensile force by pulling on the coiled tubing, or compressive force by utilizing the coiled tubing's own set-down weight).

The whipstock 1000 is herein designed to accommodate the delivery of wires 106 and data cables 107 further downhole. To this end, a wiring chamber 1030 (conducting electrical wires 106 and data cables 107) is provided. Power and data are provided from the external system 2000 to conventional logging equipment 1400, such as a Gamma Ray—Casing Collar Locator logging tool, in conjunction with a gyroscopic tool. This would be attached immediately below a conventional mud motor 1300 and coiled tubing tractor 1350. Hence, for this embodiment, hydraulic conductance through the whipstock 1000 is desirable to operate a conventional ("external") hydraulic-over-electric coiled tubing tractor 1350 immediately below, and electrical (and preferably, fiber optic) conductance to operate the logging sonde 1400 below the coiled tubing tractor 1350. The wiring chamber 1030 is shown in the cross-sectional views of FIGS. 4E-1*a* and 4E-1*b*, along lines O-O' and P-P', respectively, of FIG. 4E.

A hydraulic fluid chamber 1040 is also provided along the jetting hose whipstock 1000. The wiring chamber 1030 and the fluid chamber 1040 become bifurcated while transitioning from semi-circular profiles (approximately matching their respective counterparts of the upper swivel 900) to a profile whereby each chamber occupies separate end sections of a rounded rectangle (straddling the whipstock member 1050). Once sufficiently downstream of the whipstock member 1050, the chambers can be recombined into their original circular pattern, in preparation to mirror their respective dimensions and alignments in a lower swivel 1100. This enables the transport of power, data, and high pressure hydraulic fluid through the whipstock member 1000 (via their respective wiring chamber 1030 and hydraulic fluid chamber 1040) down to the mud motor 1300.

FIGS. 2 and 4 also show an upper swivel 900 and a lower swivel 1100. The swivels 900, 1100 are mirror images of one another. Below the whipstock member 1000 and the nozzle 1600 but above the tractor 1350 is an optional lower swivel 1100. The upper swivel 900 allows the whipstock 1000 to rotate, or index, relative to the stationary external system 2000. Similarly, the lower swivel 1100 allows the whipstock 1000 to rotate relative to any downhole tools, such as a mud motor 1300 or a coiled tubing tractor 1350.

Logging tools 1400, a packer, or a bridge plug (preferably retrievable, not shown) may also be provided. Note that, depending on the length of the horizontal portion 4*c* of the wellbore 4, the respective sizes of the conveyance medium 100 and production casing 12, and hence the frictional forces to be encountered, more than one mud motor 1300 and/or CT tractor 1350 may be needed. The packer or retrievable bridge plug are set before any fracturing fluids are injected.

Typically, the packer or bridge plug is set between two distinct frac stages. In the sequential completion (or recompletion) of a horizontal wellbore, the packer or bridge plug is set above the perforations (or casing exits or casing collars) corresponding to the frac stage that has just been pumped, and below the perforations (or casing exits or casing collars) correlative to the next frac stage to be pumped. Note that it may be advantageous to run a bottom hole pressure measurement device (called a pressure "bomb") below the packer or bridge plug and obtain real-time data from same. Alternatively, it may be further advantageous to run dual bombs, one below and one above the packer. This pressure data is helpful in determining both: (1) the integrity of the pressure seal being provided by the packer or bridge plug; and (2) whether or not there may be behind pipe (i.e., behind the production casing) pressure communication between frac stages.

In cases where previous frac stages' multi-lateral boreholes were created through ports in a ported casing collar, and those ports have subsequently been closed off after receipt of frac stimulation, then a packer or bridge plug need not be set in order to provide zonal isolation for the next frac through those casing exit- or port-initiated UDP's about to be fracked in the next stage. Notwithstanding, the packer or bridge plug could be set as a safeguard to insure zonal isolation, that is, as insurance to the leaking of a closed sleeve port that had failed. In this instance, if a pressure bomb were to indicate communication of treating pressures from below, and these same pressure readings had been monitored sequentially (without incident) while working up the hole, then that is a positive indication of communication from only the previous stage.

It is anticipated that, in preparation for a subsequent hydraulic fracturing treatment in a horizontal child wellbore 4*c*, an initial borehole 15 will be jetted substantially perpendicular to and at or near the same horizontal plane as the child wellbore 4*c*, and a second lateral borehole will be jetted at an azimuth of 180° rotation from the first (again, perpendicular to and at or near the same horizontal plane as the child wellbore). In thicker formations, however, and particularly given the ability to steer the jetting nozzle 1600 in a desired direction, more complex lateral bores may be desired. Similarly, multiple lateral boreholes (from multiple setting points typically close together) may be desired within a given "perforation cluster" that is designed to receive a single hydraulic fracturing treatment stage. The complexity of design for each of the lateral boreholes will typically be a reflection of the hydraulic fracturing characteristics of the host reservoir rock for the pay zone 3. For example, an operator may design individually contoured lateral boreholes within a given "cluster" to help retain a hydraulic fracture treatment predominantly "in zone." This "borehole cluster" would then be analogous to "perf clusters" commonly used in horizontal well completions today.

It can be seen that an improved downhole hydraulic jetting assembly 50 is provided herein. The assembly 50 includes an internal system 1500 comprised of a guidable jetting hose and jetting nozzle that can jet both a casing exit and a subsequent lateral borehole in a single step. The assembly 50 further includes an external system 2000 containing, among other components, a carrier apparatus that can house, transport, deploy, and retract the internal system to repeatably construct the requisite lateral boreholes during a single trip into and out of a child wellbore 4, and regardless of its inclination. The external system 2000 provides for annular frac treatments (that is, pumping fracturing fluids or acids down the annulus between the coiled tubing deployment string and the production casing 12) to treat newly jetted lateral boreholes. When combined with stage isolation provided by a packer and/or spotting temporary or retrievable plugs, thus providing for repetitive sequences of plug-and-UDP-and-frac, completion of the entire horizontal section 4*c* can be accomplished in a single trip.

In one aspect, the assembly 50 is able to utilize the full I.D. of the production casing 12 in forming the bend radius 1599 of the jetting hose 1595, thereby allowing the operator to use a jetting hose 1595 having a maximum diameter. This, in turn, allows the operator to pump jetting fluid at higher pump rates, thereby generating higher hydraulic horsepower at the jetting nozzle 1600 at a given pump pressure. This will provide for substantially more power output at the jetting nozzle, which will enable:

(1) optionally, jetting larger diameter lateral boreholes within the target formation;
(2) optionally, achieving longer lateral lengths;
(3) optionally, achieving greater erosional penetration rates; and
(4) achieving erosional penetration of higher strength and threshold pressure (am and $P_{Th}$) oil/gas formations heretofore considered impenetrable by existing hydraulic jetting technology.

Also of significance, the internal system 1500 allows the jetting hose 1595 and connected jetting nozzle 1600 to be propelled independently of a mechanical downhole conveyance medium. The jetting hose 1595 is not attached to a rigid working string that "pushes" the hose and connected nozzle 1600, but instead uses a hydraulic system that allows the hose and nozzle to travel longitudinally (in both upstream and downstream directions) within the external system 2000. It is this transformation that enables the subject system 1500 to overcome the "can't-push-a-rope" limitation inherent to all other hydraulic jetting systems to date. Further, because the subject system does not rely on gravitational force for either propulsion or alignment of the jetting hose/nozzle, system deployment and hydraulic jetting can occur at any angle and at any point within the host child wellbore 4 to which the assembly 50 can be "tractored" in.

The downhole hydraulic jetting assembly allows for the formation of multiple mini-laterals, or bore holes, of an extended length and controlled direction, from a single child wellbore. Each mini-lateral may extend from 10 to 500 feet, or greater, from the child wellbore. As applied to horizontal wellbore completions in preparation for subsequent hydraulic fracturing ("frac") treatments in certain geologic formations, these small lateral wellbores may yield significant benefits to optimization and enhancement of fracture (or fracture network) geometry, SRV creation, and subsequent hydrocarbon production rates and reserves recovery. By enabling: (1) better extension of the propped fracture length; (2) better confinement of the fracture height within the pay zone; (3) better placement of proppant within the pay zone; and (4) further extension of a fracture network prior to cross-stage breakthrough, the lateral boreholes may yield significant reductions of the requisite fracturing fluids, fluid additives, proppants, fracture breakdown and fracture propagation pressures, hydraulic horsepower, and hence related fracturing costs previously required to obtain a desired fracture geometry, if it was even attainable at all. Further, for a fixed input of fracturing fluids, additives, proppants, and horsepower, preparation of the pay zone with lateral boreholes prior to fracturing could yield significantly greater Stimulated Reservoir Volume, to the degree that well spacing within a given field may be increased. Stated another way, fewer wells may be needed in a given field to attain a certain production rate, production decline profile, and reserves recovery, providing a significance of cost savings. Further, in conventional reservoirs, the drainage enhancement obtained from the lateral boreholes themselves may be sufficient as to preclude the need for subsequent hydraulic fracturing altogether.

As an additional benefit, the downhole hydraulic jetting assembly 50 and the methods herein permit the operator to apply radial hydraulic jetting technology without "killing" the parent wellbore. In addition, the operator may jet radial lateral boreholes from a horizontal child wellbore as part of a new well completion. Still further, the jetting hose may take advantage of the entire I.D. of the production casing. Further yet, the reservoir engineer or field operator may analyze geo-mechanical properties of a subject reservoir, and then design a fracture network emanating from a customized configuration of directionally-drilled lateral boreholes. Further still, the operator may control a direction of the lateral boreholes to avoid a frac hit with a neighboring offset wellbore.

In yet another aspect, the method of the present invention allows the operator to capture stranded or "hemmed in" oil and/or gas reserves in the general direction of the first lateral borehole from the child wellbore. In some situations, these measures are beneficial to not only maximize child well performance, but also to protect correlative rights. That is, the method of the present invention mays serve not only for protection of a parent wellbore, but for procurement of otherwise stranded or "hemmed in" reserves.

The hydraulic jetting of lateral boreholes may be conducted to enhance fracture and acidization operations during completion. As noted, in a fracturing operation, fluid is injected into the formation at pressures sufficient to separate or part the rock matrix. In contrast, in an acidization treatment, an acid solution is pumped at bottom-hole pressures less than the pressure required to break down, or fracture, a given pay zone. (In an acid frac, however, pump pressure intentionally exceeds formation parting pressure.) Examples where the pre-stimulation jetting of lateral boreholes may be beneficial include:

(a) prior to hydraulic fracturing (or prior to acid fracturing) in order to help confine fracture (or fracture network) propagation within a pay zone and to develop fracture (network) lengths a significant distance from the child wellbore before any boundary beds are ruptured, or before any cross-stage fracturing can occur; and (b) using lateral boreholes to place stimulation from a matrix acid treatment far beyond the near-wellbore area before the acid can be "spent," and before pumping pressures approach the formation parting pressure.

The downhole hydraulic jetting assembly 50 and the methods herein permit the operator to conduct acid fracturing operations through a network of lateral boreholes formed through the use of a very long jetting hose and connected nozzle that is advanced through the rock matrix. In one aspect, the operator may determine a direction of a pressure sink in the reservoir, such as from an adjacent producer, and hence anticipate that adjacent producer is a "hit" target. The operator may then form one or more lateral boreholes in an orthogonal direction, and then conduct acid fracturing through that borehole. In this instance, assuming the greatest principal stress is in the vertical due to overburden, fractures will typically open in the vertical direction, and propagate along the top and bottom "weak points" of the lateral boreholes.

The operator may alternatively consider or determine a flux-rate of acid (or other formation-dissolving fluid) in the rock matrix. In this instance, the acid is not injected at a formation parting pressure, but allows dissolution to form in the direction(s) of the greatest concentrations of reactants within the rock matrix that first "spend" the acid. Note this procedure may be highly desirable for stimulating oil and/or gas pay zones that are "on water". That is, these formations have an oil/water or gas/water contacts in such close proximity below the desired azimuth(s) of the UDP's such that pumping the acid above formation parting pressures would risk "fracking into water". Note a common result of such a misstep is that the wellbore subsequently "cones" water. That is, because the pay zone has a higher relative permeability to water (typically because it is a "water wet" reservoir; that is, due to capillary pressure effects, the first fluid layer contacting the rock matrix is water), the well will produce significantly more water than oil and/or gas . . . often by such a magnitude of disproportion that continued production of the well is unprofitable. Hence, pumping acid into the UDP's (below formation parting pressures) and allowing for near-UDP dissolution may be the best stimulation alternative available. This could even be the case for horizontal, open hole completions, typically in highly competent carbonate reservoirs, such as the many prolific pay zones found in the Middle East. Note that only slight modifications to the jetting assembly 50 would be required to accommodate these open hole completions.

The downhole hydraulic jetting assembly 50 and the methods herein also permit the operator to pre-determine a path for the jetting of lateral boreholes. Such boreholes may be controlled in terms of length, direction or even shape. For example, a curved borehole or each "cluster" of curved boreholes may be intentionally formed to further increase SRV exposure of the formation 3 to the wellbore 4*c*.

The downhole hydraulic jetting assembly 50 and the methods herein also permit the operator to re-enter an existing wellbore that has been completed in an unconventional formation, and "re-frac" the wellbore by forming one or more lateral boreholes using hydraulic jetting technology. The hydraulic jetting process would use the hydraulic jetting assembly 50 of the present invention in any of its embodiments. There will be no need for a workover rig, a ball dropper/ball catcher, drillable seats or sliding sleeve assemblies. For such a recompletion in a single trip, even in a horizontal wellbore 4*c*, annular frac's (or re-frac's) could still be performed (while the jetting assembly 50 remains in the wellbore) by first pumping a pump-able diverting agent (such as Halliburton's "BioVert®" NWB Biodegradable Diverting Agent) to temporarily plug off existing perforations and fractures, then jetting the desired UDP(s) comprising a target "borehole cluster", followed by pumping the frac stage targeting stimulation along the jetted UDP's. Note given the packer within the jetting assembly 50, divertant would need only be applied the perf's/frac's located uphole of the target borehole cluster.

Finally, and as discussed in much greater detail below, the downhole hydraulic jetting assembly 50 permits the operator to select a distance of lateral boreholes generated from the horizontal leg, or to select an orientation or trajectory of the lateral boreholes relative to the horizontal leg, or to sidetrack off of an existing lateral borehole, or even to change a trajectory during lateral borehole formation. All of this is useful for avoiding a frac hit in an offset well, or seeking out what would otherwise be stranded reserves.

As noted above, the present disclosure includes an alternate embodiment for an indexing whipstock, that is, an alternative to the whipstock 1000 of FIG. 4E. As an alternative, customized ported casing collars 4000 may be strategically placed between joints of production casing 12 during completion of the child wellbore 4. The collars are configured to mateably receive the alternate whipstock. Once received, a force is exerted upon the whipstock that opens a portal in the casing collar, such that the alignment of the portal is in direct alignment with the curved face of the whipstock, thereby continuing the defined path for the jetting hose 1600 and precluding the need to erosionally bore an exit through the casing.

The portals are selectively opened and closed using the mating whipstock 3000. The whipstock 3000 utilizes alignment blocks 3400 and shift dogs 3201 to engage and manipulate an inner sleeve 4200 of the casing collar 4000. Once the portals are opened, the hydraulic jetting assembly 50 can be deployed to create the Ultra Deep Perforations (UDP's) (or lateral boreholes) 15 in the reservoir rock 3.

The specially-designed collars 4000 have tensile and compressive strengths and burst and collapse resistances that are at or near those of the production casing and, if desired, can be cemented into place simultaneously with cementing the production casing. Similarly, the collars 4000 can conduct stimulation fluids at pressure tolerances at or near that of the production casing. Preferably, the collars have I.D.'s approximately the same as the production casing; i.e., they are "full opening".

FIG. 4MW presents a cross-sectional view of the whipstock 3000, which may be used in lieu of the whipstock 1000 of FIG. 4E. The whipstock 3000 defines an elongated tubular body 3100 that is part of the external system 2000. The whipstock 3000 has an upper end and a lower end. The upper end is connected to the upper swivel 900, and can be releasably fixed within an inner sleeve 4200 of a ported casing collar 4000 (discussed below).

FIG. 4MW depicts how the whipstock 3000, after being mateably received by the casing collar 4000, has manipulated the inner sleeve 4200 such that its portal 4210.S is in alignment with the outer sleeve's portal 4110.W.

FIG. 4MW.1 demonstrates the exit portal 3200 in greater detail. FIG. 4MW.1 is an exploded view of the whipstock 3000 wherein a jetting hose exit portal 3200 is aligned with portals 4210.S and 4110.W of the casing collar. Portal 4210.S resides along the inner sleeve 4200 while portal 4110.W resides along an outer sleeve 4100. In this view, the inner sleeve 4200 has been rotated so that portal 4210.S is aligned with portal 4110.W, thereby providing a casing exit "W."

The inner diameter of the whipstock 3000 represents a bending tunnel 3050. The bending tunnel 3050 has a face 3001 that serves the same function as the whipstock face 1050.1 depicted in FIG. 4E. In this respect, the bending tunnel 3050 provides the "three touch points" for the jetting hose 1595 and jetting nozzle 1600 as it traverses across the whipstock face 1050.1 Of interest, the first touch point is provided at a heel 3100 of the hose bending tunnel 3050.

The hose bending tunnel 3050 is configured to receive the jetting hose 1600 at the upstream end. The hose bending tunnel 3050 terminates at an exit portal 3200, which is above the downstream end of the whipstock 3000. The hose bending tunnel 3050 closely receives the jetting hose 1600 as it is extruded from the jetting hose carrier, and delivers it to the exit portal 3200.

Of interest, it can be seen in FIG. 4MW.1 how the customized contours of portals 4210.S and 4110.W continue the trajectory of the whipstock's bending tunnel 3050 from its terminus at the jetting hose exit portal 3200. In so doing, the bend radius now available to the jetting hose 1595 has increased from "R" to "R'", as depicted.

The whipstock 3000 provides all other features of the whipstock assembly 1000 discussed above, including conducting hydraulic fluid through chamber 1040, conducting electrical and or fiber optic cable through chamber 1030, hydraulic operation and indexing, and other features. A presentation of these features has not been repeated in FIGS. 4MW, 4MW.1, 4MW.2 and 4MW.2.SD to avoid redundancy.

During operation, the whipstock 3000 is run into the wellbore 4 as part of the downhole assembly 50. The ported casing collars 4000 are strategically located between joints of production casing 12 during the completion of the child wellbore 4. As noted, the collars 4000 are configured to mateably receive the whipstock 3000. Once the whipstock 3000 reaches the depth of a selected casing collar 4000, the whipstock 3000 will latch into slots provided along the inner diameter of the inner sleeve 4200.

Once received, a force is exerted upon the whipstock 3000 that shifts the inner sleeve 4200 such that an inner sleeve portal is indirect alignment with a like portal in the outer sleeve 4100. When in the opened position, both of these co-aligned portals are also in direct alignment with the curved face 3001 of the whipstock 3000, thereby continuing the defined path for the jetting hose 1595 and precluding the need to erosionally bore an exit through the casing. Note that as shown in FIG. 4MW.1 the inner faces of these portals themselves can be curved such that they continue the radius of curvature defined by the whipstock face 3001.

FIG. 4MW.2 is an enlarged, cross-sectional view of the whipstock 3000 of FIG. 4MW.1. Here, the whipstock 3000 is rotated 90° about a longitudinal axis; hence, the hose bending tunnel 3050 and the exit portal 3200 are not visible. Of interest, opposing "shift dogs" 3201 are shown. The shift dogs 3201 reside on opposing outer surfaces of the whipstock 3000, and extend out from the outer diameter of the whipstock 3000.

FIG. 4MW.2.SD is an exploded, cross-sectional view of FIG. 4MW.2. One of the spring-loaded shift dogs 3201 is shown. The opposing shift dogs 3201 are designed to releasably mate with a "shift dog groove" 4202 located along the inner sleeve 4200 of the ported casing collar 4000. The shift dog grooves 4202 are shown in FIG. 4PCC.1 discussed below. Each shift dog 3201 includes a beveled tip 3210. In addition, each shift dog 3201 includes a spring 3250 that is held in compression. The springs 3250 bias the respective beveled tips 3210 outwardly.

The whipstock 3000 also includes a pair of alignment blocks 3400. FIG. 4MW.2.AB is an exploded, cross-sectional view of a portion of one of the spring-loaded alignment blocks 3400 of FIG. 4MW.2. The portion represents one section of the alignment block 3400. A spring 3450 resides within the alignment block 3400, biasing it outwardly. Each of the alignment blocks 3400 represents an area of enlarged outer diameter along the whipstock 3000.

The alignment blocks 3400 are dimensioned to be received by a contoured profile (referred to below as "beveled entries" 4211 along the inner sleeve 4200 of the ported casing collar 4000. FIG. 4PCC.1 is a cross-sectional view of the ported casing collar 4000. The ported casing collar 4000 is dimensioned to receive the whipstock 3000 and to be manipulated by the whipstock 3000 using the mating alignment blocks 3400, shift dogs 3201 and shift dog grooves 4202.

FIG. 4PCC.1.SDG is an exploded, longitudinal cross-sectional view of a shift dog groove 4202 that resides in the ported casing collar 4000 of FIG. 4PCC.1. The shift dog groove 4202 is formed within a body 4201 of the inner sleeve 4200. The shift dog groove 4202 is dimensioned to receive the shift dogs 201 of the whipstock 3000.

Returning to FIG. 4PCC.1, the casing collar 4000 includes two beveled entries 4211. The beveled entries 4211 are configured to receive or act upon the pair of alignment blocks 3400 of FIGS. 4MW.2 and 4MW.2.AB. Specifically, the beveled entries 4211 form shoulders that contact the alignment blocks 3400. The contour of these mirror-image beveled entries 4211 force the whipstock 3000 to rotate until the alignment blocks 3400 engage opposing inner sleeve alignment slots 4212. A continued downstream push on the e-coil conveyance medium 100 moves the alignment blocks 3400 further into the alignment slots 4212 in the inner sleeve 4200 until the spring-loaded shift dogs 3201 on the whipstock 3000 engage the shift dog grooves 4202 in the inner sleeve body 4201. Once the shift dogs 3201 are engaged into the respective shift dog grooves 4202, the whipstock 3000 can rotate the inner sleeve 4200 via the alignment blocks 3400 and shift the inner sleeve 4200 axially through the shift dogs 3201.

Once the whipstock 3000 is aligned within and locked into the inner sleeve 4200, the combined torsional and axial movements of the whipstock 3000 allows the whipstock 3000 to rotate and/or translate the inner sleeve 4200 to shift the inner sleeve 4200 into any of five positions. The five positions are depicted in a control slot pattern 4800 in FIG. 4PCC.1.CSP.

FIG. 4PCC.1.CSP is a schematic view showing a progression of the torsional and axial movements of the whipstock 3000. More specifically, FIG. 4PCC.1.CSP is a two-dimensional "roll-out" view of a control slot pattern for the inner sleeve 4200 of the ported casing collar 4000, showing each of five possible slot positions.

In FIG. 4PCC.1.CSP, a control slot 4800 is shown. The control slot 4800 is milled into the outer diameter of the inner sleeve 4200. In each of the five position, the inner sleeve 4200 is held in place and guided through the control slot 4800 by two opposing torque pins 4500. The torque pins 4500 are seen in each of FIGS. 4PCC.1 and 4PCC.1.CSP.

The torque pins 4500 protrude through the outer sleeve 4100 into the two mirror-image control slots 4800.

The control slots 4800 are designed to selectively align portals in the inner 4200 and outer 4100 sleeves. The inner sleeve 4200 has, for example, portals 4210.S, 4210.W, 4210Dd and 4210Du. The outer sleeve 4100 has, for example, portals 4110.W and 4110.E (indicating east and west). These portals are all illustrated in FIG. 4PCC.2.

In position "1," all portals of the inner sleeve 4200 and the outer sleeve 4100 are out of alignment, meaning that the ported casing collar 4000 is closed. Of interest, the casing collar 4000 is run into the wellbore 4 as an integral part of the casing string 12 in the closed position In position "2," portals 4210.S and 4110.E are in alignment, providing an "East Open" position.

In position "3," portals 4210.S and 4110.W are in alignment, providing a "West Open" position.

In position "4," portals 4110.W and 4210.Du are aligned as are portals 4110.E and 4210.Dd, meaning that the ported casing collar 4000 is fully open.

In position "5," portals of the inner sleeve 4200 and the outer sleeve 4100 are again out of alignment, meaning that the ported casing collar 4000 is once again closed.

It is noted that in all of these torque pin positions, the outer sleeve 4100 remains stationary in a pre-oriented position. Stated another way, the outer sleeve 4100 is in a fixed position throughout the manipulation and repositioning of the inner sleeve 4200. Placement of the outer sleeve 4100 in its fixed position is aided by an optional "weighted belly" 4900. The weighted belly 4900 forms an eccentric profile for the outer sleeve 4100 and urges the outer sleeve 4100 to rotate within the horizontal leg 4C to the bottom of the bore.

FIG. 4PCC.2 presents an operational series showing the relative positions of each of the outer sleeve's two stationary portals versus each of the inner sleeve's three portals as the inner sleeve 4200 is translated and rotated into each of its five possible positions.

In position "1," injection fluids flow through the ported casing collar 4000, but no fluids flow through portals of the inner sleeve 4200 and the outer sleeve 4100.

In position "2," portals 4210.S and 4110.E are in alignment, providing an "East Open" position.

In position "3," portals 4210.S and 4110.W are in alignment, providing a "West Open" position.

In position "4," portals 4110.W and 4210.Du are aligned as are portals 4110.E and 4210.Dd, meaning that the ported casing collar 4000 is fully open. Both easterly and westerly portals are open.

In position "5," portals of the inner sleeve 4200 and the outer sleeve 4100 are again out of alignment. Injection fluids flow through the ported casing collar 4000 but do not flow through any sleeve portals.

FIGS. 4PCC.3*d*.1 through 4PCC.3*d*.5 is a series of perspective views of the ported casing collar 4000 of FIG. 4PCC.1. These figures illustrate positions of the ported casing collar 4000 when placed along the production casing string 12. Each of the perspective views in the series illustrates one of the five possible positions for the inner sleeve portals relative to the outer sleeve portals.

First, FIG. 4PCC.3*d*.1 shows the ported casing collar 4000 in a position where the inner sleeve portals and the outer sleeve portals are out of alignment. This is the closed position of position "1."

FIG. 4PCC.3*d*.2 shows an alignment of portals 4210.S with portals 4110.E. Here, the "east" ports are open. This illustrates position "2."

FIG. 4PCC.3*d*.3 shows an alignment of portals 4210.S with portals 4110.W. Here "west" ports are open. This is illustrative of position "3."

FIG. 4PCC.3*d*.4 shows an alignment of all inner sleeve portals with all outer sleeve portals. Both the east and the west portals are open. This represents position "4."

FIG. 4PCC.3*d*.5 again shows the inner sleeve portals and the outer sleeve portals out of alignment. This is the closed position of position "5."

In each drawing of the FIG. 4PCC.3*d* series, a hydraulic locking swivel 5000 is shown. The casing collar 4000 is run into the wellbore 4 in combination with pairs of the hydraulic locking swivels 5000 and at least one, but preferably two, standard casing centralizers 6000. Since the outer sleeves 4100 must be able to rotate freely when the casing collar 4000 is placed next to a casing centralizer 6000, then the maximum O.D. of the casing collar 4000 must be measurably less than O.D. of a casing centralizer 6000 when in a loaded position in gauge hole; i.e., the bit diameter.

The hydraulic locking swivels 5000 allow the "weighted belly" to gravitationally rotate the outer sleeve 4100 into the proper orientation prior to cementing. Once the casing has been cemented or is in the desired location in the wellbore 4, internal pressure is applied to lock the hydraulic locking swivels 5000 in place. Once the swivels 5000 are locked, the ported casing collar 4000 can be manipulated as needed to access desired portals.

FIG. 4HLS is a longitudinal, cross-sectional view of the hydraulic locking swivel 5000 as shown in the FIG. 4PCC.3*d* series of drawings. The swivel 5000 first comprises a top sub 5100. The top sub 5100 represents a cylindrical body. An upper end of the top sub 5100 comprises threads configured to connect to a string of production casing (not shown).

The swivel 5000 also comprises a bottom sub 5500. The bottom sub 5500 also represents a cylindrical body. Together, the top sub 5100 and the bottom sub 5500 form an inner bore that is in fluid communication with the inner bore of the production casing 12 and the casing collars 4000. The inner bore of these components forms a primary flow path for production fluids.

A lower end of the bottom sub 5500 includes threads. These threads also connect in series to the production casing 12. An upper bearing 5210 is placed between an upper end of the bottom sub 5500 and a lower end of the top sub 5100. The upper bearing 5210 allows relative rotational movement between the top sub 5100 and the bottom sub 5500.

A body of the top sub 5100 threadedly connects to a bearing housing 5200. The bearing housing 5200 forms a portion of an outer diameter of the swivel 5000. Along with the top sub 5100, the bearing housing 5200 is stationary. The bearing housing 5200 includes a shoulder 5201 that resides below a corresponding shoulder 5501 of the bottom sub 5500. A lower bearing 5220 resides between these two shoulders. Along with the upper bearing 5210, the lower bearing 5220 facilitates rotational movement of the bottom sub 5500 within the wellbore 4*c*.

The swivel 5000 also includes a clutch 5300. The clutch 5300 also defines a tubular body, and resides circumferentially around the bottom sub 5500. Shear screws 5350 fix the clutch 5300 to the bottom sub 5500, preventing relative rotation of the bottom sub 5500 until the shear screws 5350 are sheared by an axial force.

Keys 5700 reside in annular slots between the bottom sub 5500 and the surrounding clutch 5300. The keys 5700 provide proper alignment of the bottom sub 5500 and the clutch 5300. In addition, o-rings 5400 reside within the annular region on opposing ends of the keys 5700. Further, snap rings 5600 are placed along an outer diameter of the bottom sub 5500. The snap rings 5600 are configured to slide into a mating groove to lock the clutch 5300 in place. This takes place when the clutch 5300 is engaged.

Finally, a clutch cover 5310 is placed on the swivel 5000. The clutch cover 5310 is threadedly connected to a bottom end of the bearing housing 5200. The clutch cover 5310 is also stationary, meaning that it will not rotate. A bottom end of the clutch cover 5310 extends down and covers an upper portion of the clutch 5300. Once the shear screws 5350 are sheared, the clutch 5300 is able to slide along the bottom sub 5500 under the clutch cover 5310.

The hydraulic locking swivel 5000 is designed to be run in on opposing ends of the ported casing collar 4000. Placement of the two hydraulic locking swivels 5000 enables the eccentrically-weighted" belly" 4900 of the outer sleeve 4100 to gravitationally rotate into a position 180° from true vertical, thereby pre-aligning the porta's in the casing collar 4000 at true horizontal.

In operation, the casing 12 is run into the wellbore 4 and cemented. Internal pressure is applied to all of the swivels 5000 along the casing string 12 simultaneously. This may be done when "bumping-the-plug" at the conclusion of cementing the casing string 12 in place. This internal hydraulic pressure, when first applied to the swivels 5000, will shear their respective shear screws 5350, thereby engaging the clutches 5300 to prevent further rotation. Once the clutch 5300 is engaged, the snap ring 5600 moves into a mating groove and locks the clutch 5300 in place. No further rotation is possible through the swivels 5000 or the attached outer sleeve 4100, nor is this locking process reversible.

The whipstock 3000 can be run and engaged with the casing collar 4000 as described above, and the casing collar portals can be open/closed as needed pursuant to the operations detailed shown in FIG. 4PCC.2 and the FIG. 4PCC.3*d* series.

Once the swivels 5000 are hydraulically released to swivel, and once the desired position of the inner sleeve 4200 within the casing collar 4000 is reached, the shill dogs 3201 and the alignment blocks 3400 can be released with upstream movement of the whipstock 3000. Upstream movement releases the shift dogs 301 from the shift dog grooves 4202 and allows the alignment blocks 3400 to be removed from the alignment slots 4210.

The main functions of the ported casing collar 4000 are:

- To pre-orient the whipstock 3000, and hence the jetting hose 1595 and attached nozzle 1600, for a desired lateral borehole trajectory;
- To preclude the need to hydraulically bore or mechanically mill casing exits in the casing to form lateral boreholes; and
- To provide a way to either temporarily or permanently open up or seal off a specific portal within the casing collar 4000, and hence (assuming a competent cement job) its associated UDP, at any point during the completion/production/recompletion of a well.

The ported casing collar 4000 also allows an operator to:

- Provide an in situ method for favorably weakening the stress profile of a pay zone in a specific direction, either by:
  - Jetting a lateral borehole immediately prior to a formation fracturing operation through the open portals in the casing collar 4000; or
  - Jetting a lateral borehole, then prior to fracturing, producing reservoir fluids and commensurately drawing down reservoir pressure in the vicinity of the pay zone immediately surrounding the lateral borehole, thus even further weakening this respective portion of the unstimulated pay zone.

The use of the ported casing collar 4000 and its five positions provides for generating lateral boreholes in an eastwardly direction, a westwardly direction, or both, and may also serve to isolate, and/or stimulate, and/or produce (either prior to or after hydraulic fracturing) the eastwardly and westwardly lateral boreholes, either individually or in tandem, as desired.

During operation, the inner sleeve 4200 mateably receives the hydraulic jetting assembly 50. This may be accomplished by pins and/or dogs protruding from the circumference of the jetting hose assembly 50, preferably at or near the whipstock 3000. This protruding mechanism may employ springs to provide an outwards biasing force.

FIG. 4PCC.1.CLD is an exploded, cross-sectional view of a collet latch dog profile 4310 of the casing collar of FIG. 4PCC.1. The collet latch 4310 interacts with a collet latch profile 4150. The collet latch profiles 4150, in turn, reside along the outer sleeve 4100.

The protruding mechanism may also have a unique shape/profile such as to be mateably received by the inner sleeve 4200 of the ported casing collar 4000, such as by slots/grooves within the inner sleeve 4200. The slots/grooves may approximate the mirror image of the profile of the protruding pin/dog at or near the whipstock 3000 within the jetting hose assembly 50. Hence, as the hydraulic jetting assembly 50 is advanced uphole while its protruding pins/dogs travel within the slots/grooves of the inner sleeve 4200, they will eventually "snug up", or latch within the inner sleeve 4200 so as to form a temporary mechanical connection between the hydraulic jetting assembly 50 and the inner sleeve 4200.

It is noted that during initial latching of the whipstock 3000 to the inner sleeve 4200, the inner sleeve 4200 is pinned to the stationary outer sleeve 4100. Referring again to FIG. 4PCC.1, a shear screw 4700 is shown. Shear screws 4700 are employed to pin the inner sleeve 4200 to the outer sleeve 4100.

As the protruding pins/dogs are traversed distally within the slots/grooves of the inner sleeve 4200, the whipstock 3000 will receive an induced rotational force. Since at this stage the whipstock 3000 is free to rotate, and the inner sleeve 4200 is not, this induced torque will cause the whipstock 4200 to rotate about bearings within the swivel assemblies 900, 1100 included in the tool string. As the whipstock 3000 rotates, the distal end of the whipstock's curved face 3001 approaches alignment with a port along the inner sleeve 4200. At the point at which the protruding pins/dogs are "snugged up" within the slots/grooves of the inner sleeve 4200, the distal end of the whipstock 4200 will become precisely aligned with an inner sleeve portal (such as portal 4210.S shown in FIG. 4MW). This portal will be placed and contoured within the inner sleeve 4200 such that it effectively serves as an extension of the arc of the whipstock's curved face 3001.

Referring back to FIG. 4MW, it can be seen that the jetting hose exit portal 3200, the portal 4210.S of the inner sleeve 4200 and the portal 4110.W of the outer sleeve 4100 are in alignment. Dimensionally, the inner diameter of the inner sleeve 4100 is approximately equal to that of the production casing 12 itself. Beneficially, any tools that could be run in the production casing 12 may also be run through the casing collars 4000. As designed, this provides an even larger bend radius R' available to the jetting hose 1595 than if the desired degree of jetting hose bending (for instance, 90 degrees) had to be accomplished entirely within the I.D. of the bending tunnel 3050.

The benefit of the small R to R' radius increase is deceptive. In absolute magnitude, the R to R' increase will only approximate the combined wall thicknesses of the inner sleeve 4200 and the outer sleeve 4100; i.e., about 0.25" to 0.50". Notwithstanding, this relatively small incremental gain in available bend radius for selection of an appropriate jetting hose yields an increase in the I.D. of the jetting hose 1595 that can be utilized. Specifically in the case of smaller casing sizes, such as OCTG's standard 4.5" O.D. and 4.0" I.D., increasing the available bend radius from 4.0" to 4.5" could mean an additional $\frac{1}{8}^{th}$ inch in jetting hose I.D. Over a jetting hose length of 300 feet, this can provide a subsequent increase in deliverable HHP to the jetting nozzle 1600 while staying within the bend radius and burst pressure constraints of the larger hose 1595.

Note the maximum limit of this protrusion's extension from the O.D. out into the borehole should approximate the same protrusion distance (from the O.D. of the outer sleeve 4200 out into the borehole) of the weighted belly 4900. And, (2) by including a slot cut out of the inner sleeve 4200 that receives the bent jetting hose 1595 at a position 180° opposite, and slightly above, the inner sleeve portal 4210.S. This enables the furthest extension of the "bend" in the jetting hose 1595 to be limited by the I.D. of the outer sleeve 4100, instead of being constrained by the I.D. of the inner sleeve 4200.

To accommodate the rotation of the weighted belly 4900, the ported casing collar 4000 may also have a series of circumferential bearings. These bearings may be located at both the proximal and distal ends of the casing collar 4000 such that adding the eccentric weighted belly 4900 to the outer sleeve 4100 of the casing collar 4000 enables gravitational force to self-orient the exit ports at the desired exit orientation. However, it is preferred to use the hydraulically locked swivels 5000 described above.

Running a casing centralizer (such as centralizer 6000 shown in the FIG. 4PCC.3*d* series discussed below) near one or both ends of the ported casing collar 4000 helps ensure that the casing collar 4000 can rotate freely until it rotationally comes to rest at the desired orientation. As discussed above, the hydraulic jetting assembly 50 mates with the inner sleeve 4200, and can rotate or translate the inner sleeve 4200 into its desired position according to the control slot 4800. Receipt of the whipstock 50 by the inner sleeve 4200 is such that a distal end of the whipstock face 3001 is in alignment with a pre-shaped portal 4210.S in the inner sleeve 4200.

In another aspect, once the ported casing collar 4000 has mateably received the hydraulic jetting assembly 50, and once the portals of the inner sleeve 4200 are rotated by the hydraulic jetting assembly such that the portals are in alignment with portals of the outer sleeve 4100, the hydraulic jetting assembly 50 may further rotate both the inner 4200 and outer 4100 sleeves into the desired alignment relative to the pay zone. The requisite rotational force may be provided by either: (1) the same protruding mechanism that rotates the whipstock 3000 into its desired alignment as discussed above; or, (2) a separate rotating mechanism, preferably of significant torque capacity such that any bonding forces of cement, drilling mud and filtrate to the outer sleeve 4100 can be sheered, and similarly any binding forces due to hole ovality and wellbore friction can be overcome. To aid in this rotation, the outer sleeve 4100 may be coated with a thin film of polytetrafluoroethylene ("PTFE"; a.k.a. Chemours' [formerly DuPont Company's] trade name Teflon®), or some similar substance, in order to minimize the torque required to shear any bond that may have formed between the outer sleeve 4100 and any subsequently circulated cement, or drilling mud, or any wellbore fluids. Note that this ability to rotate both sleeves 4100, 4200 simultaneously precludes the need for a weighted belly 4900.

In yet another aspect, a rotational force exerted by the whipstock 3000 shears the set screws 4700 that had immobilized the inner sleeve 4200 relative to the outer sleeve 4100. A pulling force (in the uphole direction) applied by the coiled tubing string 100 translates the inner sleeve 4200 from its position "1" (where all portals are out of alignment and the casing collar 4000 is sealed) into its position "2" (where selective portals of the inner 4200 and the outer 4100 sleeves are in alignment).

In one embodiment of the whipstock 3000, particularly given the preferred conveyance medium of e-coil versus standard coiled tubing, coupled with delivery of electric cable to (and actually, through) the whipstock 3000, the hydraulically powered rotation/indexing system is replaced with an electro-mechanical system. That is, where rotation of the whipstock 3000 is powered by a small, high torque electric motor, and its orientation is given in real time by a sensor reading tool face orientation.

In another aspect, a coiled tubing tractor may be used to assist in conveyance of the coiled tubing sting 100 and the hydraulic jetting assembly 50 along the horizontal leg 4*c* of the wellbore 4. In any instance, the force in the uphole direction will drive the inner sleeve 4200 into its position "2." In position "2," alignment of the jetting hose exit portal 3200 and the inner 4210.S and the outer 4110.E portals will position the jetting nozzle and hose to exit horizontally in an eastwardly direction.

FIG. 4PCC.3*d*.2 demonstrates the alignment of portals in an eastwardly direction, representing position "2." In this second position, an eastwardly lateral borehole may be jetted, and subsequently produced, and/or subsequently stimulated. Applying subsequent translating and/or rotating forces will align inner and outer sleeve portals to position "3," such that the sleeves' portals are aligned and open, providing for jetting, producing, or stimulating a lateral borehole in a westwardly direction. Yet a third translation/rotation of the inner sleeve 4200 will align the inner and outer sleeve portals into position "4," aligning portals in both eastwardly and westwardly directions and thus providing for simultaneous stimulation and/or production of both lateral boreholes. And finally, a fourth translating force application will shift the inner sleeve 4200 to position "5") and final position, such that all of the portals of the outer sleeve are sealed off.

O-rings 4600 seal the annular interface between the inner sleeve 4200 and the surrounding outer sleeve 4100.

Once the hydraulic jetting operation is completed and the jetting hose 1595 and jetting nozzle 1600 have been retrieved back into the external system 2000, a mechanical force can be transmitted to the casing collars 4000 along the production casing 12 via the whipstock 3000. The portals of the casing collars 4000 are then closed, that is, placed in position "5." When closed, the casing collars 4000 can conduct stimulation fluids at similar I.D. dimensions and burst/collapse tolerances as the production casing 12.

The downhole hydraulic jetting assembly 50 allows an operator to create a network of lateral boreholes, wherein formation of the lateral boreholes may be controlled so as to avoid frac hits in neighboring wells. The lateral boreholes are hydraulically excavated into a pay zone that exists within a surrounding rock matrix. The pay zone has been identified as holding, or at least potentially holding, hydrocarbon fluids.

Figure 5A:
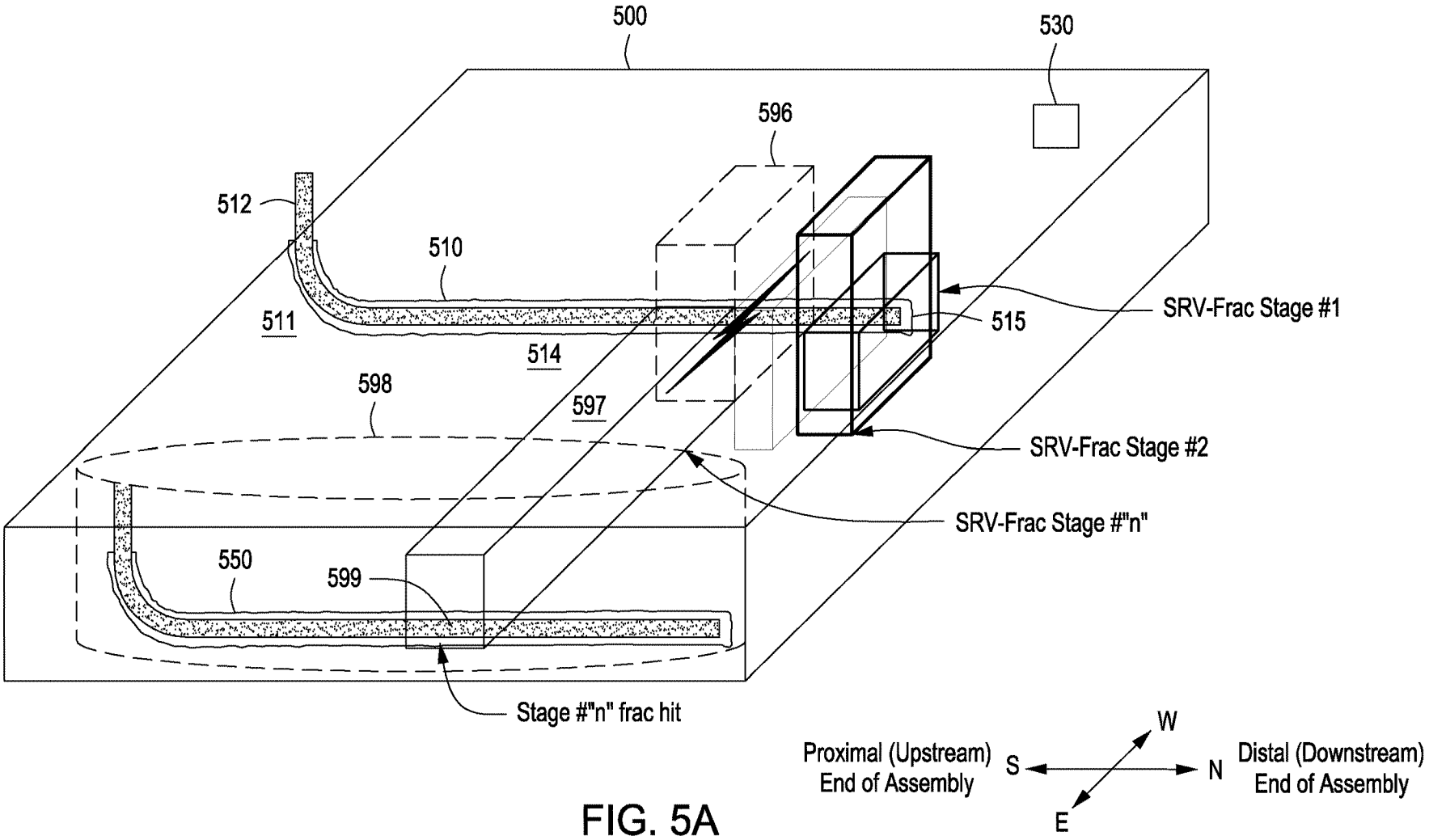
FIG. 5A is a perspective view of a hydrocarbon-producing field. In this view, a child wellbore is being completed adjacent to a parent wellbore. Depletion in a pay zone surrounding the parent wellbore attracts a frac hit while pumping frac stage "n" during completion of the child.

FIG. 5A is a perspective view of a hydrocarbon-producing field 500. In this view, a child wellbore 510 is being completed adjacent to a parent wellbore 550. In the illustrative arrangement of FIG. 5, the child wellbore 510 is a new wellbore that is being completed horizontally. In contrast, the parent wellbore 550 is an older wellbore also completed horizontally.

The child wellbore 510 has a vertical leg 512 and a horizontal leg 514. The horizontal leg 514 extends from a heel 511 to a toe 515. The horizontal leg 514 extends along a pay zone 530. The horizontal leg 514 may be of any length, but is typically at least 2,000 feet. Of interest, the horizontal leg 514 passes by or is generally parallel to the parent wellbore 550, coming perhaps as close as 200 feet.

In the completion of FIG. 5A, frac stages 1, 2, and 3 followed conventional perforations placed in "clusters." These clusters were then fracked using the common "plug-n'-perf" technique; that is, by placing a drillable bridge plug between each hydraulic fracturing stage. These bridge plugs must be drilled out later, before the SRV's gained from frac stages 1 thru 3 before frac and reservoir fluids can flow into the wellbore 511.

This typical completion technique of child well 510 is carried out until frac stage "n", during which time a frac hit 599 is observed in the parent wellbore 550. In many instances, the severity of the frac hit 599 is first indicated by a blown-out stuffing box of the parent well 550.

An SRV 597 is shown in FIG. 5A, emanating from the child wellbore 510 as a result of frac stage "n." In the hypothetical but very real scenario depicted in FIG. 5A, the SRV 597 grows only in one direction, and that as a very narrow "line-out" toward a depletion zone 598 surrounding the lateral section of parent wellbore 550. Note here the operator's greatest economic loss may not be: (1) the cleanout expense of parent wellbore 550, or (2) the potential loss of unrecoverable production and remaining reserves from the depletion zone 598; nor even, (3) frac costs to build so much of SRV 597 within the parent's depletion zone 598. Instead, it is highly probable the operator's greatest economic loss is incurred by his inability to access hydrocarbon production and reserves from the higher reservoir pressure, and hence production- and reserves-rich pay zone volume depicted as 596; that is, half of the SRV that frac stage "n" was otherwise designed to construct.

The narrow "line-out" of the SRV from frac stage "n" toward the depletion zone 598 is a result of the weakening of the principal horizontal stress profile within the pay zone 530. Such weakening is typically directly proportional to the reduction in pore pressure. For previous flow of hydrocarbons to be captured by a parent wellbore, the pore pressure of the reservoir would have been represented by a gradient from a maximum at an outer drainage boundary, gradually decreasing to a minimum in the vicinity of the parent wellbore. Commensurately, the principal horizontal stress profile within the reservoir would follow the same gradient: maximum at an outer drainage boundary, minimum in the vicinity of the parent wellbore 550. Thus, the likelihood of frac hits increases proportionally to the pore pressure gradient between the locations of the existing parent 550 and the new child wellbore 510.

When a frac hit such as frac hit 599 occurs, the operator of the parent wellbore 550 will naturally become concerned that subsequent frac stages, beginning with the very next stage "n+1", are going to hit parent wellbore 550 just as stage "n" did. Thus, it is desirable in connection with a horizontal well completion to obtain greater control over the geometric growth of the primary fracture network extending perpendicularly outward from the horizontal leg 4*c*. It is further desirable to actually control, or at least favorably influence, the growth of a fracture network and its resultant SRV while completing a newer "child" to avoid frac hits damaging offsetting "parent" wells and "thiefing" the subject frac stage. It is proposed herein that this can be accomplished through the use of one or more hydraulically-jetted mini-lateral boreholes, otherwise called Ultra Deep Perforations ("UDP's"), extending from the horizontal leg 514 in the child wellbore 510, in a direction away from the parent wellbore.

Figure 5B:
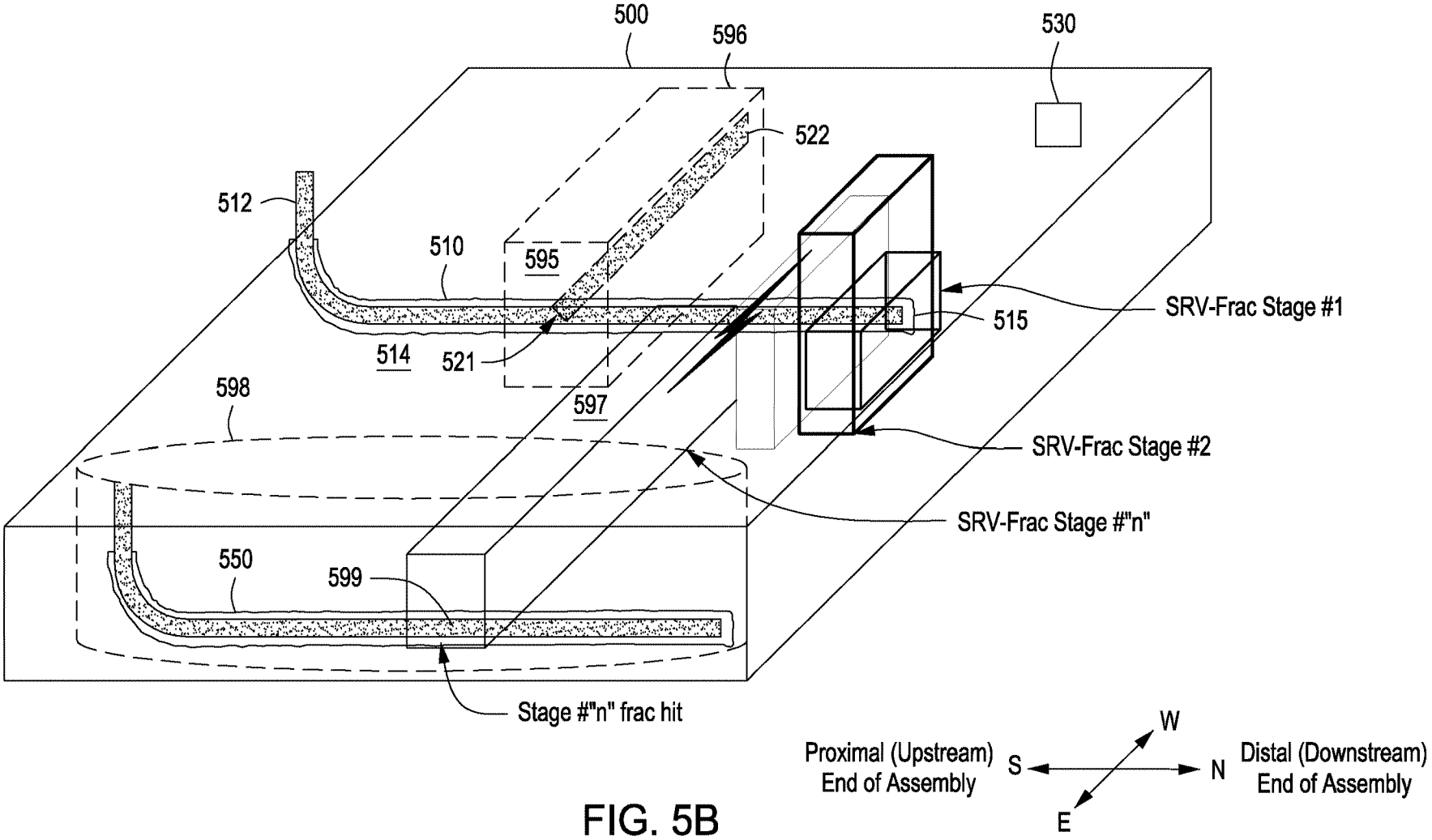
FIG. 5B is another perspective view of the hydrocarbon-producing field of FIG. 5A. Additional frac stages are shown from the child wellbore.

FIG. 5B is another perspective view of the hydrocarbon-producing field 500 of FIG. 5A. Here, a mini-lateral borehole 522 has been jetted from the child wellbore 510. The lateral borehole 522 extends from a first casing exit location 521 along the child wellbore 510, and is formed transverse to the horizontal leg 514. Of course, the lateral borehole 522 may extend away from the horizontal leg 514 at any angle. What is significant in FIG. 5B is that the lateral borehole 522 is formed in a direction that is moving away from the existing parent wellbore 550.

The lateral borehole 522 has been formed subsequent to and in the opposite direction of the frac hit 599 occurring from pumping stage "n." The lateral borehole 522 has also been formed prior to pumping stage "n+1." In order to form the lateral borehole 522, the operator of the formation fracturing operation taking place in the child wellbore 510 may rig down the wireline service providing the "plug-n-perf" functions, and moved in an e-coil unit to run in a downhole hydraulic jetting assembly 50. Thus, the lateral borehole 522 is formed using the downhole hydraulic jetting assembly 50 described above, including the use of either whipstock 1000 or whipstock 3000.

It is observed that there is nothing improper about the formation of the lateral borehole 522, provided that regulatory reporting requirements are met. It is also observed from FIG. 5A that SRV's were also formed from frac stages #1, #2 and #3. This is proper as well. However, these SRV's 515 did not extend in only one direction (the direction of depletion zone 598, but formed bilaterally as they were designed to do. No additional frac hits were created.

Where the whipstock 3000 and ported casing collar 4000 are used to form lateral borehole 522, it is anticipated that the path established by the portals' alignments will be perpendicular to the longitudinal axis of production casing 12 at 90° and 270° from true vertical. Because of the self-aligning feature of the casing collar 4000, the 90°/270° are not essential to the design, and could be modified as desired. For example, the portals may be used to align the longitudinal axis of the portals (said axis being at-or-near perpendicular to the longitudinal axis of the wellbore, and hence of the casing collar body itself) at 100° and 280° as to initiate lateral boreholes parallel to a host pay zone's bedding plane having a 10° dip.

In any instance, during the formation of the lateral borehole 522 it is desirable for the operator to obtain real-time geophysical feedback. An example of such feedback is from micro-seismic data. For example, if the micro-seismic data's processing and presentation times are truly close to "real-time", pumping operations could be shut down prior to a "hit" 599 being incurred. At the very least, real-time micro-seismic feedback should yield valuable information as to what the lateral borehole 522 configuration for the subsequent frac stage 521 should be.

For the remainder of the child wellbore 510 completion, for each remaining frac stage the operator may jet lateral boreholes only in a westerly direction, and none easterly, particularly if he discovers lateral borehole 522 was successful in both: (1) directing SRV 596 growth westerly for frac stage 521 ("n+1"), and (2) avoiding another frac hit 599 in parent wellbore 550.

In addition, sensor tools may be used to provide real-time data describing the downhole location and the alignment of the whipstock face 1050.1 or 3001. This data is useful in determining:

(1) how many degrees of re-alignment, via the whipstock face 1050.1 alignment, are desired to direct the initial lateral borehole along its preferred azimuth; and (2) subsequent to jetting the first lateral borehole, how many degrees of re-alignment are required to direct subsequent lateral borehole(s) along their respective preferred azimuth(s).

In addition, the tool face sensor data received in real time, subsequent to the whipstock 3000 being latched into a casing collar 4000, would confirm:

(3) the initial alignment of the casing collar 4000 by validation of the weighted belly 4900 successfully orienting at 180° from true vertical;

(4) the alignments of the outer sleeve's easterly-oriented port 4110.E and westerly-oriented port 4110.W being oriented at 90° and 270°, respectively, from true vertical (presuming that their longitudinal azimuths were designed for true horizontal); and, (5) the hydraulic locking swivels 5000 (or, at least one of them) located at each end of the casing collar 4000 had successfully actuated, locking the rotational position of the casing collar 4000 and the swivels 5000 in place. That is, throughout the rotational movements of the whipstock face 3001, induced by torque from an electric motor, it can be observed whether or not the casing collar 4000 is rotating with it.

The operating procedures for the whipstock 3000 and the ported casing collar 4000 are as follows:

(1) After the hydraulic locking swivels are pressurized and hydraulically locked. the whipstock 3000 is run inside an inner sleeve 4200 to operate the casing collar 4000 and to place it in the desired port-open condition such that hydraulic jetting and/or stimulation and/or production operations can begin.

(2) Once the whipstock 3000 is inside the inner sleeve 4200, the alignment blocks 3400 are guided by the beveled entries 4211 to matingly rest in the axial alignment slots 4212.

(3) Continued downstream movement of the whipstock 3000 snaps the shift dogs 301 into the mating shift dog groove 4202 in the inner sleeve body 4201. At this point of engagement by the whipstock 3000, the casing collar 4000 is in position "1," which is the run-in-hole position. all portals are sealed and pressure-tight in the casing collar 4000.

(4) Rotating the whipstock 3000 clockwise (right-hand) applies torque to the inner sleeve 4200 through the alignment blocks 3400, shearing the shear screws 4700 in the lower portion of the inner sleeve 4200 and places the inner sleeve 4200 in an axial portion of the control slots 4800 relative to the torque pins 4500. The torque pins 4500 are used to guide the inner sleeve's movement along the path established by the control slots 4800.

(5) Moving the whipstock 3000 upstream via the shift dogs' 3201 engagement of shift dog groove 4202, followed by counter clockwise (left-hand) rotation places the inner sleeve 4200 in position "2." This is the "East Hole Open" position relative to the torque pins 4500. Further longitudinal movement is prevented. Hydraulic jetting, stimulation and/or production operations in the easterly direction can begin while in this position "2."

(6) To move the inner sleeve 4200 from position "2" to position "3," which is the "West Port Open" position, 180° of clockwise rotation is applied through rotation of the whipstock 3000, placing the torque pins 4500 in a longitudinal portion of the control slot 4800. This is shown in FIG. 4PCC.1.CSP. Upstream movement via the shift dogs 3201 and clockwise (right-hand) rotation of the whipstock 3000 and matingly attached inner sleeve 4200 place the torque pins 4500 in position "3." In this position, hydraulic jetting, stimulation and/or production operations in the westerly direction can begin.

(7) Moving from position "3" to position "4" is accomplished by applying counterclockwise (left-hand) rotation, then upstream axial movement, to the whipstock 3000. This aligns all portals as shown in FIGS. 4PCC.2 and 4PCC.3*d*.4, meaning that both East and West Ports are open. Clockwise (right-hand) rotation locks the inner sleeve 4200 in Position "4." Further longitudinal movement is again prevented and stimulation and/or production operations in simultaneous easterly and westerly directions can begin. (Note that hydraulic jetting is not possible in Position "4" as the whipstock's jetting hose exit portal 3200 is no longer in alignment with a portal in the inner sleeve 4200.)

(8) Applying 90° of counterclockwise (left-hand) rotation to the whipstock 3000 followed by upstream longitudinal movement and additional counterclockwise (left-hand) rotation places the torque pins 4500 in control slot Position "5." This is the "Both Holes Closed" position, shown in FIGS. 4PCC.2 and 4PCC.3*d*.5. In this position. further axial movement is prevented. Straight upstream movement (i.e. no rotation) can be applied when in any of the five "locked" control slot positions and removes the shift dogs 3201 from the mating circumferential shift dog groove 4202. Further upstream longitudinal movement removes the alignment blocks 3400 from the alignment slots 4212, thereby allowing the whipstock 3000 to be moved to a next casing collar 4000 along the casing string 12.

Beneficially, the above completion protocol could include all of the lateral boreholes being jetted in advance of any frac equipment arriving at the child well location. In fact, the only necessary equipment would be the hydraulic jetting assembly 50 with the casing collars 4000 placed along the production casing 12 to jet the lateral boreholes.

Using the whipstock 3000, the casing collars 4000 may be selectively opened or closed at a later time to provide for fracing through them in any sequence desired. Additionally, lateral boreholes jetted through the aligned portals of the casing collars 4000 may be augmented by additional lateral boreholes jetted through the casing 12 and into the pay zone using either the whipstock 1000 or 3000. The configuration of the lateral boreholes may be based upon the at-or-near real time interpretation of micro-seismic data or electromagnetic imaging of an SRV.

In FIGS. 4E and 4MW, the whipstock 1050 and 3000 is disposed below the lower end of the outer conduit 490 of the external section 2000. The whipstock 1050, 3000 is presented as having a generally 90° curvature. However, other degrees of curvature may be desired such that the jetting hose 1595 exits the casing 12 (or the outer sleeve 4100) closer to the plane of maximum principle (horizontal) stress, $\sigma_H$, of the host pay zone. Beneficially, a larger-diameter jetting hose 1595 may be used where the angle of curvature is less than 90°.

Note that in many cases, drillers will purposefully orient the lateral sections of their wellbores to be perpendicular to $\sigma_H$, which is typically parallel to the minimum principle (horizontal) stress, $\sigma_h$. As applied to the technology disclosed herein, a 90° casing exit by the jetting hose 1595 should generate a lateral borehole in a direction perpendicular to $\sigma_h$; i.e., along the same trajectory that hydraulic fractures (in the absence of natural fractures or other geologic anomalies) tend to propagate within a rock matrix. Knowing this, the operator can locate lateral boreholes at a location along the horizontal leg 4*c* of the wellbore and in a direction that is away from an offset parent wellbore. Optionally, the operator can select a whipstock face curvature that will avoid a frac hit with an offset wellbore.

The hydraulic jetting assembly 50 also allows the operator to make a 180° rotation of the face 1050.1 of the whipstock 1000. This may be done, for example, if the operator wishes to align a subsequent UDP with $\sigma_h$ or if the operator wishes to increase SRV while still avoiding a frac hit.

It is also proposed herein that a mini-lateral borehole (such as lateral borehole 522) can control frac direction. As a first point, it is observed that the hydraulic pressures used in connection with forming a lateral borehole are typically lower than the initial fracturing pressure required to generate a parting of the formation. Thus, a lateral borehole can be formed in a direction away from an offset wellbore without creating a fracturing network and the accompanying risk of a frac hit. Thereafter, the lateral borehole could be produced for a period of time, thereby weakening the rock matrix making up the pay zone—again, in a location away from the offset wellbore. Stated another way, pre-frac depletion serves to "magnetize" the lateral borehole.

After a period of producing reservoir fluids, a formation fracturing operation could be conducted in the lateral borehole. In this instance, the fracture network will not be biased to flow in the direction of the parent wellbore but will form more closely in a perpendicular orientation off of the lateral borehole.

As long as the "weaker stress" points along the lateral borehole have an initial fracture pressure ($P_{Fi}$) that is less than a formation parting pressure at the parent wellbore ($P_{Fp}$)=5,950 psi), the fractures will propagate along the top and bottom of the lateral borehole in a desired direction that will not create a measurable risk of frac hit.

Because of the presence of the lateral borehole, initial formation parting pressure ($P_{Fi}$) and formation propagation pressure ($P_{Fp}$) in the rock matrix (at-or-near the top and bottom of a pre-frac lateral borehole) are reduced below the correlative ($P_{Fi}$) and ($P_{Fp}$) thresholds extending from the child well towards the parent. If necessary, combining the disruption of the in situ stress profile of the rock matrix surrounding the lateral borehole itself with the compounding $P_{Fi}$ and $P_{Fp}$ reductions from near-lateral borehole depletion, ($P_{Fi}$) and ($P_{Fp}$) (at-or-near the top and bottom of the pre-frac lateral borehole) are then reduced below the correlative ($P_{Fi}$) and ($P_{Fp}$) thresholds extending from the parent wellbore.

As part of the method of avoiding frac hits herein, the operator will need to determine how long will it take to drain a sufficiently depleted volume surrounding the lateral borehole, and how much drained volume is required to create the desired pressure bias. Answers to these questions will be governed by numerous factors, chiefly those inherent to the reservoir itself, such as relative permeability's to the respective reservoir fluids.

One noteworthy practice in unconventional reservoirs development, particularly utilizing horizontal wellbores, is that many wells are drilled and cased long before they are perforated and fracked via multi-stage completions. This interim state is referred to in the industry as drilled-but-uncompleted, with wellbores in this classification simply referred to as "DUC's". The procedure referenced above provides a methodology to utilize this interim "DUC" state to enhance the desired SRV geometry from subsequent fracs by first partially depleting reservoir volumes surrounding pre-frac lateral boreholes. Further, given the right reservoir parameters, the referenced procedure may even place an otherwise idle DUC into a cash flow positive position as oil and/or gas are produced via the pre-frac lateral boreholes.

Referring back to the downhole hydraulic jetting assembly 50, FIGS. 2 and 4 depict the final transitional component 1200, the conventional mud motor 1300, and the (external) coiled tubing tractor 1350. Along with the tools listed above, the operator may also choose to use a logging sonde 1400 comprised of, for example, a Gamma Ray—Casing Collar Locator and gyroscopic logging tools.

Using the downhole hydraulic jetting assembly 50 described above, a method of avoiding frac hits is offered herein. In one aspect, the method first comprises providing a child wellbore 510 within a hydrocarbon-producing field 500. A portion of the child wellbore 510 extends into the pay zone 530. Preferably, the wellbore 510 is completed horizontally such that a horizontal leg 514 of the child wellbore 510 extends along the pay zone 530.

The method also includes identifying a parent wellbore 550 within the hydrocarbon-producing field 500. In the context of the present disclosure, the parent wellbore 550 is a well located near or adjacent to the child wellbore 510. The parent wellbore 550 is an existing older well that was previously completed within the pay zone 530 such as shown in FIGS. 5A and 5B.

Within a drainage volume affected by the parent wellbore, production of reservoir fluids has reduced pore pressure in the rock matrix. This reduction of pore pressure has affected the in situ stress profile of the rock matrix within the pay zone's pressure sink. The result is that the rock matrix will hydraulically fracture with significantly less hydraulic/pressure force than it otherwise would have at virgin conditions.

Note that this reduction in formation breakdown pressure is somewhat proportional to the reduction in pore pressure. That is, the greater the drainage of pore pressure of a specific rock, the less the frac pressure required to initiate formation fractures; and extend (or propagate) fractures out into the formation. Accordingly, this pre-existing pore pressure gradient within the pay zone, upon the arrival and completion of the child wellbore, creates a preferential "path-of-least-resistance" for a hydraulic fracture initiating from a child wellbore and extending towards the vicinity of the parent wellbore.

The method further includes conveying a hydraulic jetting assembly into the child wellbore. The hydraulic jetting assembly is in accordance with the assembly 50 of FIG. 2, in any of its various embodiments. The hydraulic jetting assembly 50 is transported into the wellbore on a working string. Preferably, the working string is a string of e-coil, that is, coiled tubing carrying an electric line within, along the entirety of its length. Even more preferably, the working string is a string of coiled tubing having a sheath for holding one or more electrical wires and, optionally, one or more fiber optic data cables as presented in detail in the '351 patent incorporated above.

Generally, the hydraulic jetting assembly 50 will include:

a whipstock member having a concave face, a jetting hose having a proximal end and a distal end, and a jetting nozzle disposed at a distal end of the jetting hose.

The method also comprises setting the whipstock at a desired first casing exit 521 location along the child wellbore 510. The face of the whipstock bends the jetting hose substantially across the entire inner diameter of the wellbore 510 while the jetting hose is translated out of the jetting hose carrier.

The method additionally includes translating the jetting hose out of the jetting hose carrier to advance the jetting nozzle against the face of the whipstock. This is done while injecting hydraulic jetting fluid through the jetting hose and connected jetting nozzle, thereby excavating a lateral borehole within the rock matrix in the pay zone.

The method also includes further advancing the jetting nozzle through a first window at the first casing exit location 521 and into the pay zone 530. The method then includes further injecting the jetting fluid while further translating the jetting hose and connected jetting nozzle through the jetting hose carrier and along the face of the whipstock. In this way, a first lateral borehole 522 that extends at least 5 feet from the horizontal (child) wellbore 514 is formed.

In one aspect, the method of the present invention additionally includes controlling (i) a distance of the first lateral borehole 522 from the child wellbore 514, (ii) a direction of the first lateral borehole 522 from the child wellbore 514, or (iii) both, to avoid a frac hit with the parent wellbore 550 during a subsequent formation treatment operation. The formation treatment operation is preferably a formation fracturing operation, such as the frac stage "n+1" of FIG. 5B.

In one embodiment, the method further comprises monitoring tubing and annular pressures of the parent wellbore 550 while conducting frac operations of child wellbore 510. "Tubing pressure" typically means pressure within the production string of the parent wellbore 550. "Annular pressures" would include pressure within a tubing-casing annulus, but would also include pressure in the annuli between casing strings. The later could perhaps prove to be the most ominous, as it could indicate issues concerning wellbore (and particularly, casing) integrity, well control, and even the exposure of fresh water zones to well and frac fluids.

The tubing and annular pressures are monitored to see if a so-called pressure hit is taking place in the parent wellbore 550 during any frac stage "n". Note that, even if the parent wellbore 550 is producing from a highly depleted portion 598 of pay zone 530, the tubing-production casing annulus pressure could be monitored, not only by a pressure gauge at surface, but by continuously shooting downhole fluid levels. Even if the surface gauge is reading zero, an increasing downhole fluid level could indicate that a pressure hit is occurring within the parent wellbore 550, and the operator could discontinue pumping frac fluid into child wellbore 510. Alternatively, prior to pumping the subsequent frac stage, the operator will jet lateral borehole 522 away from the parent wellbore 510. Alternatively still, the operator may partially withdraw the jetting hose and connected jetting nozzle from the first lateral borehole 522, and then form a side borehole off of the first lateral borehole 522 in order to create even more SRV in a direction away from the parent wellbore 550 to avoid a frac hit from frac stage "n+1".

The process of forming the first lateral borehole 522 in such a manner as to avoid a frac hit may be done during initial well completion. Alternatively, the process may be done after the child wellbore 510 has been producing hydrocarbon fluids for a period of time.

It is preferred, though not required, that the child wellbore 510 be completed horizontally, referred to as a "horizontal wellbore." In this instance, the first casing exit location 521 will be along a horizontal leg 514 of the child wellbore 510. In one embodiment, the operator will determine a distance of the parent wellbore 550 from the first casing exit location 521 in connection with avoiding a frac hit.

In one aspect, the method may further comprise the steps of:

retracting the jetting hose and connected nozzle from the first window (at the first casing exit location 521);

re-orienting the whipstock at the first casing exit location 521;

injecting hydraulic jetting fluid through the jetting hose and connected nozzle, thereby forming a second window at the first casing exit location 521;

advancing the jetting nozzle against the face of the whipstock while injecting hydraulic jetting fluid through the jetting hose and connected jetting nozzle;

advancing the jetting nozzle through the second window at the first casing exit location 521 and into the pay zone 530;

further injecting the jetting fluid while advancing the jetting hose and connected nozzle along the face of the whipstock, thereby forming a second lateral borehole 524 that extends from the second window through a rock matrix in the pay zone 530; and controlling (i) a distance of the second lateral borehole (not shown) from the child wellbore 510, (ii) a direction of the second lateral borehole from the child wellbore 510, or (iii) both, to avoid a frac hit with the parent wellbore 550 during a subsequent formation fracturing operation in order to create SRV in the pay zone 530.

In this embodiment, the child wellbore 510 is preferably a horizontal wellbore, and the first casing exit location 521 is preferably along the horizontal leg 514. In addition, the second lateral borehole is preferably offset from the first lateral borehole 522 by between 10-degrees and 180-degrees, and is thus not excavated in a horizontal orientation. In any instance, the jetting fluid typically comprises abrasive solid particles. The operator may then produce hydrocarbon fluids from both the first and second lateral boreholes.

In one embodiment of the method, the operator of the child wellbore 510 produces reservoir fluids from the first and second lateral boreholes for a period of time prior to pumping fracturing fluids into the first and second lateral boreholes. In another embodiment of the method, particularly suited for settings of significant in situ stress anisotropy (as in the case where offset production from the subject pay zone has locally reduced pore pressure) would be to only jet a lateral(s) into the higher pressure/higher stress region of the pay zone. That is, in a direction opposite the source of depletion. Once completed, these laterals could be produced for a given time span prior to hydraulically fracturing, thus reducing the pore pressures, and rock stresses, in the vicinity surrounding the lateral boreholes. If the frac treatments of these lateral boreholes did not eventually break into a direction towards the original depletion source, subsequent lateral boreholes could be jetted in that direction, and then be subsequently fracked. Note in this case it would be advantageous to utilize a casing collar 4000 of FIG. 4MW, so the portals exposing the original lateral boreholes could be closed off while fracking the more recent lateral boreholes.

It is understood that the operator may form a third or a fourth lateral borehole (not shown) proximate the first casing exit location 521. This allows an even greater exposure of the wellbore 514 to the surrounding pay zone 530. Confirmation of the directions of the original fractures could be detected in offsetting well pressures, through the use of chemical tracers, or through micro-seismic data. Also, tiltmeter measurements in or near the child wellbore 510 could be employed.

In another embodiment of the method herein, the method may further comprise:

retracting the jetting hose and connected nozzle from the first window (at the first casing exit location 521);

moving the whipstock to a desired second casing exit location along the horizontal leg 514 of the child wellbore 510, and setting the whipstock;

injecting hydraulic jetting fluid through the jetting hose and connected nozzle, thereby forming a second window at the second casing exit location;

advancing the jetting nozzle against the face of the whipstock while injecting hydraulic jetting fluid through the jetting hose and connected jetting nozzle;

advancing the jetting nozzle through the second window at the second casing exit location and into the pay zone 530;

further injecting the jetting fluid while translating the jetting hose and connected jetting nozzle along the face of the whipstock, thereby forming a second lateral borehole that extends from the second window through the rock matrix in the pay zone 530; and controlling (i) a distance of the second lateral borehole from the child wellbore 510, (ii) a direction of the second lateral borehole from the child wellbore 510, or (iii) both, to avoid a frac hit with the parent wellbore 550 during a subsequent pumping of frac fluid.

It is observed that in the illustrative wellbore 510, the second lateral borehole could be oriented vertically relative to the horizontal leg 514. In practice, the second lateral borehole may be oriented in any radial direction off of the horizontal leg 514. In addition, the second lateral borehole may extend any distance from the horizontal leg 514, provided that regulatory reporting requirements are met.

Once again, the child wellbore 510 is preferably a horizontal wellbore, and the first casing exit location 521 (and any second, third, or subsequent casing exits) is preferably along the horizontal leg 514. The second casing exit location is preferably separated from the first casing exit location 521 by 15 to 200 feet. Preferably, each of the first 522 and second lateral boreholes is at least 25 feet in length and, more preferably, at least 100 feet in length. In any instance, the jetting fluid typically comprises abrasive solid particles. The operator may then produce hydrocarbon fluids from both the first and second lateral boreholes, with or without subsequent hydraulic fracturing.

In any of the above methods, advancing the jetting hose into a lateral borehole is done at least in part through a hydraulic force acting on a sealing assembly along (such as at an upstream end of) the jetting hose. Further, the jetting hose is advanced and subsequently withdrawn without coiling or uncoiling the jetting hose in the wellbore.

In one embodiment, advancing the jetting hose into a lateral borehole is further done through a mechanical force applied by rotating grippers of a mechanical tractor assembly located within the wellbore, wherein the grippers frictionally engage an outer surface of the jetting hose.

In another embodiment, advancing the jetting hose into a lateral borehole is accomplished by forward thrust forces generated from flowing jetting fluid through rearward thrust jets located in the jetting assembly. These rearward thrust jets are specifically located in the jetting nozzle, or in a combination of the nozzle and one or more in-line jetting collars strategically located along the jetting hose. Preferably, the nozzle permits a flow of the jetting fluid through rearward thrust jets in response to a designated hydraulic pressure level. In this instance, the flowing of fluid through the rearward thrust jets is only activated after the jetting hose has advanced into each borehole at least 5 feet from the child wellbore. The additional rearward thrust jets located in the in-line jetting collar(s) are then activated at incrementally higher operating pressures, typically when the jetting hose has been extended such a significant length from the child wellbore that the rearward thrust jets within the nozzle alone can no longer generate significant pull force to continue dragging the full length of jetting hose along the lateral borehole.

In a related aspect, the method may include monitoring tensiometer readings at a surface. The tensiometer readings are indicative of drag experienced by the jetting hose as lateral boreholes are formed. In this instance, the flowing of fluid through the rearward thrust jets is activated in each of the plurality of boreholes in response to a designated tensiometer reading.

Of course, the operator will also monitor pressure readings at the child wellbore. During a hydraulic fracturing operation, a sudden drop in pumping pressure at the surface indicates fracture initiation. At this point, fluids flow into the fractured formation. This means that a formation parting pressure has been reached and that the fracture initiation pressure has exceeded the sum of the minimum principal stress plus the tensile strength of the rock.

Additional prophylactic steps to avoid a frac hit may be undertaken. Such may include monitoring tubing and/or annular pressures in the parent wellbore 550 or conducting real-time micro-seismic and/or tiltmeter measurements in or near the child wellbore 510 and extending to (and preferably beyond) parent wellbore 550 and at least to any other directly offsetting parent wellbores in every direction. This will provide at least two benefits: (1) provision of a precise horizontal depth datum (particularly, as the jetting nozzle and hose just begin to extend from the child wellbore) with which to calibrate subsequently gathered micro-seismic data; and (2) confirmation of the path of the lateral borehole as it is being erosionally excavated.

During a fracing operation, if monitoring indicates that an SRV has failed to propagate in the pay zone in any desired orientation emanating from the child well, then the next stage's configuration of lateral boreholes can be tailored to address the issues. For example, a well plan may be modified so that lateral boreholes in a subsequent stage may only be formed in one direction, rather than bilaterally. Alternatively, the lateral boreholes in a subsequent fracturing stage may be formed a longer distance in a direction away from an offset well, and a shorter distance in a direction towards the offset well.

Upon detecting propagation near a parent wellbore 550, the operator can discontinue the injection of the jetting fluid into the first lateral borehole, thereby:

(1) protecting the parent wellbore, its associated production, and future recoverable reserves it may still be able to capture;

(2) saving the cost of associated frac fluids, proppants, and hydraulic horsepower that would be wasted while "hitting" or "bashing" the parent wellbore;

(3) precluding the expense of fishing the parent well's rods, pumps, tubulars, tubing anchor and other downhole production equipment that may become stuck due to the influx of frac fluids and particularly, proppants from child well frac operations;

(4) precluding the expense of a parent well cleanout operation, often requiring coiled tubing and nitrogen to circulate out frac fluids and proppants;

(5) precluding the cost of lost hydrocarbon production and (previously) remaining reserves attributable to the parent well, which is often the most significant expense of all; and (6) precluding the expense of surface cleanup and remediation from an induced "blowout" situation (note in the case where the parent wellbore is much older (typically vertical) wells, and due to corrosion and aging may have weakened and/or already have leaking casing, the "blowout" scenario could occur entirely underground).

Therefore in the subject method, no longer is the operator superimposing a pre-designed frac stage spacing, perforation densities, or even perforation direction without considering the frac behavior of the immediately preceding stage. By utilizing the hydraulic jetting assembly 50 and the methods presented herein, a given "cluster" (or set) of lateral boreholes can provide customization of (quite literally) far greater depths, wherein the dual objectives of (1) SRV maximization and (2) frac hits minimization can be achieved. Each grouping of lateral boreholes can be customized in terms of depth, direction, distance, design, and density in preparation for receiving a next frac stage. Where a ported custom collar 4000 is used, a given borehole's level of depletion can also be increased to further enhance achievement of these two main objectives.

Each of the UDP customization criteria is elaborated below:

Depth

Because the apparatus can be set and re-set multiple times, individual lateral boreholes can be jetted through the casing and on out into the pay zone from any position along the horizontal wellbore. Further, even though the apparatus is conveyed via a string of coiled tubing, because it is configured to be able to conduct hydraulic fluid entirely throughout its length, it can thus incorporate and drive a downhole motor/CT tractor assembly toward its distal end. Thus, the depth limit is not that of the CT alone (e.g., to the point at which, while advancing downhole, CT "buckling" produces "lock-up"), but that depth to which a CT tractor can convey the CT and the apparatus. Note when utilizing ported custom collars, some of this depth flexibility is lost because the collars are run within the casing string itself. That is, the casing collar portals that will provide the casing exit location for a given lateral borehole is at a fixed, predetermined wellbore depth along the string of production casing. Notwithstanding this limitation, multiple other lateral boreholes may be jetted through the casing in conjunction with, or in place of, lateral boreholes jetting through the casing collars.

Direction

Lateral boreholes can be jetted in any axial direction (depending on the tool assembly's ratchet mechanism setting, typically within 5- or 10-degree increments) from the wellbore. Generally speaking, more and longer lateral boreholes are desired in the direction for which fracking is most difficult. Note that, typically, when utilizing the casing collars herein, the hydraulic locking swivels on each end will have been pressure-actuated to lock the casing collars in place when "bumping-the-plug" at the conclusion of the cement job of the production casing string. Hence, this employment of the casing collars carries with it the inherent limitation of the orientation of the exit portals relative to the self-orienting mechanism (that is, the "weighted belly"). That is, where the weighted belly will find true vertical at 180° (down), the exit portals will have been milled at true horizontal (90° and 270°), or perhaps some slight variation to correspond with the bedding plane of the pay zone. However, there is the alternative method of first engaging the casing collars with the whipstock of the jetting assembly before they have been locked, and using the whipstock's orienting mechanism and tool-face measurements to selectively set the casing collars (with their pre-milled port orientations) in any desired orientation, then pressuring-up on the CT-casing annulus to lock the casing collar in place. (Note this would require an uphole-to-downhole progression.) Thus, in the case where the tool assembly's hydraulic 'pressure pulse' ratchet mechanism has been replaced with an electric driven motor assembly, coupled with real time tool face orientation, the operator at surface can select any precise exit orientation (at least, for one direction of exit ports) desired in real-time. Notwithstanding any initial orientation limitations imposed by the casing collar exit portals, in a preferred embodiment of the jetting assembly, the jetting nozzle and hose can be steered toward any desired orientation after exiting the wellbore.

Distance

Lateral boreholes may be generated that extend any distance from the child wellbore, limited only by the length of the jetting hose itself. This 'distance' customization capability is also available "on-the-fly" between frac stages.

Design

In certain embodiments, the subject apparatus is capable of generating steerable lateral boreholes. Though the maximum length of each lateral borehole is dictated by the length of the jetting hose, the ability to steer the jetting nozzle in 3-D space within the pay zone provides for an almost infinite number of geometries. Incorporated U.S. Pat. No. 9,976,351 entitled "Downhole Hydraulic Jetting Assembly." highlights this 'design' capability in significant detail. Note that this particular flexibility is independent of whether the initial casing exit is obtained from jetting through the casing or from utilizing portals in a casing collar. This is true even if the casing collar is of the self-orienting embodiment previously described, and has been cemented into place. This 'design' customization capability is also available "on-the-fly" between pumping frac stages.

The subject hydraulic jetting assembly 50 can generate lateral boreholes at multiple azimuths and at any given depth location. For this reason, the density of lateral boreholes can be highly customized.

Depletion

Depletion of the pay zone in the vicinity around the circumference of the lateral borehole for a designated period of time can be useful in making the lateral borehole a preferred "path-of-least-resistance" for a subsequent frac stage. Optionally, selected portals along a stage that is considered to be high risk for a frac hit may be kept open for the selected period of time for production while other portals that are located along less-at-risk depths may be closed.

Preferably, it will be the information observed from the immediately preceding frac stage that will guide design of a current lateral borehole. Of course, the closer to real-time the data feedback is to actual pumping times, the more frac fluids, proppant volumes, pumping rates and pressures can also be custom-tailored for each stage's already customized lateral borehole(s).

The method disclosed herein also encompasses the deployment of ported casing collars within the production casing string. The casing collars serve as a substitute for conventional perf clusters in a child wellbore. The casing collars are run in conjunction with pairs of hydraulic locking swivels. The eccentric weighted belly's turns at approximately 180° from true vertical, thus orienting all of the exit portals at or near true horizontal.

A benefit of the present methods and of the hydraulic jetting assembly disclosed herein is that lateral boreholes may be excavated within the pay zone without creating fractures of any significant scale. This means that, in many if not most cases, the operator can favorably influence the direction and distance of the growth of the fracture network (in the form of SRV emanating from the lateral boreholes) relative to the wellbore.

In one aspect of the present invention, lateral boreholes are intentionally formed in a horizontal direction. In addition, the horizontal leg of the wellbore is drilled in a direction of least principal (horizontal) stress, and the lateral boreholes extend "transverse" to the wellbore horizontally. This enables pumping pressures through the lateral boreholes to be minimized since rock stresses acting against the hydraulic forces will be minimized.

Optionally, after a lateral borehole has been formed, the operator may increase pumping pressure up to the formation parting pressure. Fractures will then emanate vertically, and propagate horizontally in a vertical plane running parallel to the longitudinal axis of the lateral borehole itself.

It is observed that after a formation has parted, fractures will begin to propagate. The fracture propagation pressure of a formation (indicated at the fracture tip) is typically less than the original formation parting pressure. It is further observed that producing reservoir fluids from the pay zone 530 will change the stress regime in the rock matrix, and lower the formation parting pressure. Thus, in one aspect of the methods herein, the operator may choose to produce reservoir fluids from the lateral borehole(s) for a period of time before actually injecting fluids into the lateral borehole (s) at a pressure that exceeds the formation parting pressure. In other words, the operator may form the lateral boreholes, produce reservoir fluids from the formation (causing a reduction in pore pressure and a corresponding fracture propagation pressure), and then inject traditional proppant-laden fracturing fluids to create fracture networks.

In another aspect of the method, the well is completed with casing collars 4000 and all desired lateral borehole configurations are completed before commencing formation fracturing operations. The hydraulic jetting assembly 50 is the re-run into the hole with the whipstock 3000. This provides the operator with the ability to selectively close-off (or frac and then re-close) portals in the casing collars 4000 in any sequence desired.

Suppose, for example, real-time micro-seismic reveals the first stage produced an SRV highly skewed easterly. If the operator wanted to know if this characteristic was going to continue throughout the entirety of his, say, 100-stage well completion, instead of proceeding from stage #1 to #2, he may want to skip to stages 25, 50, 75, and 100, to learn east-leaning tendency was going to continue throughout. Say it does, and even increasingly so from toe-to-heel, with unacceptable westwardly SRV generation occurring by stage 75. Hence, instead of completing the remainder of the well after, say, stage 50, the operator may opt shut-down frac operations at that point, flow back the stages he has fracked, while simultaneously pre-producing stages 51-100. Notwithstanding this particular scenario, obviously, whatever the operator observes form completing in stages sequence 1-25-75-100 will certainly influence his planning, and validate probable modifications of the completion plan.

Another aspect of the method, in the 1-25-50-75-100 stage sequence scenario above, revealing an increasingly heavy eastwards SRV generation, the operator (with or without the pre-frac production option afforded by completing with the casing collars 4000) may want to utilize the ability to steer the jetting nozzle 1600 and branch-off the existing westerly lateral boreholes to further enhance westerly SRV generation. Further, the operator may want to actually frac through one or more casing collars, first in a westerly direction (i.e., all portals in position "3"), then shut down briefly to re-shift the same casing collars into position "2" (east open, only) or perhaps some into position "4" (both east and west open).

In a still further aspect, steps may be taken to determine a suitable period of time of reservoir production to generate a change in in situ stresses before injecting fracturing fluids and forming the resultant fracture (SRV) network.

Once again, where a fracture network is formed, prophylactic steps may be taken to monitor pressure hits. Some degree of pressure change sensed in or caused to the parent wellbore 550 may be beneficial. However, a frac hit where proppant invades the tubing string of the parent wellbore 550 or where a pressure in the parent wellbore exceeds burst pressure ratings is to be avoided herein.

In another aspect of the method of avoiding frac hits herein, the operator of the parent wellbore may take affirmative steps to prevent child well fracturing interference. For example, the operator may dump a heavy drilling mud into the well, creating hydrostatic head that will act against rising formation pressures during the fracturing operation in the neighboring well. Thereafter, the operator of the child well may turn off artificial lift equipment (if it exists) and shut in the well by closing off valves in the wellhead.

As an alternative, the operator of the parent wellbore may inject an aqueous fluid into the well and at least partially into the surrounding formation. This has the effect of reversing the pressure sink that has been formed in the subsurface formation during production, and minimizing the "path of least resistance" created by changes in the in situ stress field during production.

In a more aggressive aspect of protecting the child wellbore from a frac hit, the operator of the child wellbore may pump a diverting agent into the well. Diverting agents are known and may be used to redirect fluid flow away from one pay zone compartment already thought to be adequately stimulated, towards another compartment not yet adequately stimulated. Divertants can in some cases be used to block an established stimulation fluid's flow path, and redirect the fluid to an unstimulated (or under-stimulated) set of perforations. This forced redirection improves the stimulation treatment's efficacy and efficiency in the creation of Stimulated Reservoir Volume ("SRV"), whether during the wellbore's initial completion, a recompletion, or remedial work.

In the present case, the operator is injecting a diverting agent not for the purpose of creating SRV, but to protect it. The diverting agent temporarily seals perforations by creating a positive pressure differential across perforations along the parent wellbore. Halliburton's BioVert™ diverting agent is a suitable example. Once the diverting agent is in place, surface-generated back pressure can be held on the reservoir in the previously completed parent well(s), thus creating a pressure barriers or "halo" to the offset frac(s), thereby avoiding frac hits from an offset child well's completion/hydraulic fracturing operations. Once the offset child frac operations are complete, the diverting agent can be removed by dissolution or by flowing the parent well back.

Of course, the operator of the parent wellbore can also install a bridge plug at the bottom of the production tubing. In a more extreme case, the operator could completely pull the production tubing and associated artificial lift equipment.

In an alternate method of protecting the parent wellbore from a frac hit, the parent wellbore may be completed with the ported casing collars 4000 along its production string. In this case, the ported casing collars are not necessarily used in the parent wellbore for jetting lateral boreholes, although they certainly could be; rather, the ported casing collars are provided in lieu of conventional or hydra-jet perforations. In other words, the ported casing collars are serving as "slotted base pipes," but wherein the slots may be selectively opened and closed.

In the current method, the operator of the parent wellbore will take the step of protecting against a frac hit from an offset child well's frac by running a setting tool having two spring-loaded shift dogs 3201 and alignment blocks 3400. The setting tool may or may not be the modified whipstock 3000 as previously presented. Either way, the setting tool provides for operating the ported casing collars 4000 and setting them in a "closed" position. This method, though protecting only the parent wellbore, provides for mechanically sealing each port, and thus precluding offset frac fluids, or re-pressurized reservoir fluids, from entering the wellbore at all.

Note that if additional protection out in the reservoir is desired, the desired quantities of a product like Halliburton's BioVert® could be pumped out of each port just prior to closing the collars 4000. Otherwise, this method requires that no additional fluids be introduced into the parent wellbore.

It is acknowledged that this method would require pulling all rods, pumps, and production tubing to give the setting tool, e.g., whipstock 3000, full wellbore access so it can mateably engage with the casing collars for operation. Obviously, after the threat of offset frac fluid invasion passes, re-engaging the collar's sequentially, reopening them, and re-running production tubulars and equipment is required.

It can be seen that an improved method for stimulating a subsurface formation and achieving the desired SRV for the production of hydrocarbon fluids while avoiding frac hits in neighboring wells has been provided. By avoiding frac hits, the operator is spared the expense of cleaning out or recompleting the parent wellbore. At the same time, the operator has significantly increased the Stimulated Reservoir Volume for the child wellbore without harming adjacent parent wellbores. In the unlikely event that the operator actually does "hit" a neighbor's well, the operator can demonstrate that an effort was made to control the propagation of fractures by intentionally directing lateral boreholes away from (meaning not in the direction of) or not in the vicinity of the neighboring parent wellbores.

It will be apparent that the inventions herein described are well calculated to achieve the benefits and advantages set forth above, it will be appreciated that the inventions are susceptible to modification, variation and change without departing from the spirit thereof. Improved methods for completing a child wellbore that avoids frac hits in neighboring wells are provided. In addition, a novel casing collar that may be mechanically manipulated downhole to selectively open and close portals that provide access to a surrounding rock formation are provided.

What is claimed is:

1. A ported casing collar, comprising:

a tubular body having an upper end and a lower end, and defining an outer sleeve;

a first port disposed on a first side of the outer sleeve;

a second port disposed on a second opposing side of the outer sleeve;

an inner sleeve defining a cylindrical body rotatably and translatably residing within the outer sleeve;

a plurality of inner portals residing along the inner sleeve;

a control slot residing along an outer diameter of the inner sleeve; and a pair of opposing torque pins fixedly residing within the outer sleeve, and protruding into the control slot of the inner sleeve;

wherein the inner sleeve is configured to be manipulated by a setting tool such that:

in a first position, the inner portals of the inner sleeve are out of alignment with the first and second ports of the outer sleeve, in a second position, one of the inner portals of the inner sleeve is in alignment with the first port of the outer sleeve, in a third position, one of the inner portals of the inner sleeve is in alignment with the second port of the outer sleeve, and in a fourth position, at least a first and a second of the inner portals of the inner sleeve are in alignment with the respective first and second ports of the outer sleeve.

2. The ported casing collar of claim 1, further comprising:

a beveled shoulder along an inner diameter of the inner sleeve proximate an upper end of the inner diameter, the beveled shoulder offering a profile that leads to a pair of alignment slots on opposing sides of the inner sleeve;

wherein the pair of alignment slots are configured to receive mating alignment blocks residing along an outer diameter of the setting tool.

3. The ported casing collar of claim 2, wherein the inner sleeve is further configured to be manipulated by the setting tool such that:

in a fifth position, the inner portals of the inner sleeve are once again out of alignment with the first and second ports of the outer sleeve.

4. The ported casing collar of claim 2, further comprising:

a shift dog groove located along the inner diameter of the inner sleeve and residing proximate the upper end of the tubular body;

wherein the shift dog groove is configured to receive one or more mating shift dogs also residing along the outer diameter of the setting tool.

5. The ported casing collar of claim 4, further comprising:

at least two shear screws residing in the outer sleeve and extending into the inner sleeve, wherein the shear screws fix a position of the inner sleeve relative to the outer sleeve, until sheared by a longitudinal or rotational force applied by the setting tool.

6. The ported casing collar of claim 5, further comprising:

a first swivel secured to the tubular body at the upper end; and a second swivel secured to the tubular body at the lower end;

wherein each said swivel is configured to be threadedly connected to a joint of production casing.

7. The ported casing collar of claim 6, wherein:

the outer sleeve comprises an enlarged wall portion creating an eccentric profile to the tubular body;

the enlarged wall portion provides added weight to the tubular body along a side, such that when the ported casing collar is placed along a horizontal leg of a wellbore, the first and second swivels permit the tubular body to rotate such that the enlarged wall portion gravitationally rotates to at or near a true vertical bottom of the horizontal leg; and the ported casing collar is configured such that upon such rotation, the first port of the outer sleeve and the opposing second port of the outer sleeve are positioned horizontally within the wellbore.

8. The ported casing collar of claim 6, wherein:

the outer sleeve comprises an enlarged wall portion creating an eccentric profile to the tubular body;

the enlarged wall portion provides added weight to the tubular body along a side, such that when the ported casing collar is placed along a horizontal leg of a wellbore, the first and second swivels permit the tubular body to rotate such that the enlarged wall portion gravitationally rotates to at or near a true vertical bottom of the horizontal leg; and subsequent to the enlarged wall portion gravitationally rotating to at-or-near the true vertical bottom, the ported casing collar is configured such the first port of the outer sleeve is positioned less than or greater than true horizontal, and the opposing second port of the outer sleeve is positioned less than or greater than true horizontal, such that a vector drawn from a center of the first port of the outer sleeve through a center of the second port of the outer sleeve comprises a straight line that is at-or-near parallel to a bedding plane of g host pay zone.

9. The ported casing collar of claim 6, wherein:

the outer sleeve comprises an enlarged wall portion creating an eccentric profile to the tubular body;

the enlarged wall portion provides added weight to the tubular body along a side, such that when the ported casing collar is placed along a horizontal leg of a wellbore, the first and second swivels permit the tubular body to rotate such that the enlarged wall portion gravitationally rotates to at or near a true vertical bottom of the horizontal leg; and subsequent to the enlarged wall portion gravitationally rotating to at-or-near the true vertical bottom, the ported casing collar is configured such that the first Port of the outer sleeve is positioned at-or-near a top of true vertical, and the opposing second port of the outer sleeve is positioned at-or-near a bottom of true vertical, such that a vector drawn from a center of the first port of the outer sleeve through a center of the second port of the outer sleeve would comprise a straight line that is at-or-near true vertical.

10. The ported casing collar of claim 6, wherein:

the first swivel is threadedly connected to a first joint of production casing;

the second swivel is threadedly connected to a second joint of production casing;

a first centralizer is disposed along the first joint of production casing; and a second centralizer is disposed along the second joint of production casing.

11. The ported casing collar of claim 6, wherein the one or more shift dogs is/are located along the outer diameter of the setting tool downstream of the alignment blocks.

12. The ported casing collar of claim 6, wherein:

the setting tool defines a tubular body;

the outer diameter of the setting tool receives the one or more shift dogs and the alignment blocks;

an inner diameter of the setting tool defines a curved whipstock face configured to receive a jetting hose and a connected jetting nozzle; and the setting tool comprises an exit portal, wherein the exit portal aligns with a designated one of the inner portals of the inner sleeve when the alignment blocks of the setting tool are placed within the alignment slots.

13. The ported casing collar of claim 12, wherein:

the inner diameter of the setting tool comprises a bending tunnel for receiving the jetting hose and the connected jetting nozzle;

and the whipstock face resides at a lower end of the bending tunnel and spans the outer diameter of the setting tool.

14. The ported casing collar of claim 13, wherein:

a toe of the whipstock face is the exit portal; and the bending tunnel is configured to receive the jetting hose and the connected jetting nozzle such that the jetting hose travels across the whipstock face to the exit portal.

15. The ported casing collar of claim 14, wherein:

a heel of the whipstock face is open such that when the jetting hose travels across the whipstock face, the jetting hose is in contact with the inner sleeve at a touch point; and a tangent line of an arcuate path provided by the whipstock face at the exit portal is perpendicular to a longitudinal axis of the setting tool.

16. The ported casing collar of claim 14, wherein:

the setting tool is configured to rotate freely at an end of a run-in string;

outer faces of the alignment blocks protrude from the outer diameter of the setting tool;

each alignment block comprises a plurality of springs that bias individual block segments outwardly; and the block segments comprising the respective alignment blocks are configured to ride along the beveled shoulder of the inner diameter of the inner sleeve, rotating the setting tool, and landing the alignment blocks in the alignment slots of the inner sleeve.

17. The ported casing collar of claim 12, wherein each of the swivels comprises:

a box end with female threads and an opposing pin end with male threads, each for threadedly connecting with an adjoining joint of production casing or an adjoining ported casing collar;

a top sub that transitions from the box end;

a bottom sub;

a bearing housing threadedly connected to the top sub;

upper bearings residing between a lower end of the top sub and an upper end of the bottom sub, and within an inner diameter of the bearing housing, that permit relative rotational movement between the top sub and the bottom sub:

lower bearings residing between an upper shoulder of the bearing housing and a lower shoulder of the bottom sub, also within the inner diameter of the bearing housing, and facilitating the relative rotational movement between the bearing housing and the bottom sub;

a snap ring;

a clutch residing below the bearing housing and around a portion of the bottom sub; and shear pins preventing the relative rotational movement between the bearing housing and the bottom sub;

wherein:

the top sub and the bottom sub are free to rotate in either clockwise or counterclockwise directions;

the bottom sub comprises a beveled upper shoulder which, upon receipt of a hydraulic pressure force from within, urges the clutch away from the bearing housing, shearing the shear pins;

continued movement of the clutch away from the bearing housing allows the snap ring to engage the clutch, locking the clutch in place; and still further movement of the clutch away from the bearing housing matingly engages a base of the bearing housing.

18. A method of accessing a rock matrix in a subsurface formation, comprising:

providing a ported casing collar, wherein the ported casing collar comprises:

a tubular body defining an upper end and a lower end, the tubular body defining an outer sleeve;

a first port disposed on a first side of the outer sleeve;

a second port disposed on a second opposing side of the outer sleeve;

an inner sleeve defining a cylindrical body rotatably residing within the outer sleeve;

a plurality of inner portals residing along the inner sleeve;

a control slot residing along an outer diameter of the inner sleeve; and a pair of opposing torque pins fixedly residing within the outer sleeve, and protruding into the control slot of the inner sleeve;

threadedly securing the upper end of the tubular body to a first joint of production casing;

threadedly securing the lower end of the tubular body to a second joint of production casing;

running the first and second joints of production casing and the ported casing collar into a horizontal portion of a wellbore;

running a setting tool into the wellbore; and manipulating the setting tool to move the inner sleeve relative to the torque pins to selectively align one or more of the inner portals of the inner sleeve with the first and/or second ports of the outer sleeve, wherein the ported casing collar further comprises:

the inner sleeve is in a first position when the ported casing collar is run into the wellbore, wherein the inner portals of the inner sleeve are out of alignment with the first and second ports of the outer sleeve; and manipulating the setting tool comprises:

placing the inner sleeve in a second position, wherein one of the inner portals of the inner sleeve is in alignment with the first port of the outer sleeve, placing the inner sleeve in a third position, wherein one of the inner portals of the inner sleeve is in alignment with the second port of the outer sleeve, and placing the inner sleeve in a fourth position, wherein at least a pair of the inner portals of the inner sleeve are together in alignment with the respective first and second ports of the outer sleeve.

19. The method of claim 18, wherein the ported casing collar further provides:

a beveled shoulder along an inner diameter of the inner sleeve proximate an upper end of the inner diameter, the beveled shoulder offering a profile that leads to a pair of alignment slots on opposing sides of the inner sleeve; and the pair of alignment slots are configured to receive mating alignment blocks residing along an outer diameter of the setting tool.

20. The method of claim 19, wherein the inner sleeve of the ported casing collar is further configured to be manipulated by the setting tool such that:

in a fifth position, the inner portals of the inner sleeve are once again out of alignment with the first and second ports of the outer sleeve.

21. The method of claim 19, wherein the ported casing collar further comprises:

a shift dog groove located along an inner diameter of the inner sleeve and residing proximate the upper end of the tubular body; and at least two shear screws residing in the outer sleeve and extending into the inner sleeve, wherein the shear screws fix a position of the inner sleeve relative to the outer sleeve, until sheared by a longitudinal or rotational force applied by the setting tool;

and wherein the shift dog groove is configured to receive one or more mating shift dogs residing along an outer diameter of the setting tool.

22. The method of claim 21, wherein the ported casing collar further comprises:

a first swivel secured to the tubular body at the upper end; and a second swivel secured to the tubular body at the lower end;

wherein the tubular body is threadedly connected to the first joint of production casing through the first swivel, and the tubular body is threadedly connected to the second joint of production casing through the second swivel.

23. The method of claim 22, wherein:

the outer sleeve of the ported casing collar comprises an enlarged wall portion creating an eccentric profile to the tubular body;

the enlarged wall portion provides added weight to the tubular body along a side, such that when the ported casing collar is placed along a horizontal leg of the wellbore, the first and second swivels permit the tubular body to rotate such that the enlarged wall portion gravitationally rotates to at-or-near a true vertical bottom of the horizontal leg; and the ported casing collar is configured such that upon such rotation, the first port of the outer sleeve and the opposing second port of the outer sleeve are positioned horizontally within the wellbore.

24. The method of claim 22, wherein:

the outer sleeve of the ported casing collar comprises an enlarged wall portion creating an eccentric profile to the tubular body;

the enlarged wall portion provides added weight to the tubular body along a side, such that when the ported casing collar is placed along a horizontal leg of the wellbore, the first and second swivels permit the tubular body to rotate such that the enlarged wall portion gravitationally rotates to at-or-near a true vertical bottom of the horizontal leg; and subsequent to the enlarged wall portion gravitationally rotating to at-or-near the true vertical bottom, the ported casing collar is configured such that the first port of the outer sleeve is positioned less than or greater than true horizontal, and the opposing second port of the outer sleeve is positioned less than or greater than true horizontal, such that a vector drawn from a center of the first port of the outer sleeve through a center of the second port of the outer sleeve comprises a straight line that is at-or-near parallel to a bedding plane of a host pay zone.

25. The method of claim 22, wherein:

the outer sleeve of the ported casing collar comprises an enlarged wall portion creating an eccentric profile to the tubular body;

the enlarged wall portion provides added weight to the tubular body along a side, such that when the ported casing collar is placed along a horizontal leg of the wellbore, the first and second swivels permit the tubular body to rotate such that the enlarged wall portion gravitationally rotates to at-or-near a true vertical bottom of the horizontal leg; and subsequent to the enlarged wall portion gravitationally rotating to at-or-near a true vertical bottom, the ported casing collar is configured such the first port of the outer sleeve is positioned at-or-near the top of true vertical, and the opposing second Port of the outer sleeve is positioned at-or-near the bottom of true vertical, such that a vector drawn from a center of the first port of the outer sleeve through a center of the second port of the outer sleeve would comprise a straight line that is at-or-near true vertical.

26. The method of claim 22, wherein:

the one or more shift dogs is/are located along the outer diameter of the setting tool;

the setting tool defines a tubular body;

the outer diameter of the setting tool receives the one or more shift dogs and the alignment blocks;

an inner diameter of the setting tool defines a curved whipstock face configured to receive a jetting hose and a connected jetting nozzle; and the setting tool comprises an exit portal, wherein the exit portal aligns with a designated one of the inner portals of the inner sleeve when the alignment blocks are placed within the alignment slots.

27. The method of claim 26, wherein:

the inner diameter of the setting tool comprises a bending tunnel for receiving the jetting hose and the connected jetting nozzle;

the whipstock face resides at a lower end of the bending tunnel and spans the entire outer diameter of the setting tool;

a toe of the whipstock face is the exit portal; and the bending tunnel is configured to receive the jetting hose and the connected jetting nozzle such that the jetting hose travels across the whipstock face to the exit portal.

28. The method of claim 26, wherein:

the setting tool is configured to rotate freely at a end of a run-in string;

outer faces of the alignment blocks protrude from the outer diameter of the setting tool;

each alignment block comprises a plurality of springs that bias individual block segments outwardly; and when the setting tool is lowered into the inner diameter of the inner sleeve, the block segments comprising the respective alignment blocks are configured to ride along the beveled shoulder, rotating the setting tool, and landing the alignment blocks in the alignment slots of the inner sleeve.

29. The method of claim 26, wherein manipulating the setting tool to move the inner sleeve relative to the torque pins comprises:

applying a downward force to the setting tool and landing the one or more shift dogs of the setting tool into the shift dog groove of the inner sleeve, the inner sleeve being in its first position;

the whipstock face is a whipstock face of a whipstock;

rotating the whipstock clockwise to apply torque to the inner sleeve through the alignment blocks, and place the torque pins in a first axial portion of the control slot; and applying an upward force to the setting tool and the connected inner sleeve to shear the shear screws and position the torque pins along the first axial portion of the control slot, followed by a counter-clockwise rotation of the setting tool which moves the control slot relative to the torque pins and places the inner sleeve in its second position.

30. The method of claim 29, wherein manipulating the setting tool to move the inner sleeve relative to the torque pins further comprises:

again rotating the whipstock clockwise to apply torque to the inner sleeve through the alignment blocks and place the torque pins in a second axial portion of the control slot;

again applying an upward force to the setting tool and the connected inner sleeve, followed by another clockwise rotation of the setting tool, to move the control slot relative to the torque pins and place the inner sleeve in its third position;

rotating the whipstock counter-clockwise to apply torque to the inner sleeve through the alignment blocks and place the torque pins back in the second axial portion of the control slot; and again applying an upward force to the setting tool and the connected inner sleeve to position the torque pins along the second axial portion of the control slot, followed by another clockwise rotation of the setting tool which moves the control slot relative to the torque pins and places the inner sleeve in its fourth position.

31. The method of claim 30, wherein manipulating the setting tool to move the inner sleeve relative to the torque pins further comprises:

rotating the whipstock counter-clockwise to apply torque to the inner sleeve through the alignment blocks and place the torque pins in a third axial portion of the control slot;

again applying an upward force to the setting tool and the connected inner sleeve to position the torque pins along the third axial portion of the control slot, followed by a counter-clockwise rotation of the setting tool, to move the control slot relative to the torque pins and place the inner sleeve in its fifth position.

32. The method of claim 26, wherein each of the first and second swivels comprises:

a box end with female threads and an opposing pin end with male threads, each for threadedly connecting with an adjoining joint of production casing or an adjoining ported casing collar;

a top sub that transitions from the box end;

a bottom sub;

a bearing housing threadedly connected to the top sub;

upper bearings residing between a lower end of the top sub and an upper end of the bottom sub, and within an inner diameter of the bearing housing, that permit relative rotational movement between the top sub and the bottom sub;

lower bearings residing between an upper shoulder of the bearing housing and a lower shoulder of the bottom sub, also within the inner diameter of the bearing housing, and facilitating relative rotational movement between the bearing housing and the bottom sub;

a snap ring;

a clutch residing below the bearing housing and around a portion of the bottom sub; and shear pins preventing the relative rotational movement between the bearing housing and the bottom sub;

wherein:

the top sub and the bottom sub are free to rotate in either clockwise or counterclockwise directions;

the bottom sub comprises a beveled upper shoulder which, upon receipt of a hydraulic pressure force from within, urges the clutch away from the bearing housing, shearing the shear pins;

continued movement of the clutch away from the bearing housing allows the snap ring to engage the clutch, locking the clutch in place; and still further movement of the clutch away from the bearing housing matingly engages a base of the bearing housing.

33. The method of claim 26, further comprising:

locking the first and second swivels from rotating, and locking the outer sleeve as well.

34. The method of claim 33, further comprising:

placing the inner sleeve in its second position;

activating a downhole hydraulic jetting assembly to move the jetting hose and the connected jetting nozzle along the whipstock face;

injecting a fracturing fluid through the jetting hose and the connected jetting nozzle;

advancing the jetting hose and the connected jetting nozzle through the inner portal of the inner sleeve and the first port of the outer sleeve which are aligned in the second position; and hydraulically jetting a first lateral borehole into the rock matrix.

35. The method of claim 34, further comprising:

withdrawing the jetting hose and the connected jetting nozzle from the first port of the outer sleeve;

placing the inner sleeve in its third position;

activating the downhole hydraulic jetting assembly to again move the jetting hose and the connected jetting nozzle along the whipstock face;

again injecting the fracturing fluid through the jetting hose and the connected jetting nozzle;

advancing the jetting hose and the connected jetting nozzle through the inner portal of the inner sleeve and the second port of the outer sleeve which are aligned in the third position; and hydraulically jetting a second lateral borehole into the rock matrix.

36. The method of claim 35, wherein each of the first and second lateral boreholes extends at least 10 feet from the ported casing collar and at a substantially transverse angle from the ported casing collar.

37. A method of closing off access to a rock matrix in a subsurface formation, comprising:

locating or providing a wellbore having a string of production casing therein, wherein the string of production casing comprises a ported casing collar threadedly connected to the production casing as a tubular joint, wherein the ported casing collar comprises:

a tubular body defining an upper end and a lower end, the tubular body defining an outer sleeve;

one or more portals disposed along the outer sleeve serving as one or more perforations;

an inner sleeve defining a cylindrical body rotatably residing within the outer sleeve;

one or more inner portals residing along the inner sleeve;

a control slot residing along an outer diameter of the inner sleeve; and a pair of opposing torque pins fixedly residing within the outer sleeve, and protruding into the control slot of the inner sleeve;

running a setting tool into the wellbore; and manipulating the setting tool to move the control slot relative to the torque pins to move one of the one or more inner portals of the inner sleeve out of alignment with one of the one or more portals of the outer sleeve, wherein the ported casing collar further comprises:

a beveled shoulder along an inner diameter of the inner sleeve proximate an upstream end of the inner diameter, the beveled shoulder offering a profile that leads to a pair of alignment slots on opposing sides of the inner sleeve;

the pair of alignment slots are configured to receive mating alignment blocks residing along an outer diameter of the setting tool;

a shift dog groove located along the inner diameter of the inner sleeve and residing proximate the upper end of the tubular body below the alignment slots; and at least two shear screws residing in the outer sleeve and extending into the inner sleeve, wherein the shear screws tix a position of the inner sleeve relative to the outer sleeve, until sheared by a longitudinal or rotational force applied by the setting tool; and wherein the shift dog groove is configured to receive a mating shift dog residing along an outer diameter of the setting tool distal to the alignment blocks.

38. The method of claim 37, wherein:

the wellbore is a parent wellbore in a hydrocarbon-bearing field;

a hydraulic fracturing operation is being conducted in connection with an offset well in the hydrocarbon-producing field; and the method further comprises:

running the setting tool into the parent wellbore; and manipulating the inner sleeve to place one of the one or more inner portals in the inner sleeve out of alignment with one of the one or more portals of the outer sleeve to avoid a frac hit in connection with the hydraulic fracturing operation in the offset wellbore.

* * * * *